US007879206B2

(12) United States Patent
Matthews

(10) Patent No.: US 7,879,206 B2
(45) Date of Patent: Feb. 1, 2011

(54) SYSTEM FOR INTERPHASE CONTROL AT AN ELECTRODE/ELECTROLYTE BOUNDARY

(76) Inventor: Mehlin Dean Matthews, Box 24, Saratoga, CA (US) 95071

( * ) Notice: Subject to any disclaimer, the term of this patent is extended or adjusted under 35 U.S.C. 154(b) by 1289 days.

(21) Appl. No.: 11/439,932

(22) Filed: May 23, 2006

(65) Prior Publication Data

US 2007/0272546 A1 Nov. 29, 2007

(51) Int. Cl.
*C25B 9/00* (2006.01)
*C25B 15/02* (2006.01)

(52) U.S. Cl. ..... 204/230.2; 204/193; 204/194

(58) Field of Classification Search ..... 204/230.2
See application file for complete search history.

(56) References Cited

U.S. PATENT DOCUMENTS 5,753,098 A * 5/1998 Bess et al. ..... 205/501
6,228,516 B1 * 5/2001 Denton et al. ..... 429/7
2003/0075456 A1 * 4/2003 Collins et al. ..... 205/710
2003/0228727 A1 * 12/2003 Guerra ..... 438/200
2004/0075940 A1 * 4/2004 Bajorek et al. ..... 360/110

* cited by examiner

*Primary Examiner*—Harry D Wilkins, III
*Assistant Examiner*—Zulmariam Mendez
(74) *Attorney, Agent, or Firm*—M. Dean Matthews

(57) ABSTRACT

An anode and cathode for an electrolytic cell are configured as a low inductance transmission line to enable control of an interphase at an electrode surface. The anode and cathode are coupled to a switched current source by a low inductance path that include a parallel plate transmission line, a coaxial transmission line, or both. The switched current source provides switching between current sources at three or more voltages to provide fast charging and discharging of the double-layer capacitance associated with the electrode surface.

20 Claims, 47 Drawing Sheets

300

SYSTEM FOR INTERPHASE CONTROL AT AN ELECTRODE/ELECTROLYTE BOUNDARY

BACKGROUND OF THE INVENTION

1. Field of the Invention

This invention relates to electrolytic cells.

2. Description of Related Art

The boundary between a liquid electrolyte and an electrode typically has an associated region in the electrolyte adjacent to the electrode that separates the electrode from the bulk electrolyte. This region is often referred to as an interphase. As a result of the influence of the electrode surface, the interphase has a composition that is different from the bulk electrolyte. The orientation of molecular dipoles and the concentrations of cationic and anionic species typically differ from the bulk.

Prior Art FIG. 1A shows a representation 100 of an interface between a metal and an electrolyte solution. Such an interface generally becomes electrified, with a net charge developing at the surface of the metal and a near surface region of excess ion concentration developing in the electrolyte solution. In the example of FIG. 1A the excess charge in the metal is negative and the near surface region of the electrolyte solution has an excess concentration of cations.

Prior Art FIG. 1B shows a diagram 101 of the potential that is developed by the charge separation at interface between the metal and the electrolyte solution. The near surface region of the electrolyte solution is characterized by a "double layer" that is composed of a compact layer and a diffuse layer. The compact layer (or Helmholtz layer) is a thin region adjacent to the surface that typically contains adsorbed ions and oriented dipoles. The Helmholtz layer is also often further divided into two layers defined by an inner Helmholtz plane (IHP) and an outer Helmholtz plane (OHP). A discussion on electrode/electrolyte interfaces and the interphase is presented in "Modern Electrochemistry, Vol. 2A, Fundamentals of Electrodics, Second Edition," by Bockris et al, Klewer Academic/Plenum Publishers (2000).

The Helmholtz layer typically has a thickness that is on the order of a nanometer. The diffuse layer has a less well defined thickness that is frequently characterized by the Debye length ($L_D$). For a 1:1 electrolyte the Debye length ($L_D$) is given as:

$$L_D = \frac{1}{ze}\sqrt{\frac{\varepsilon_r \varepsilon_0 kT}{2c_0}} = \frac{6.3\times 10^{-11}}{z}\sqrt{\frac{\varepsilon_r T}{c_0}}$$

T, z, e, $\in_r$, $\in_0$, k and $c_0$ are the temperature (Kelvin), valence number, electron charge, solvent relative permittivity, permittivity of free space, Boltzmann constant, and bulk electrolyte concentration (moles/$m^3$), respectively. For water with a relative dielectric constant taken as 78 at a temperature of 298K, a copper sulfate electrolyte solution at a concentration of 1 mol/$m^3$ the diffuse layer has a calculated Debye length of about 10 nm. Due to the variability of the dielectric constant of the solvent close to the electrode and other phenomena, the calculated Debye length is only approximate, but it serves to illustrate the fine scale of the interphase in an electrolytic cell.

For redox reactions to occur at an electrode surface in an electrolytic cell, the reactants and products must traverse the interphase. The rates of reaction and the nature of the reaction products are thus influenced by the state of the interphase. A particularly important feature of the interphase is that large electric fields can be developed by the application of an electric potential.

When an electric potential is applied to an electrolytic cell, the interphase will adjust to the applied potential through a variety of mechanisms. Contact adsorbed ions may become dislodged and or replaced by counterions, molecular dipoles may change orientation, and the concentration profiles of cations and anions may change. The interphase differs from the bulk electrolyte in that an electric field can have a relatively greater influence on mass transport than diffusion. Although the interphase has been studied to a considerable extent, precise manipulation of the interphase has not been adopted on a manufacturing scale.

The speed at which an ion in an electrolyte solution will travel when subjected to an electric field depends in part upon the characteristics of the ion, the solvent, and the intensity of the electric field. Concentration and other factors may also influence the speed at which an ion travels. Due to the extremely short distances associated with the interphase, the adjustments that occur in the interphase in response to an applied potential can occur in a very short period of time, on the order of a microsecond or less. Thus, a potential waveform applied to an electrolytic cell that is intended to control the makeup of the interphase should be capable of providing a precise potential level and fast transitions between potential levels.

Ideally, a system for controlling the interphase will be able to produce a square pulse at the electrode surface with minimal rise time, overshoot, fall time, and undershoot. For industrial applications, the square pulse should be able to retain its characteristics when applied to large area electrodes. In order to achieve such a waveform at the electrode surface, all circuit elements in the current path should be considered.

Prior Art FIG. 2 Shows a general schematic 200 for an equivalent circuit of an electrolytic cell. The schematic shows the resistive and reactive components of an electrochemical cell and its connections to a power supply. $C_{shunt}$ is the parasitic capacitance that exists between the connections to the two electrodes in the cell. $C_{shunt}$ is generally very small in comparison to the double layer capacitance presented by the electrochemical cell, and is only of concern for systems with extremely small electrodes.

$R_{C1}$, and $R_{C2}$ are the resistances associated with the leads connecting the electrodes to the power supply. For industrial applications in which hundreds of amps may be used at low working voltages, the magnitude of $R_{C1}$ and $R_{C2}$ are a matter of concern. Efforts are typically made to minimize conductor length and to provide sufficient cross-sectional area for the anticipated load. copper bus bars or cables are widely used.

$L_{C1}$ and $L_{C2}$ are the inductances associated with the connections between the power supply and the electrodes, and are largely ignored in equipment intended for use at DC or low frequency. Even in equipment that is intended for applications such as reverse pulse plating, inductance is ignored to a considerable extent.

For example, U.S. Pat. No. 6,224,721, "Electroplating Apparatus," Nelson et al, issued May 1, 2001, teaches the use of a coaxial conductor as a means for reducing inductance in a portion of the electrical distribution system for a plating bath. The preferred conductor assembly disclosed by Nelson is a loose circular coaxial configuration in which a tape-wrapped inner cathode conductor is placed in an outer anode conductor. Although preferred, the inductance of the coaxial segment is still on the order of 100 nanohenries. Further, Nelson does not address the inductance of the electrochemical cell itself, or the requirements for control of the interphase in the electrolytic cell.

$L_{EL1}$ and $L_{EL2}$ are the inductances associated with the electrodes that are in contact with the electrolyte. The electrode inductance in industrial electrolytic cells is largely ignored, with factors such as current distribution and areal configuration taking precedent. $R_{EL1}$ and $R_{EL2}$ are the resistances associated with the electrodes that are in contact with the electrolyte. Typically, $R_{EL1}$ and $R_{EL2}$ are small compared to the resistance of the bulk electrolyte ($R_{BE}$). For non-metallic electrode materials such as carbon or ceramic, resistance may influence design for use with high-conductivity electrolytes.

$C_{DL1}$ and $C_{DL2}$ are the double-layer capacitances associated with the electrodes that are in contact with the electrolyte. $C_{DL1}$ and $C_{DL2}$ can be quite large, but are seldom a concern for low frequency or DC electrodeposition systems. Although $C_{DL1}$ and $C_{DL2}$ can be adjusted, electrode shape and electrolyte composition are usually determined by other factors, with $C_{DL1}$ and $C_{DL2}$ being tolerated as an inevitable nuisance. In contrast to electrodeposition systems, a large $C_{DL1}$ and $C_{DL2}$ may be designed into electrochemical energy storage systems.

$Z_{F1}$ and $Z_{F2}$ are faradaic impedances associated with the charge transfer involved in redox reactions at the electrode surfaces. $Z_{F1}$ and $Z_{F2}$ are nonlinear, and dependent upon the electrode potential and nature and concentration of the reactive species. In some respects a faradaic impedance resembles the behavior of a reverse biased diode, with a redox reaction potential being analogous to a breakdown voltage.

$L_{BE}$ and $R_{BE}$ are the inductance and resistance of the bulk electrolyte, respectively. $L_{BE}$ is largely ignored in the design of electrolytic cells. The current distribution and nature of the charge carriers in an electrolyte volume can be altered to adjust $L_{BE}$, but they are usually adjusted in light of other design considerations. It is generally desired that $R_{BE}$ have a low value to reduce ohmic losses, and electrolyte composition often takes $R_{BE}$ into account. For example, sulfuric acid may be added to copper sulfate plating baths to reduce $R_{BE}$.

Systems for instrumentation and analysis typically use relatively small electrodes and thus handle relatively small currents. The switching of small currents does not produce large voltage transients and the compact size of instruments serves to provide an inherent limit on inductance. Analytical electrochemical systems have also shown a trend toward ultramicroelectrodes (UMEs) in order to avoid problems in dealing with double-layer capacitance. The prior art instrumentation approach of using miniaturization to deal with reactive circuit elements is of little use for systems that are to be scaled for manufacturing processes.

In varying degrees, the prior art has dealt with problems associated with resistive and reactive circuit elements in electrolytic systems. However, the prior art apparatus is limited in its ability to provide both the fast response that is necessary for the control of the interphase at the surface of an electrode, and the large currents required for a manufacturing process.

Thus, there is a need for a power supply system for an electrolytic cell that is capable of providing pulses with transitions on a timescale that will allow control of the interphase at an electrode/electrolyte boundary. There is also a need for an electrolytic cell system that minimizes the impact of reactive circuit elements. It is also desirable that a system for interphase control be scalable for manufacturing processes.

BRIEF SUMMARY OF THE INVENTION

Accordingly, a system for providing fast transition pulses to an electrode surface in an electrolytic cell is described herein. A switched current power supply is combined with a very low inductance current carrying structure supporting a low inductance anode/cathode assembly.

In an embodiment of the present invention the anode/cathode assembly includes a parallel plate transmission line.

In a further embodiment of the present invention the anode/cathode assembly includes a coaxial transmission line.

In another embodiment of the present invention the power supply is mounted on a transmission line structure coupled directly to the anode/cathode assembly.

In still a further embodiment the switched current supply is capable of providing pulses at three or more potential levels.

BRIEF DESCRIPTION OF THE DRAWINGS

Prior Art

Prior Art

Figure 1B:
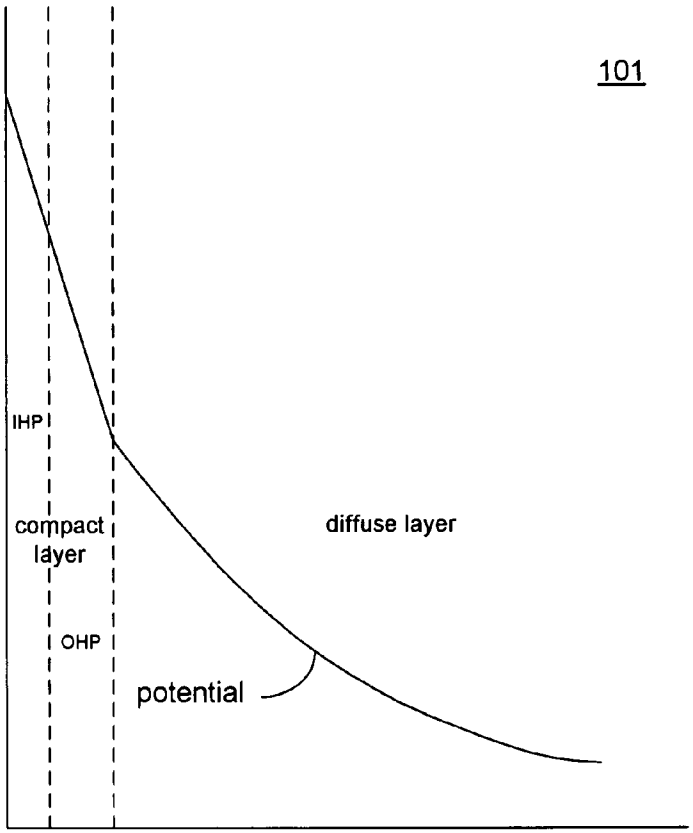
FIG. 1B (Prior Art)
FIG. 1B shows an electric potential diagram for an interphase at an electrode surface.
Figure 1A:
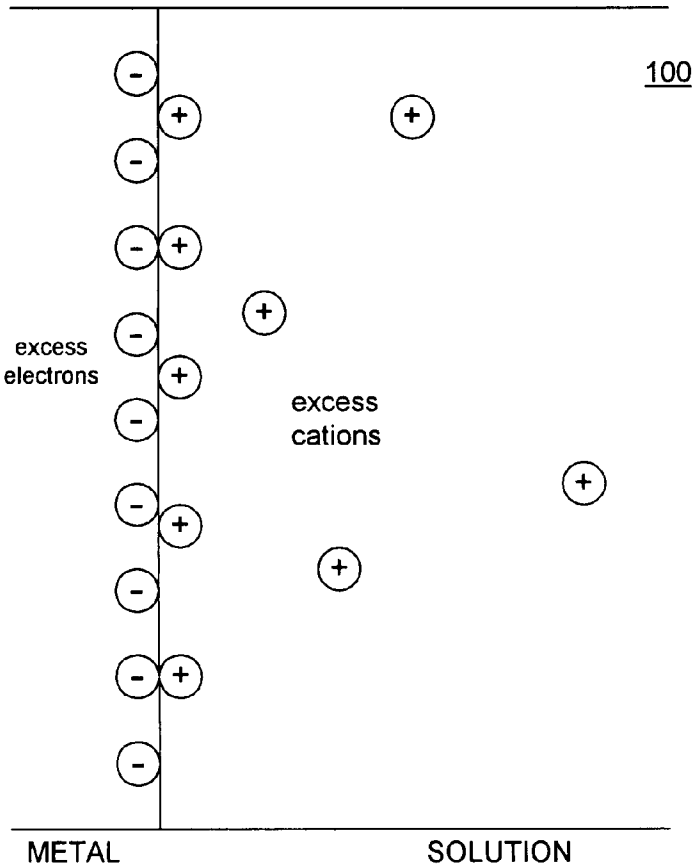
FIG. 1A (Prior Art)
FIG. 1A depicts a double layer at an electrode surface.
Figure 2:
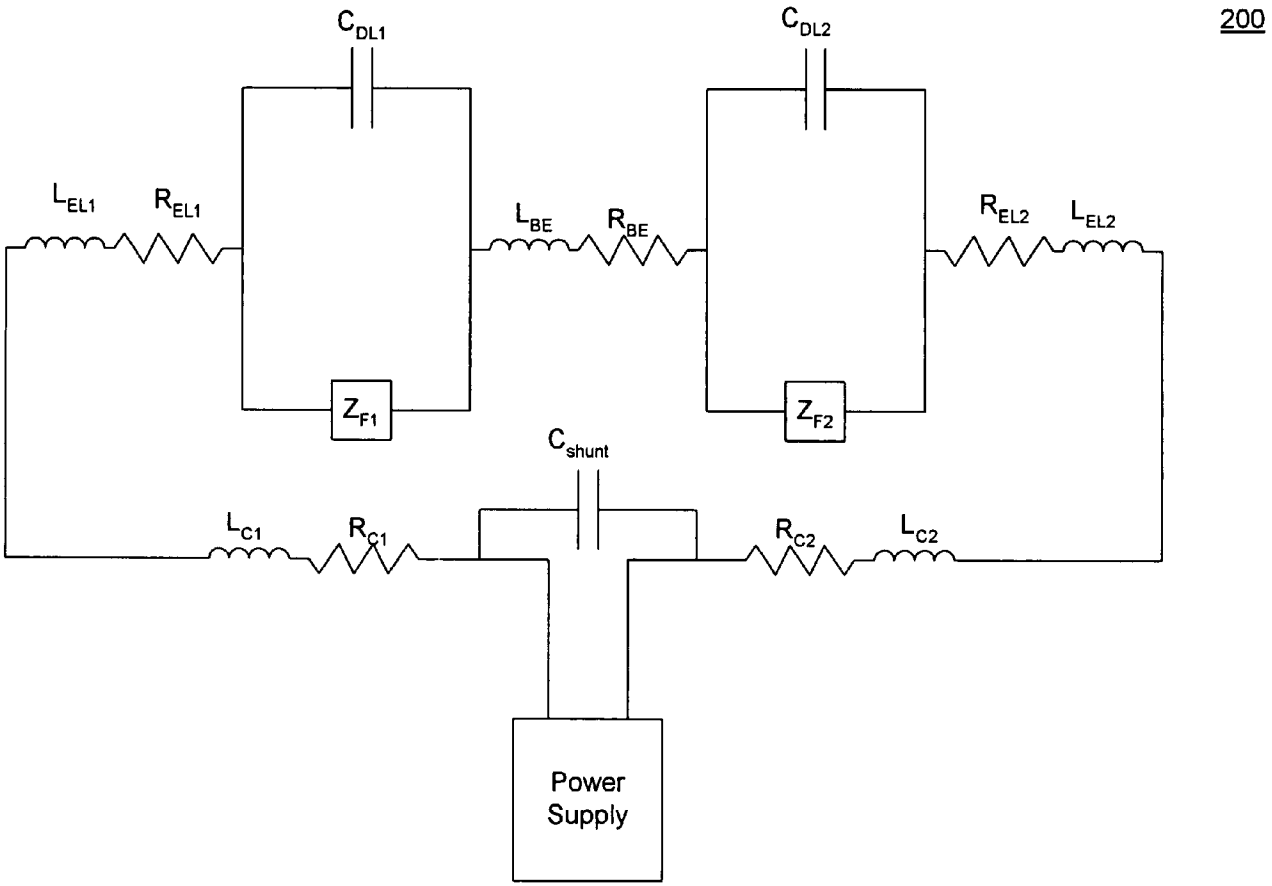
FIG. 2 (Prior Art)

Prior Art FIG. 2 Shows a general schematic for the equivalent circuit of an electrolytic cell.

Figure 3A:
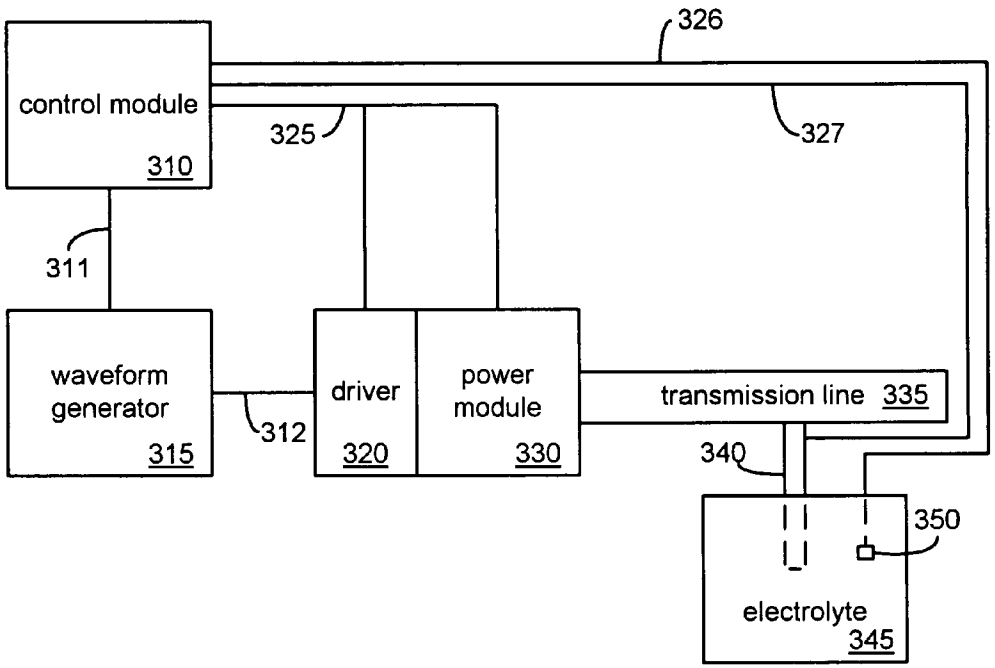

FIG. 3A shows a block diagram of an electrolytic cell interphase control system in accordance with an embodiment of the present invention.

Figure 3B:
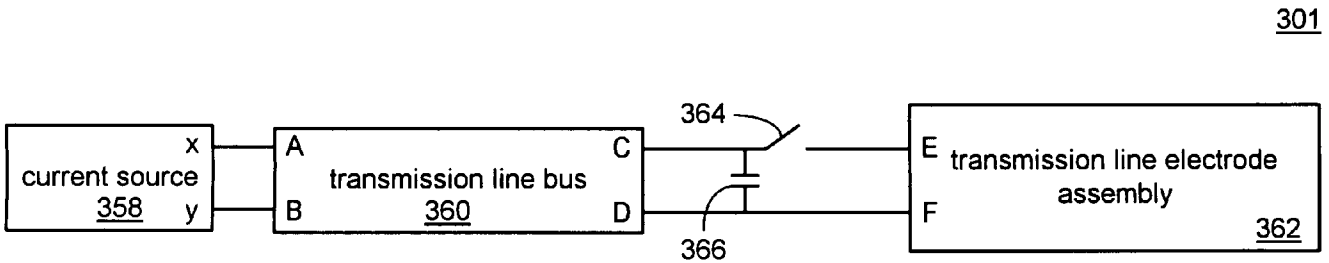

FIG. 3B shows a diagram of an interphase control circuit with a single-switched transmission line electrode assembly in accordance with an embodiment of the present invention.

Figure 3C:
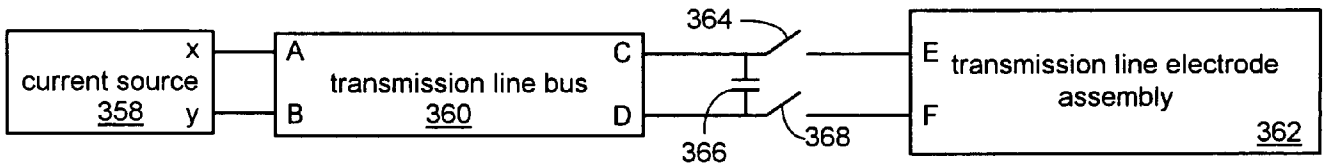

FIG. 3C shows a diagram of an interphase control circuit with a double-switched transmission line electrode assembly in accordance with an embodiment of the present invention.

Figure 3D:
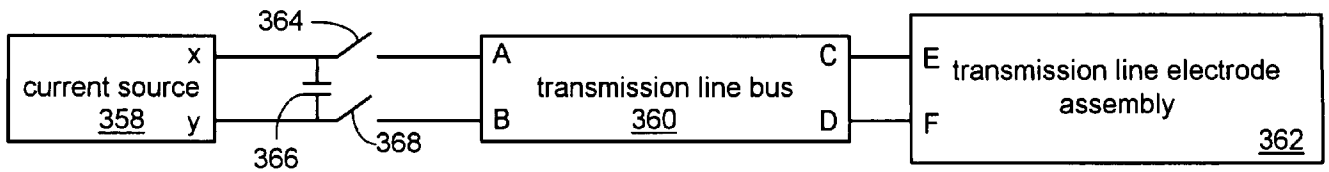

FIG. 3D shows a diagram of an interphase control circuit with a double-switched transmission line bus in accordance with an embodiment of the present invention.

Figure 3E:
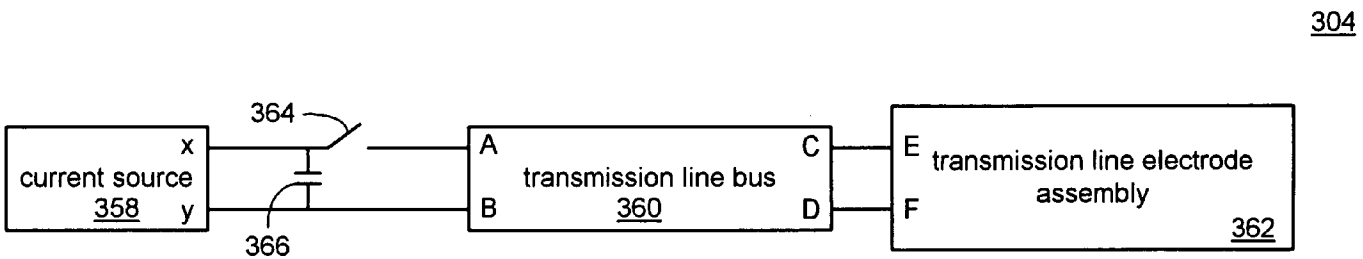

FIG. 3E shows a diagram of an interphase control circuit with a single-switched transmission line bus in accordance with an embodiment of the present invention.

Figure 3F:
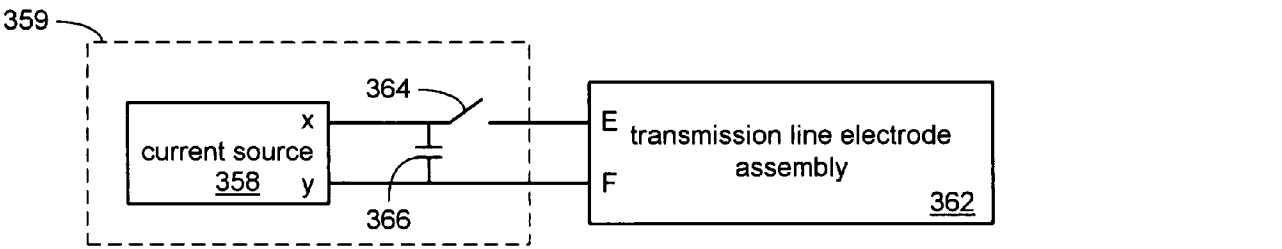

FIG. 3F shows a diagram of an interphase control circuit with a single-switched power supply in accordance with an embodiment of the present invention.

Figure 3G:
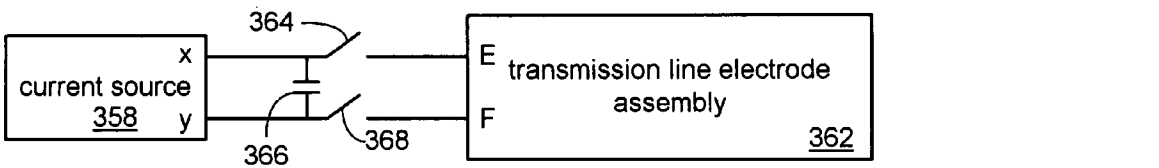

FIG. 3G shows a diagram of an interphase control circuit with a double-switched power supply in accordance with an embodiment of the present invention.

Figure 3H:
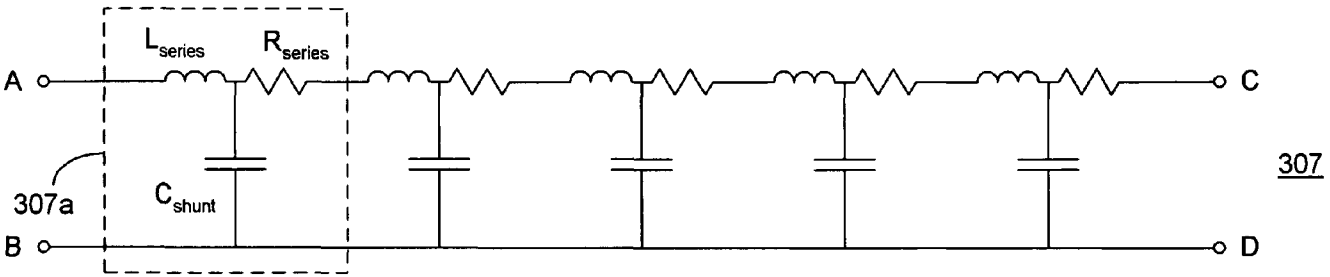

FIG. 3H shows a schematic diagram of a transmission line bus in accordance with an embodiment of the present invention.

Figure 3I:
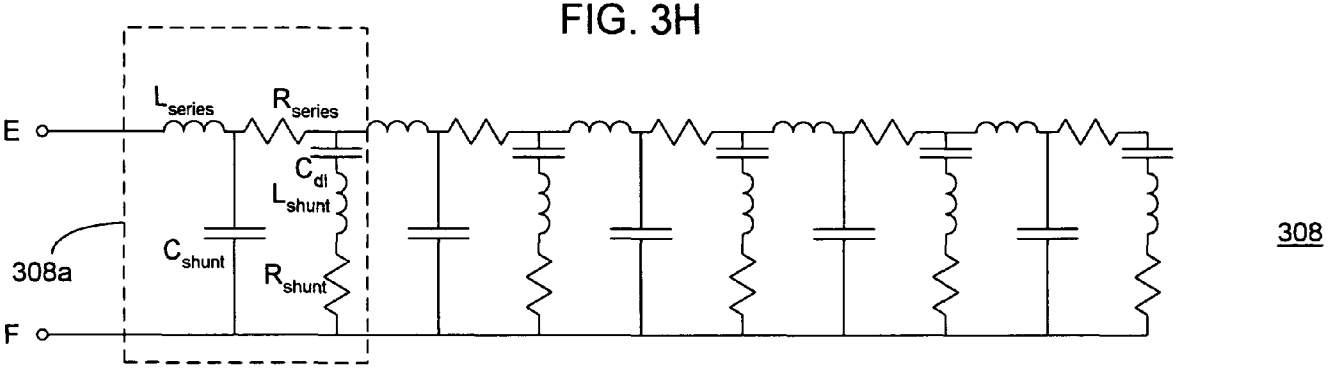

FIG. 3I shows a schematic diagram of a transmission line electrode assembly with a solid dielectric in accordance with an embodiment of the present invention.

Figure 3J:
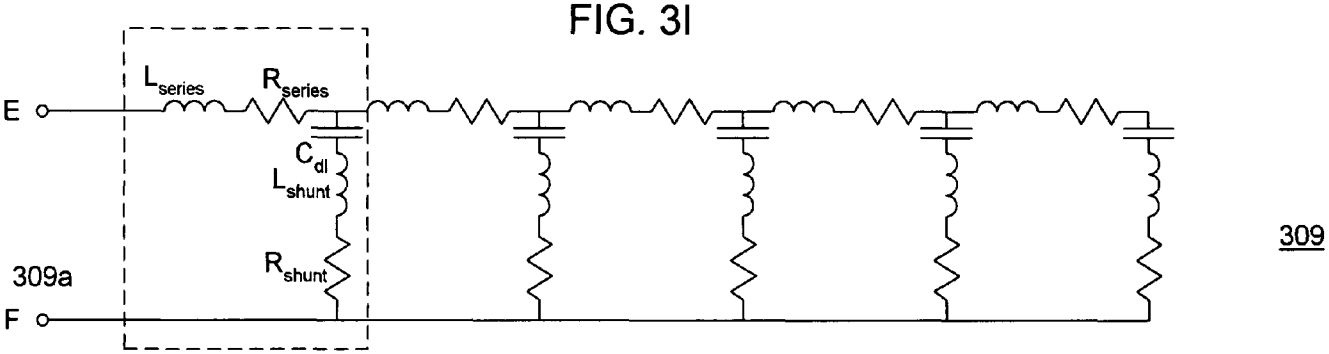

FIG. 3J shows a schematic diagram of a transmission line electrode assembly with an electrolyte dielectric in accordance with an embodiment of the present invention.

Figure 3K:
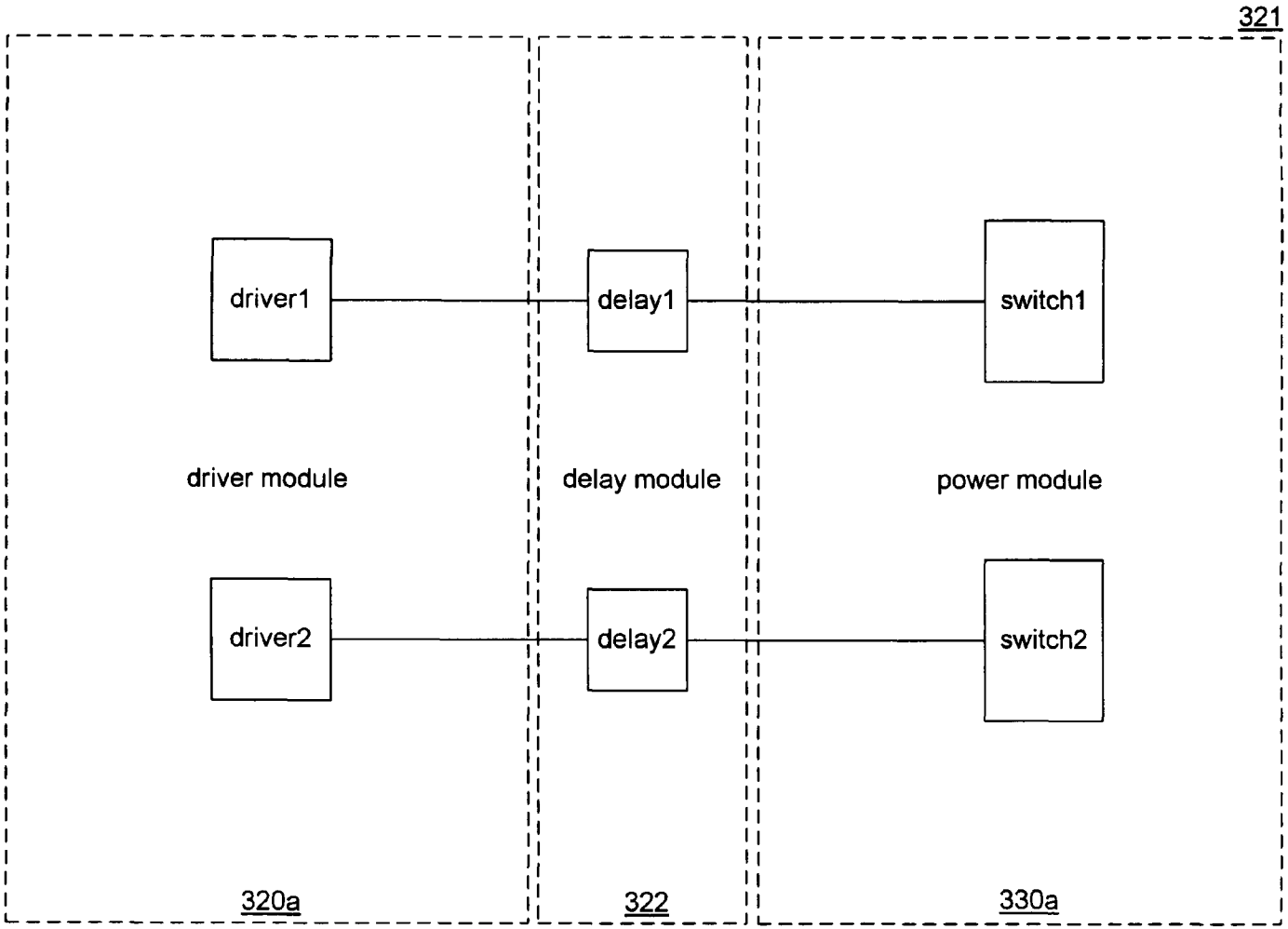

FIG. 3K shows a schematic diagram of a parallel driver module coupled to a parallel power module by a tunable delay module in accordance with an embodiment of the present invention.

Figure 4A:
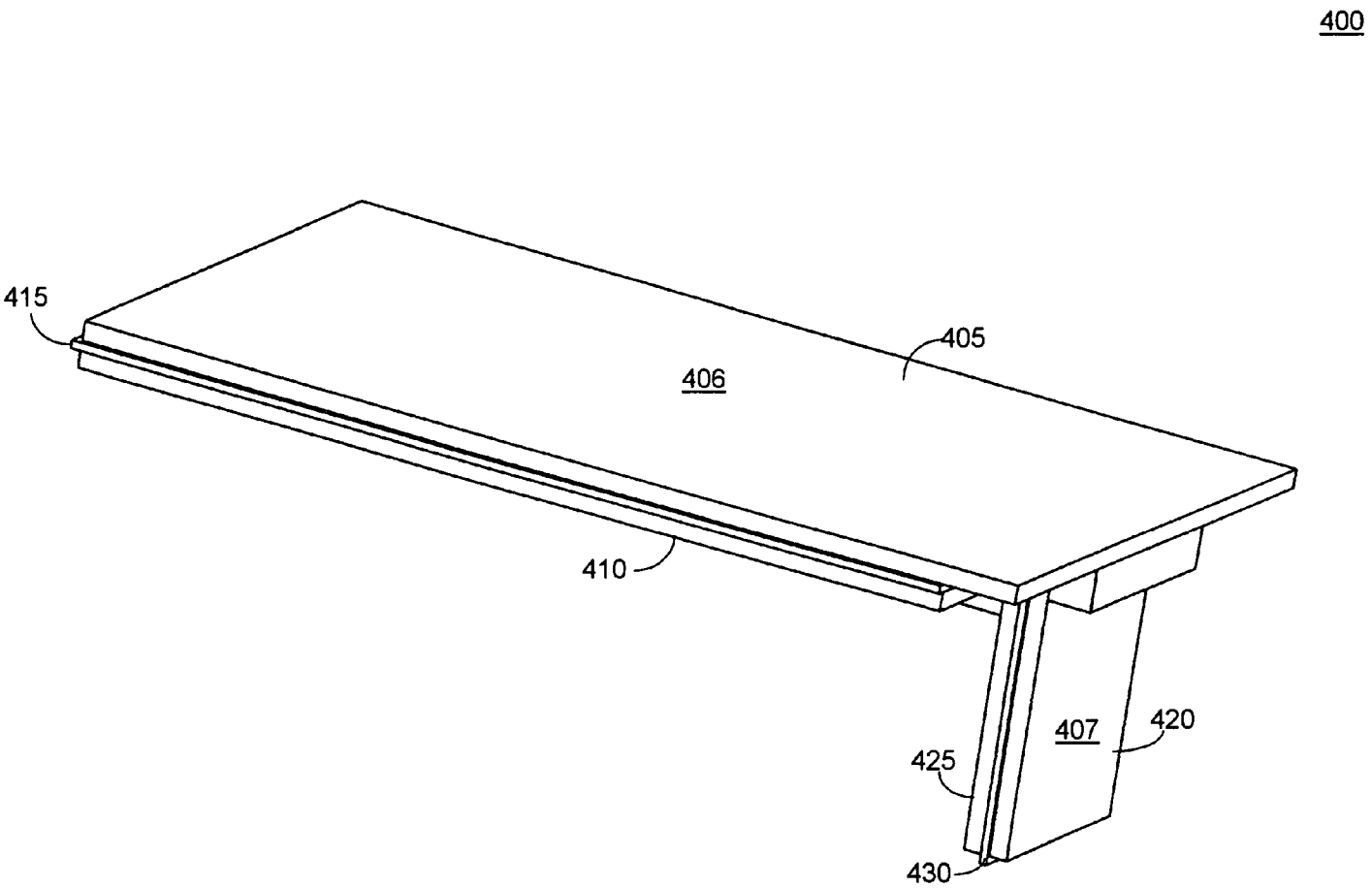

FIG. 4A shows a parallel plate transmission line with a solid dielectric filled gap in accordance with an embodiment of the present invention.

Figure 4B:
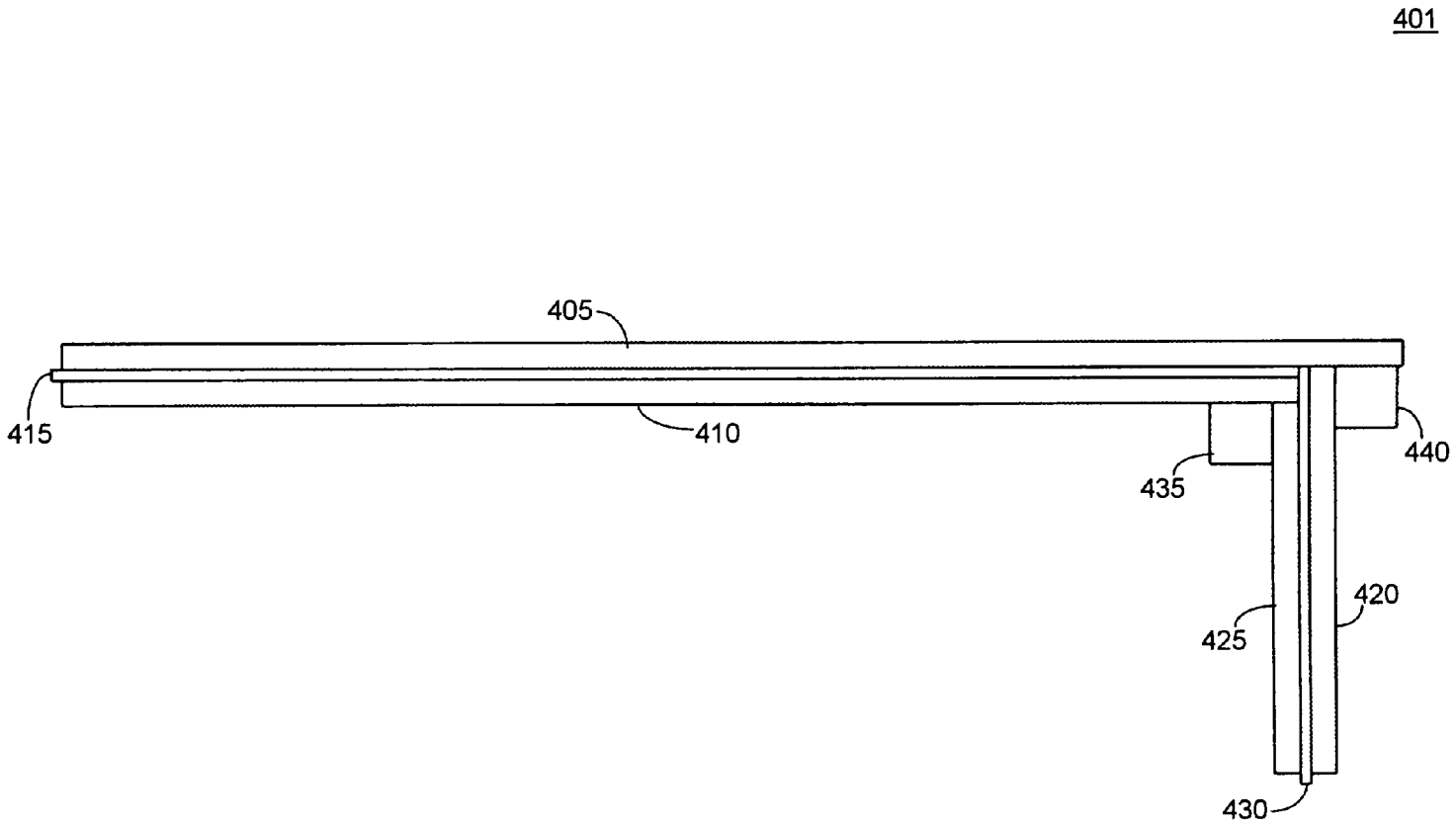

FIG. 4B shows a cross-section view of the parallel plate transmission line of FIG. 4A.

Figure 4C:
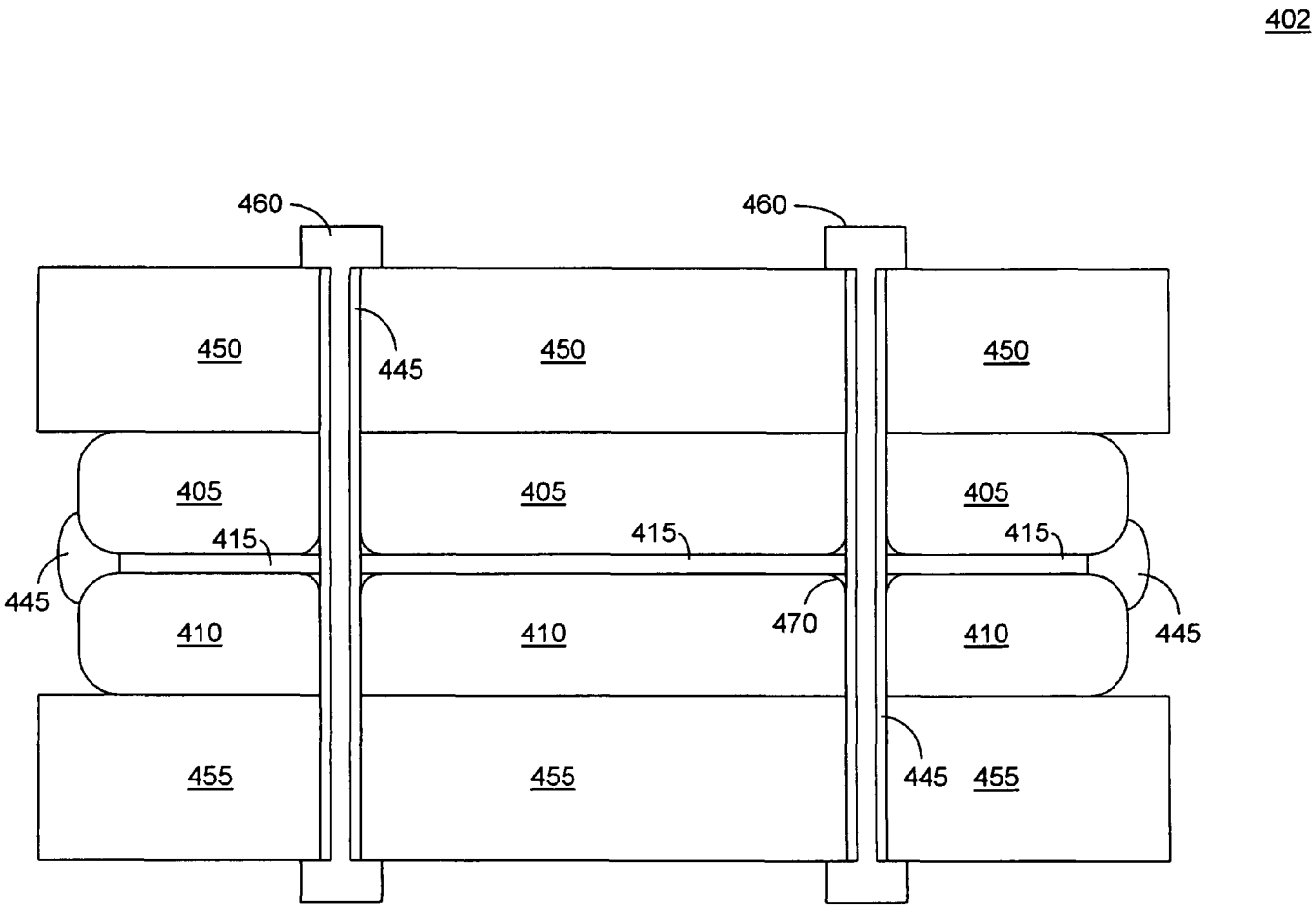

FIG. 4C shows a cross-section view of a construction for a parallel plate transmission line in accordance with an embodiment of the present invention.

Figure 4D:
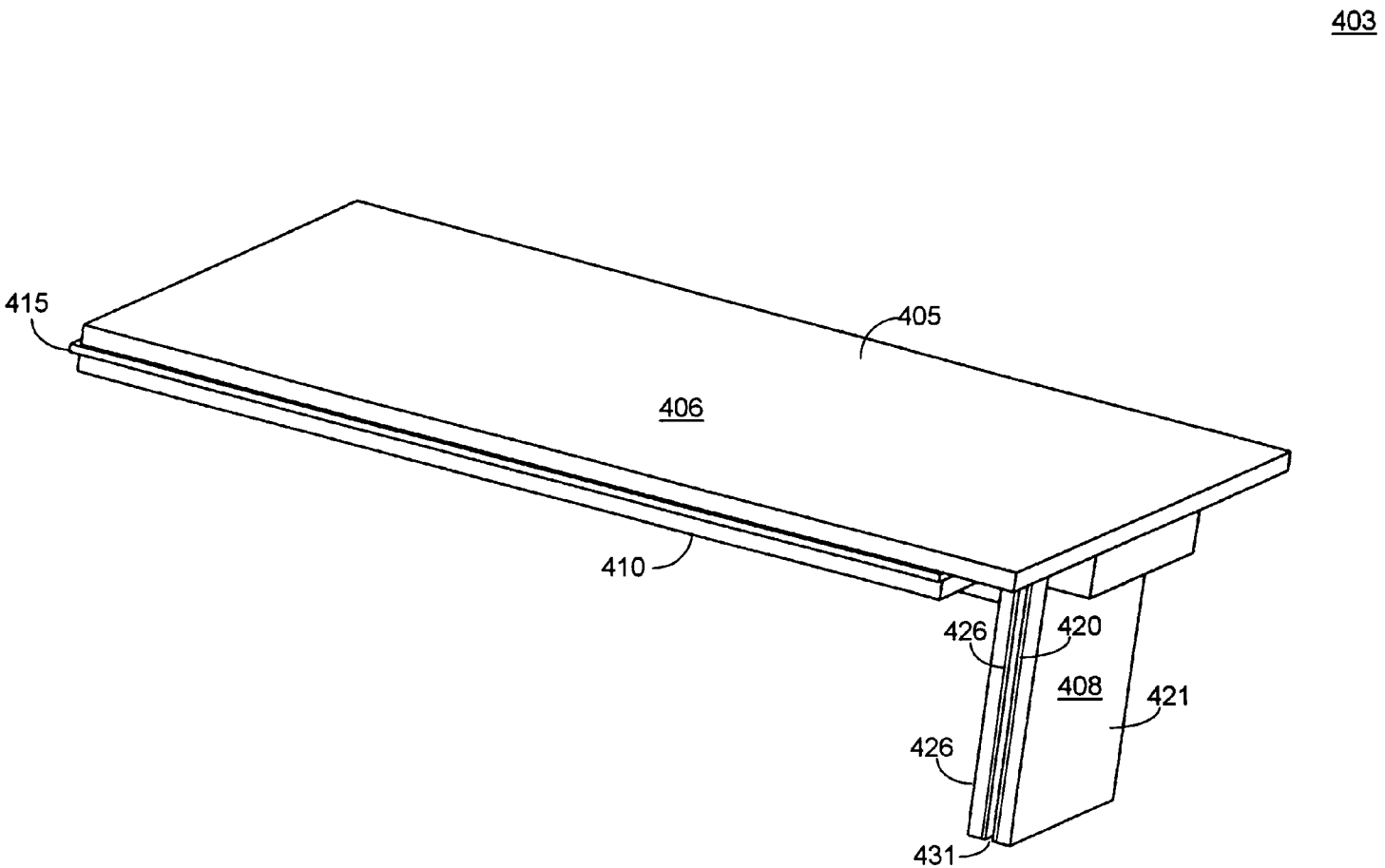

FIG. 4D Shows a parallel plate transmission line with an electrolyte filled gap in accordance with an embodiment of the present invention.

Figure 4E:
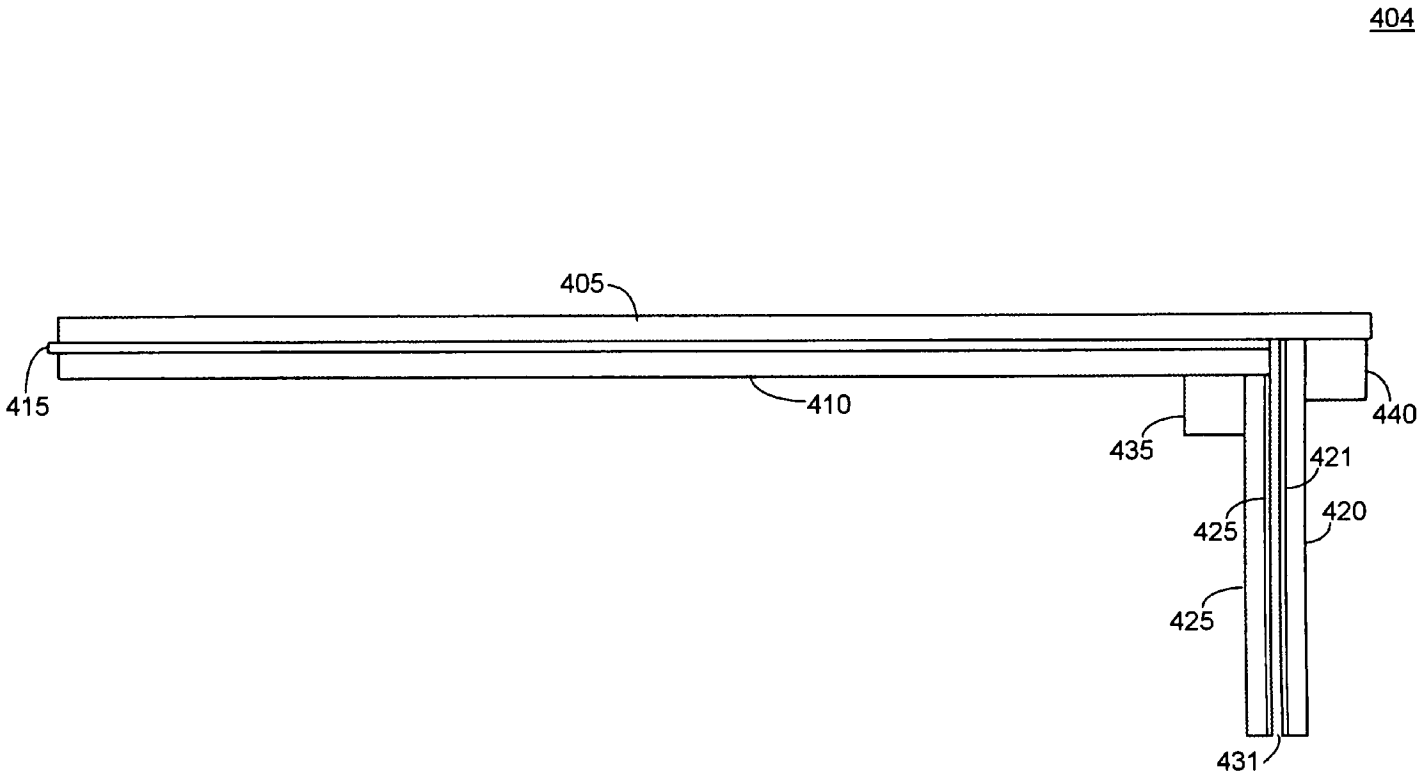

FIG. 4E Shows a cross-section view of the parallel plate transmission line of FIG. 4C.

Figure 5A:
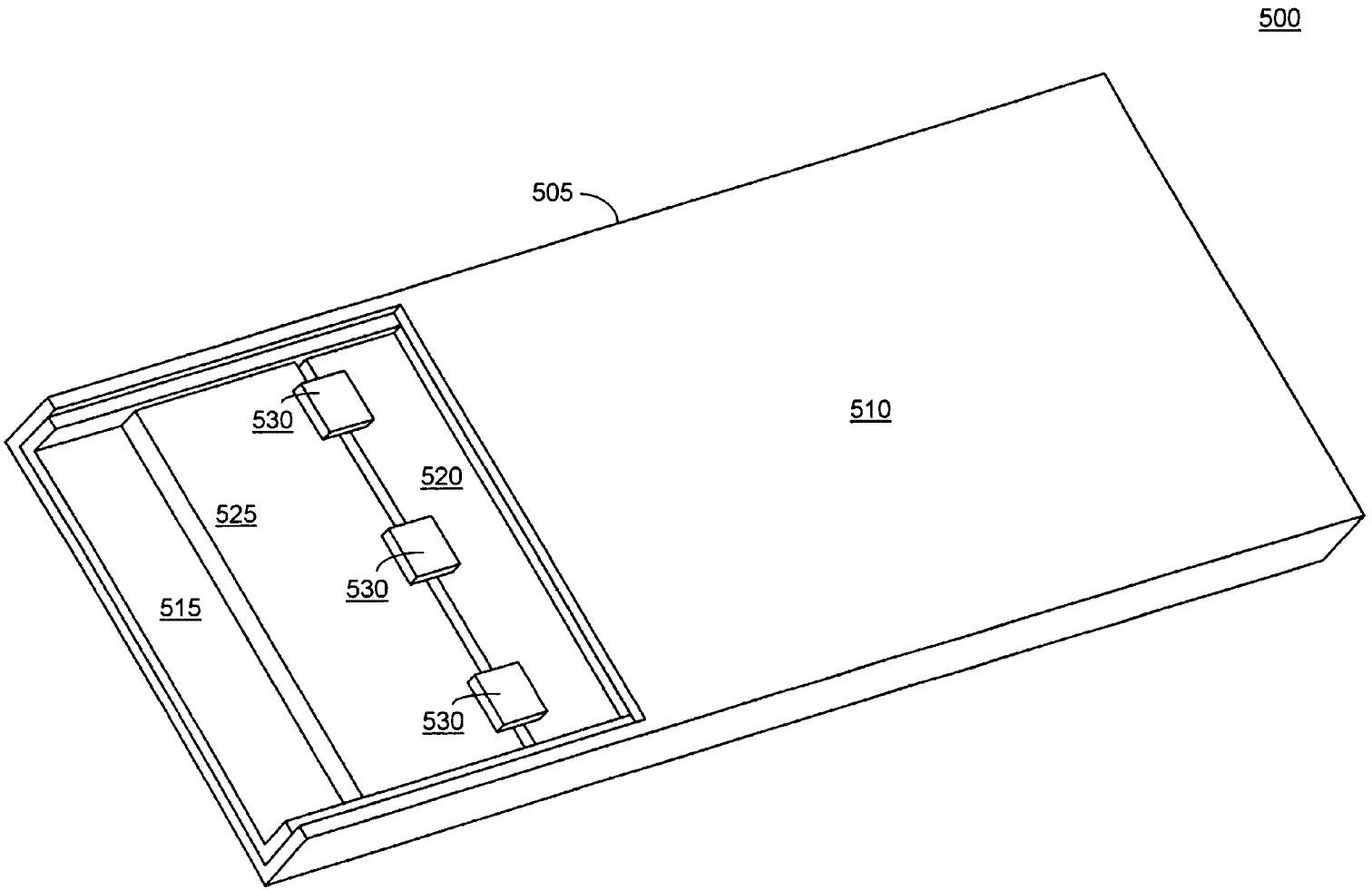

FIG. 5A shows a top perspective view of a switched coaxial transmission line bus in accordance with an embodiment of the present invention.

Figure 5B:
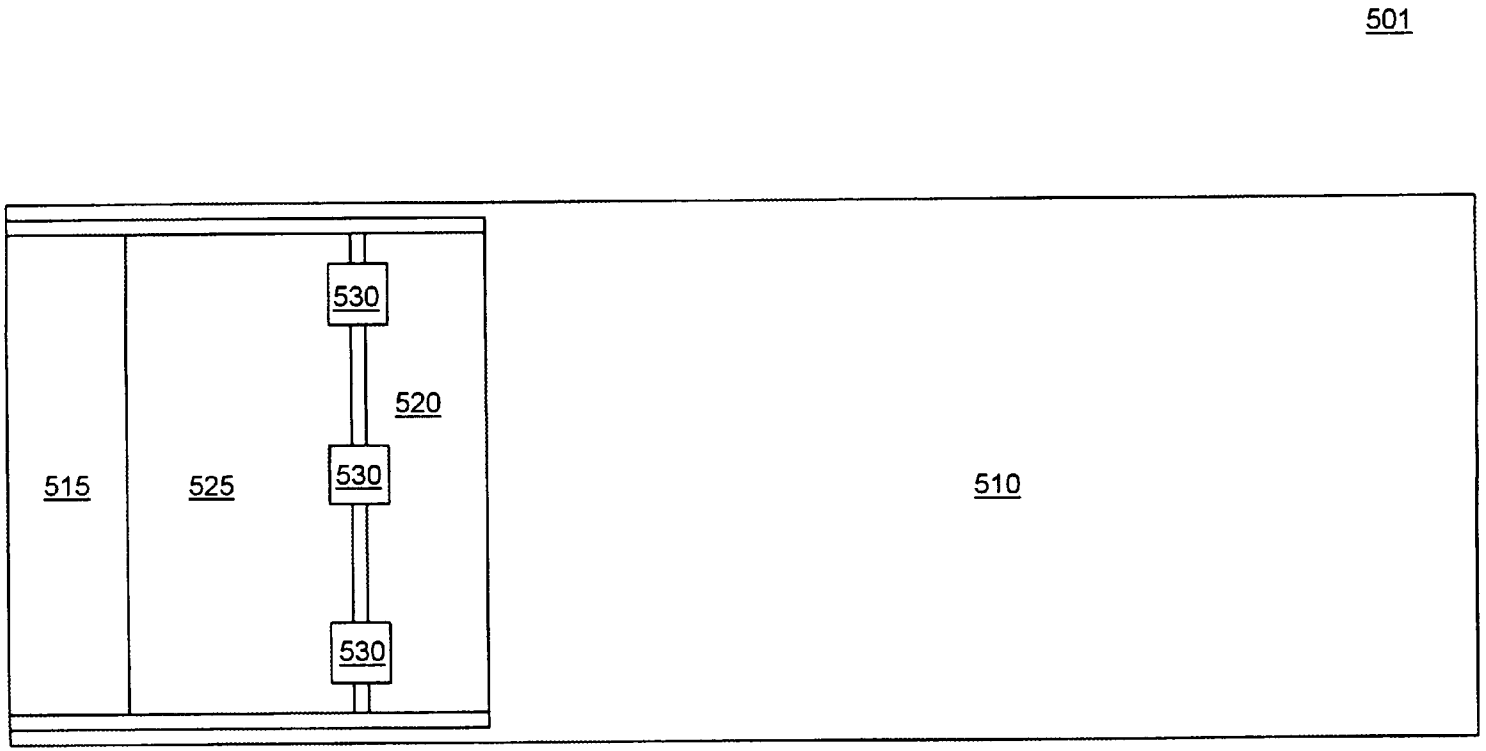

FIG. 5B shows a top view of the switched coaxial transmission line of FIG. 5A.

Figure 5C:
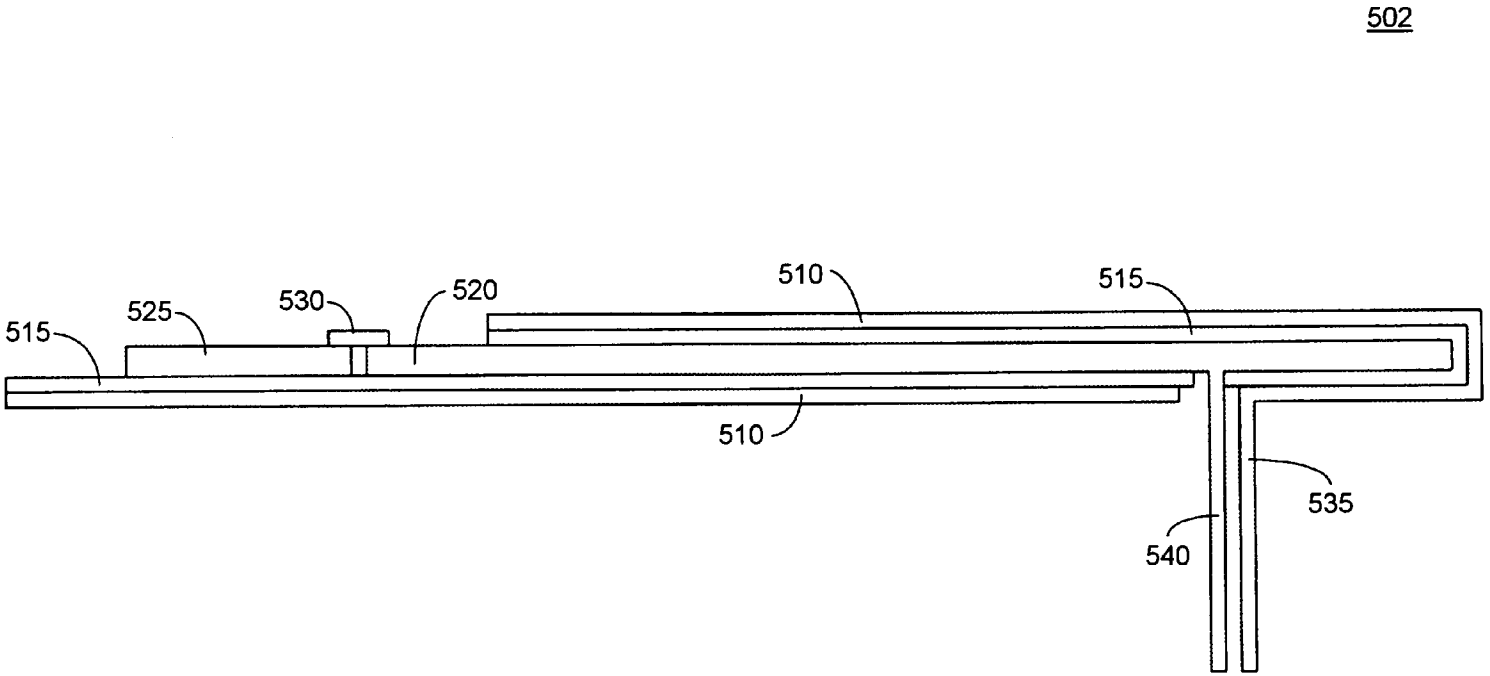

FIG. 5C shows a cross-section view a switched coaxial transmission line with an attached anode/cathode assembly in accordance with an embodiment of the present invention.

Figure 5D:
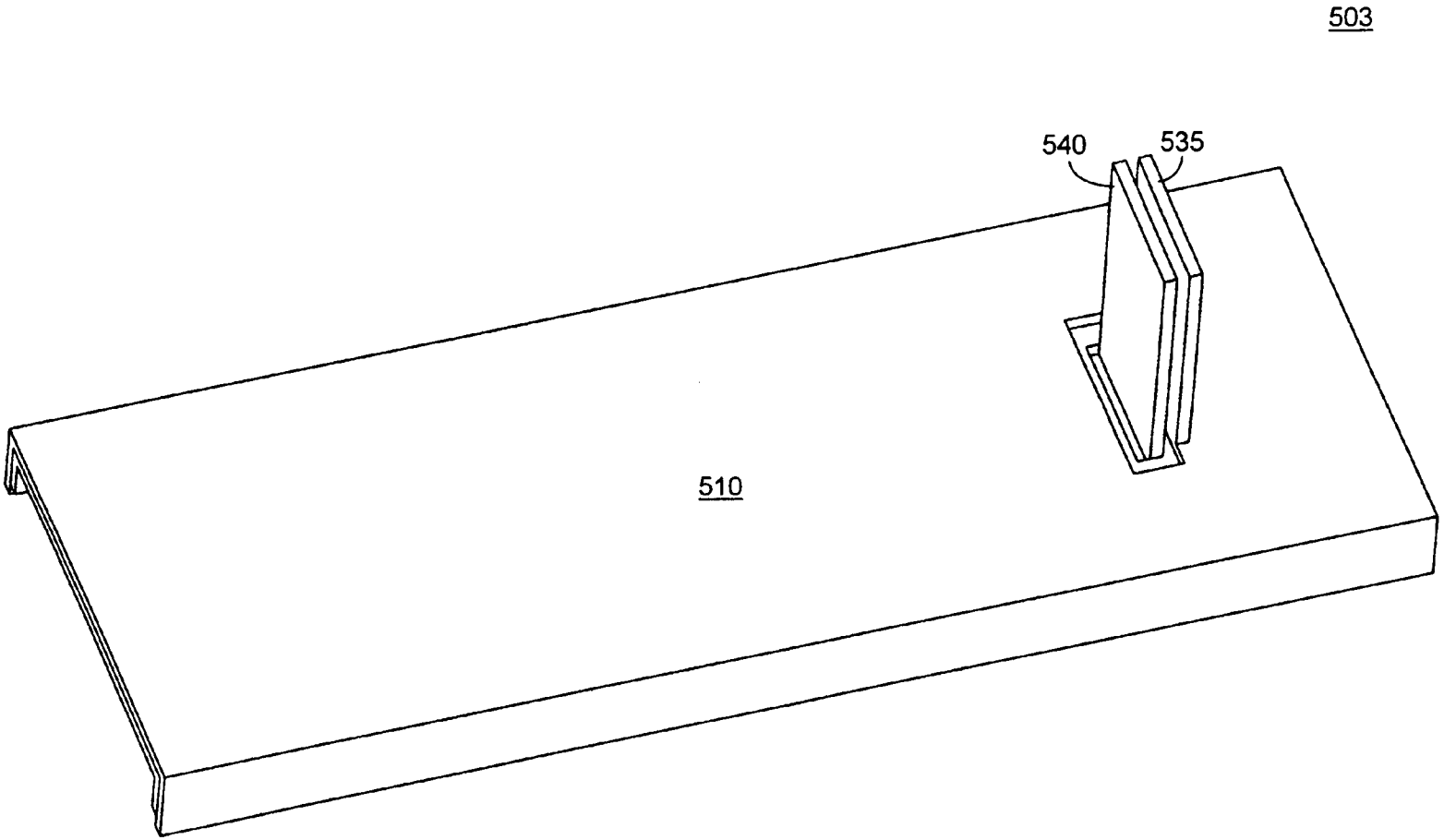

FIG. 5D shows a bottom perspective view of the switched coaxial transmission line of FIG. 5C.

Figure 6A:
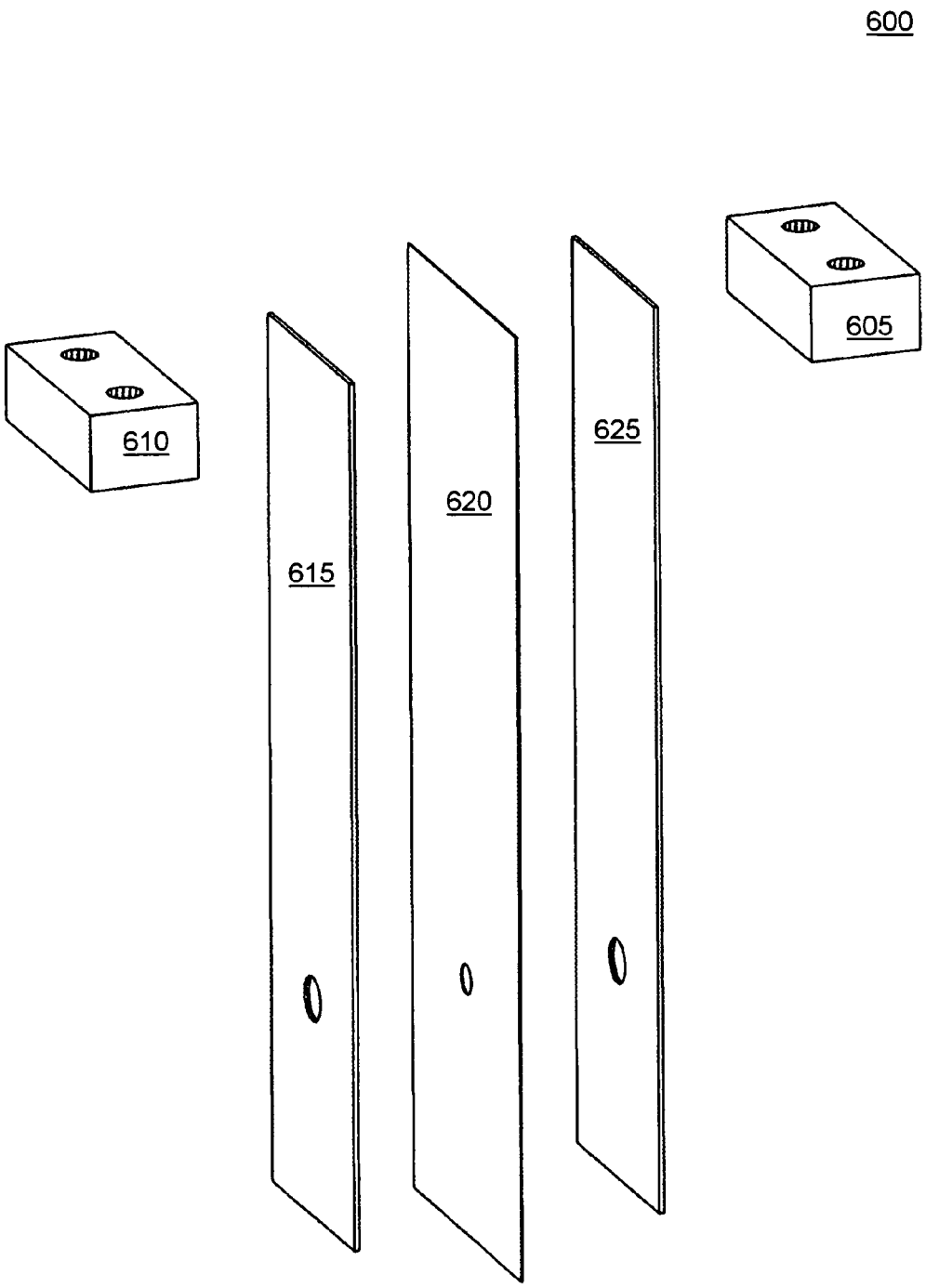

FIG. 6A shows an exploded view a parallel plate anode/cathode assembly in accordance with an embodiment of the present invention.

Figure 6B:
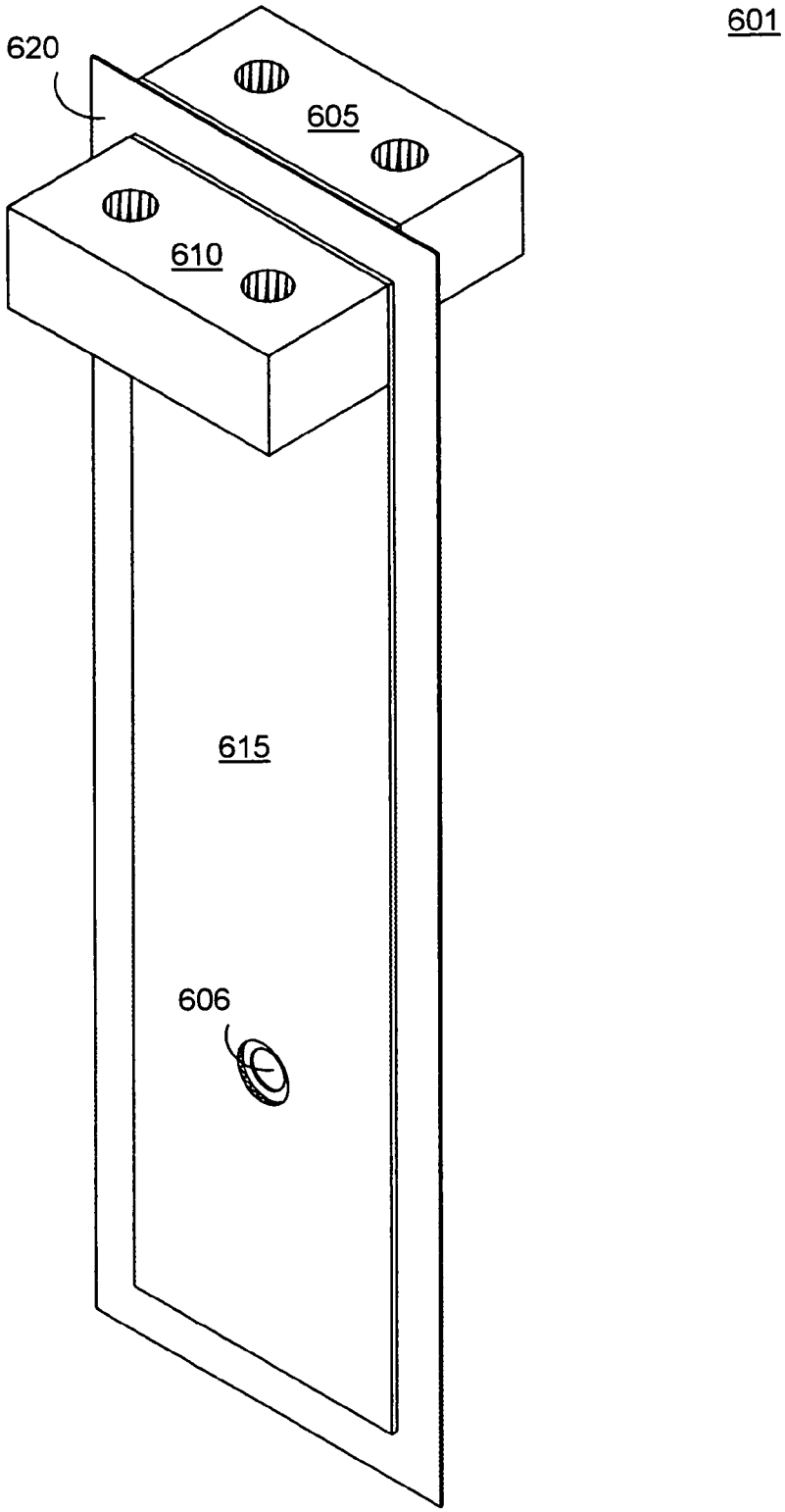

FIG. 6B shows an assembled view of the parallel plate anode/cathode assembly of FIG. 6A.

Figure 6C:
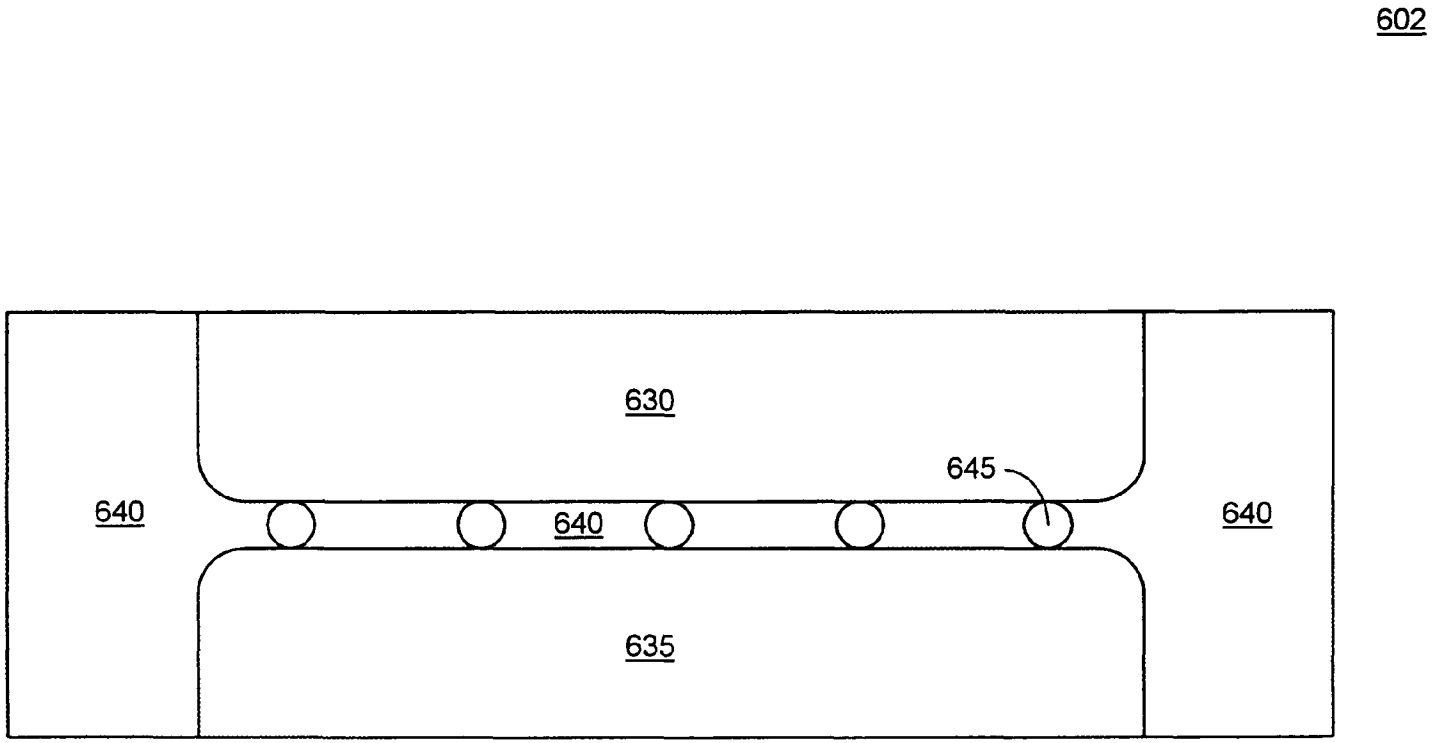

FIG. 6C shows a cross section view of a parallel plate anode/cathode assembly in accordance with an embodiment of the present invention.

Figure 7A:
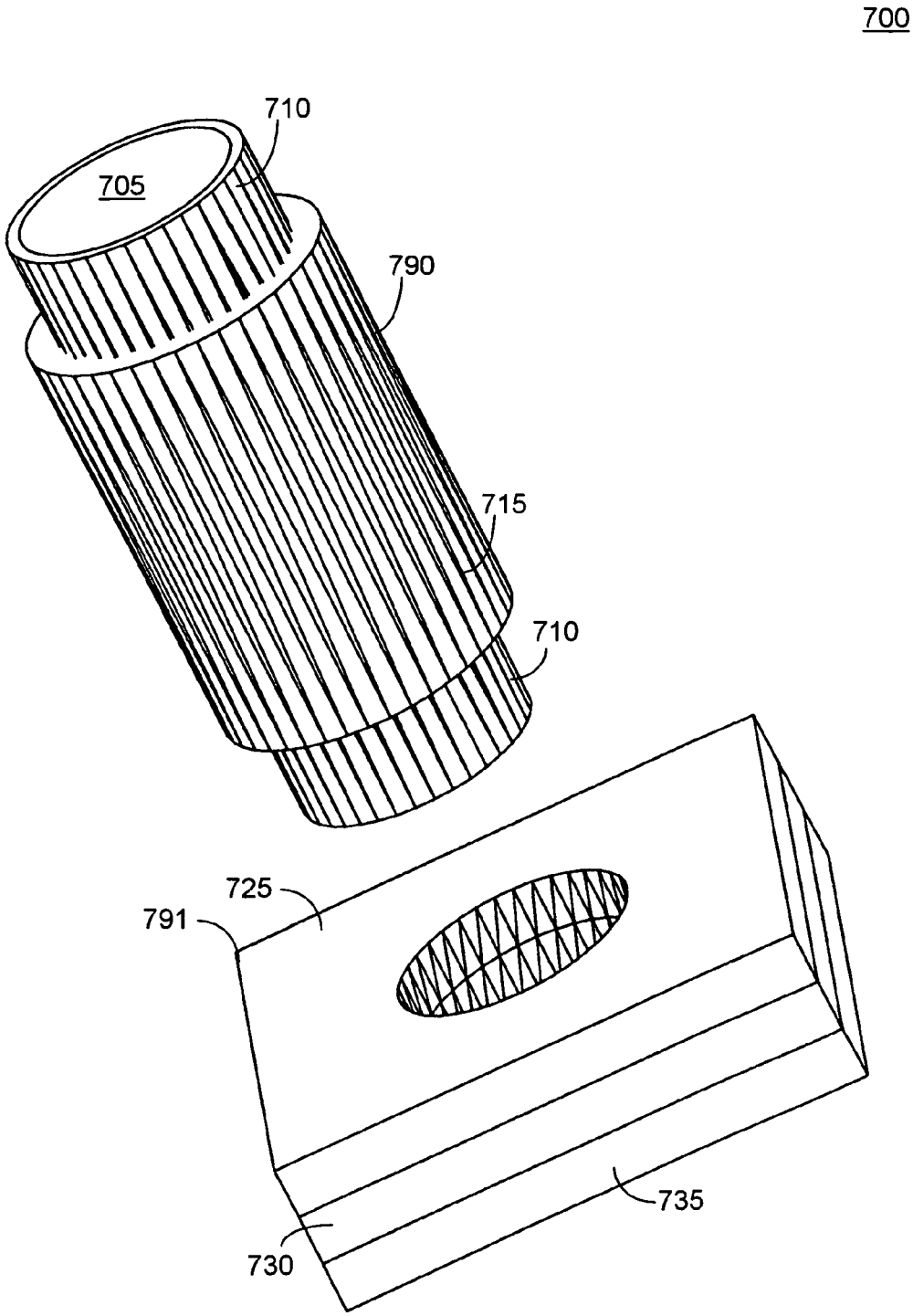

FIG. 7A shows an exploded view of a solid dielectric coaxial anode/cathode assembly in accordance with an embodiment of the present invention.

Figure 7B:
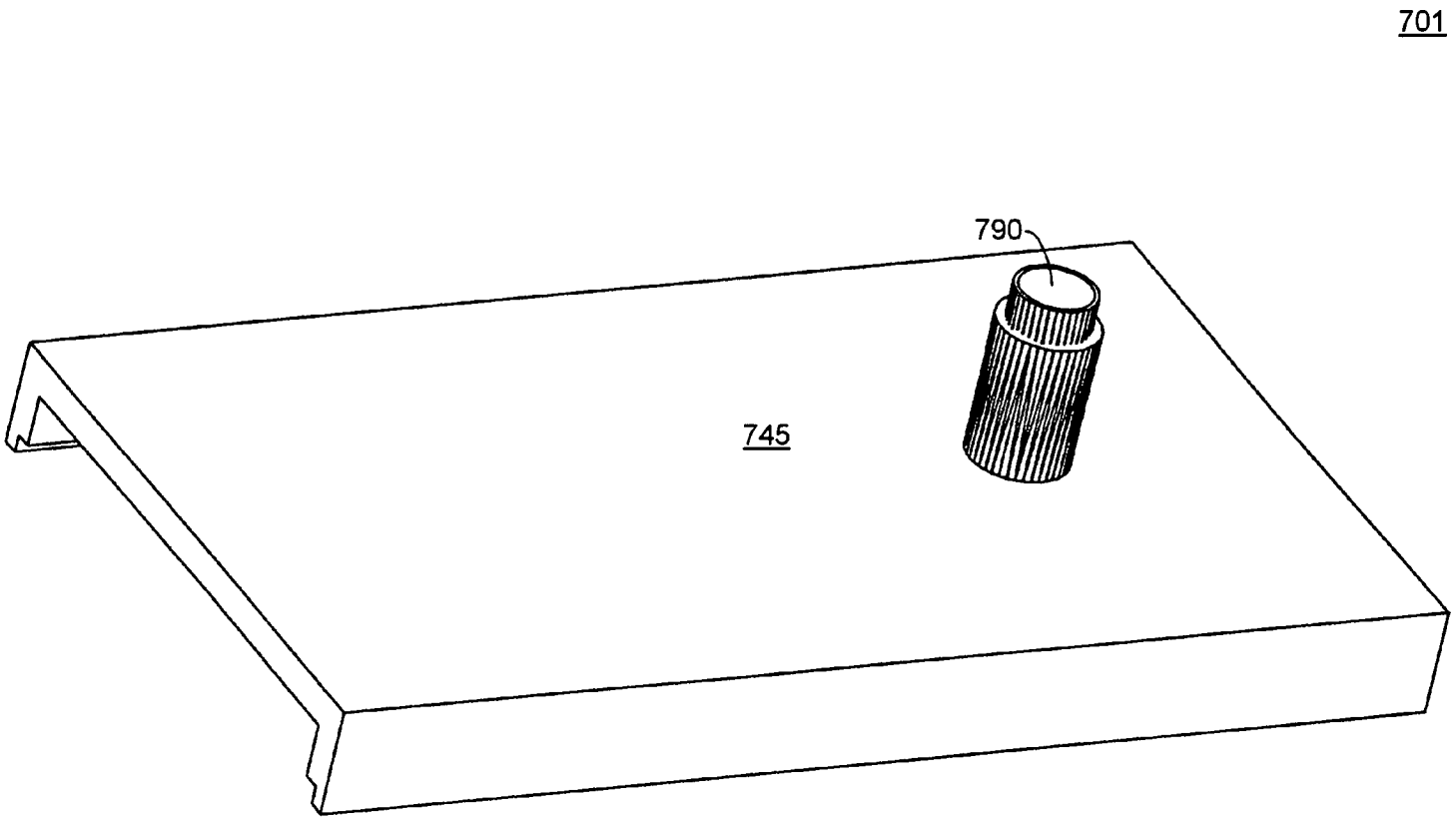

FIG. 7B shows a perspective view of a solid dielectric coaxial anode/cathode assembly attached to a parallel plate transmission line in accordance with an embodiment of the present invention.

Figure 8:
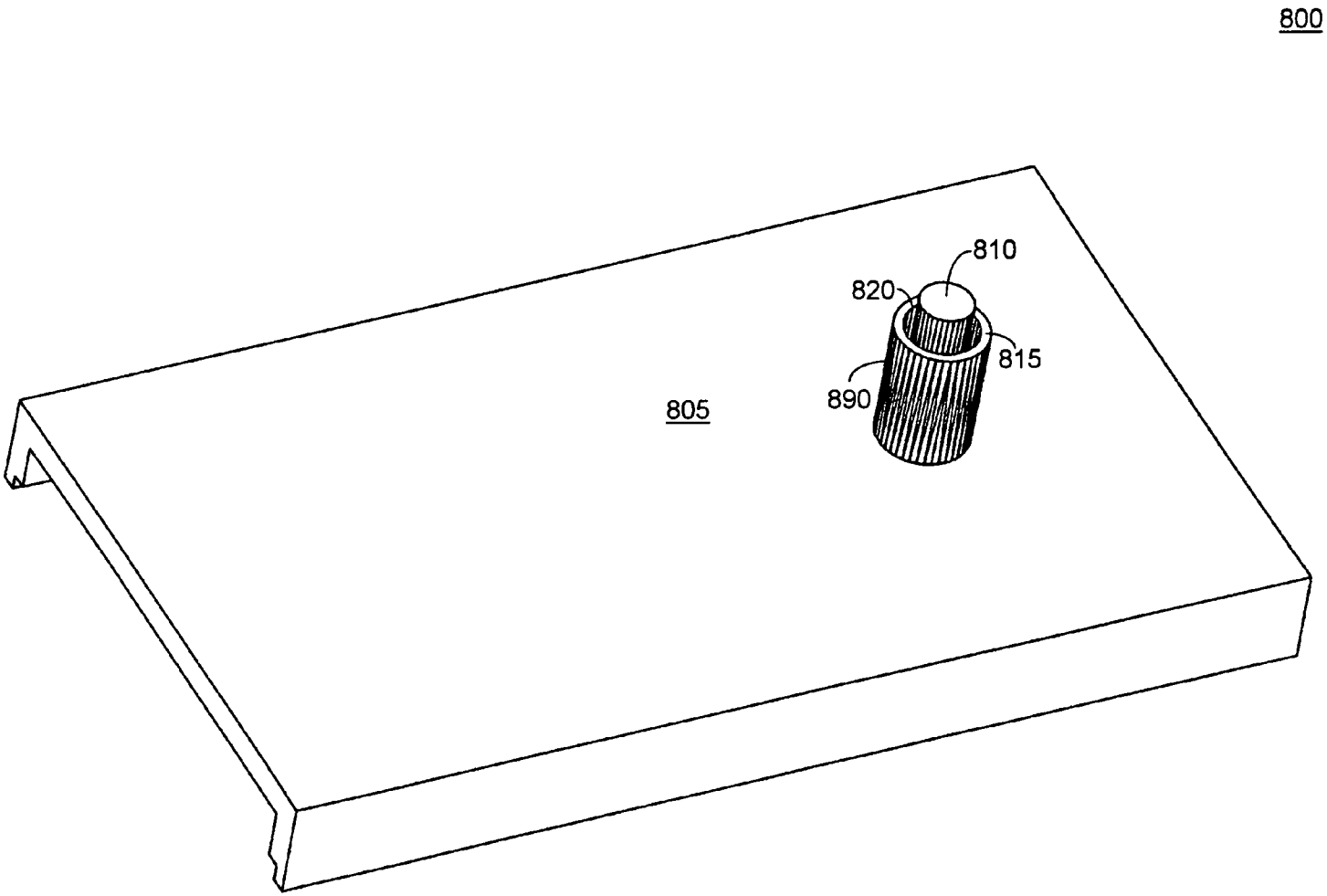

FIG. 8 shows a perspective view of a liquid dielectric coaxial anode/cathode assembly attached to a parallel plate transmission line in accordance with an embodiment of the present invention.

Figure 9A:
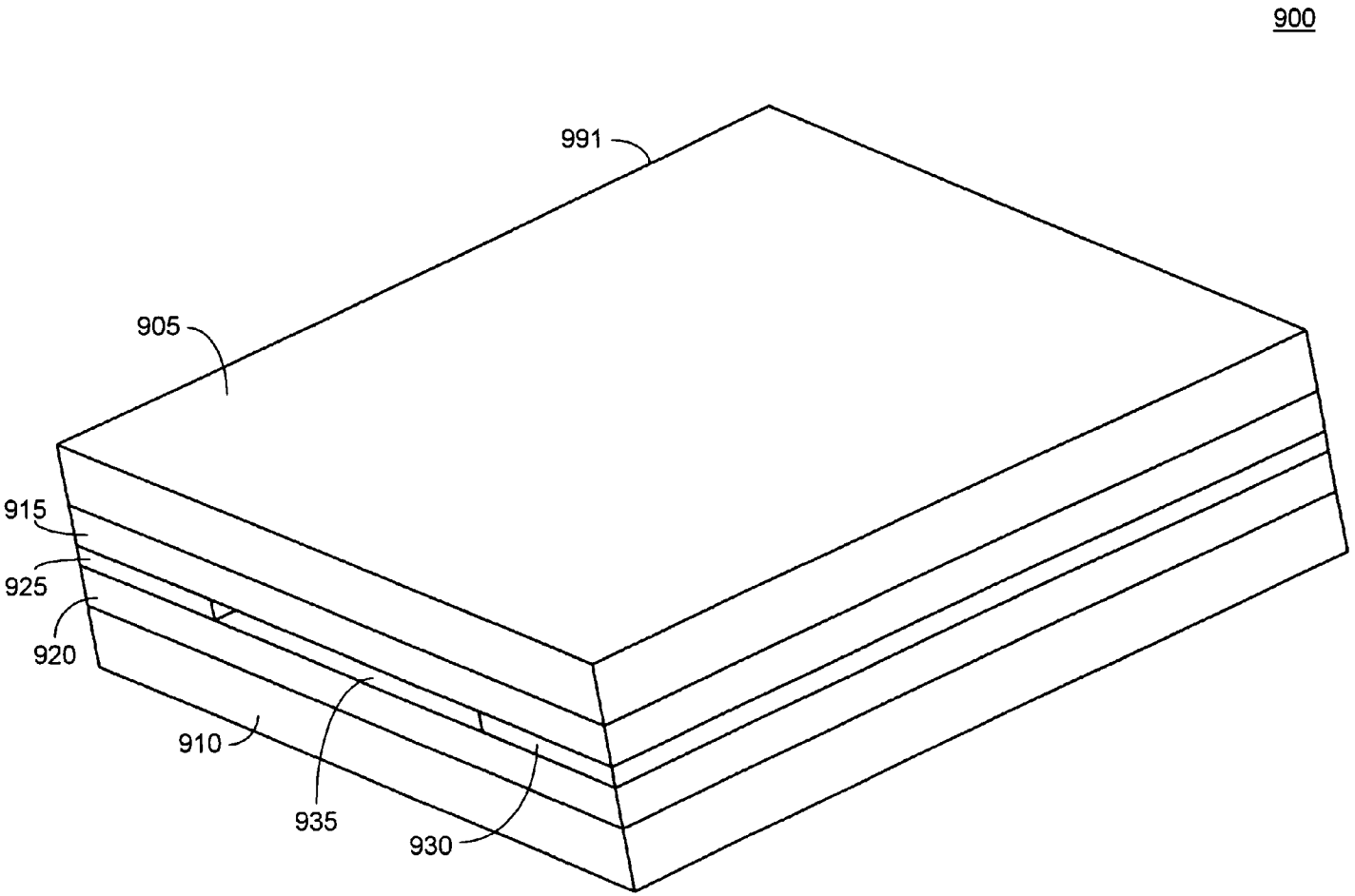

FIG. 9A shows a perspective view of a transmission line duct with opposing anode and cathode walls in accordance with an embodiment of the present invention.

Figure 9B:
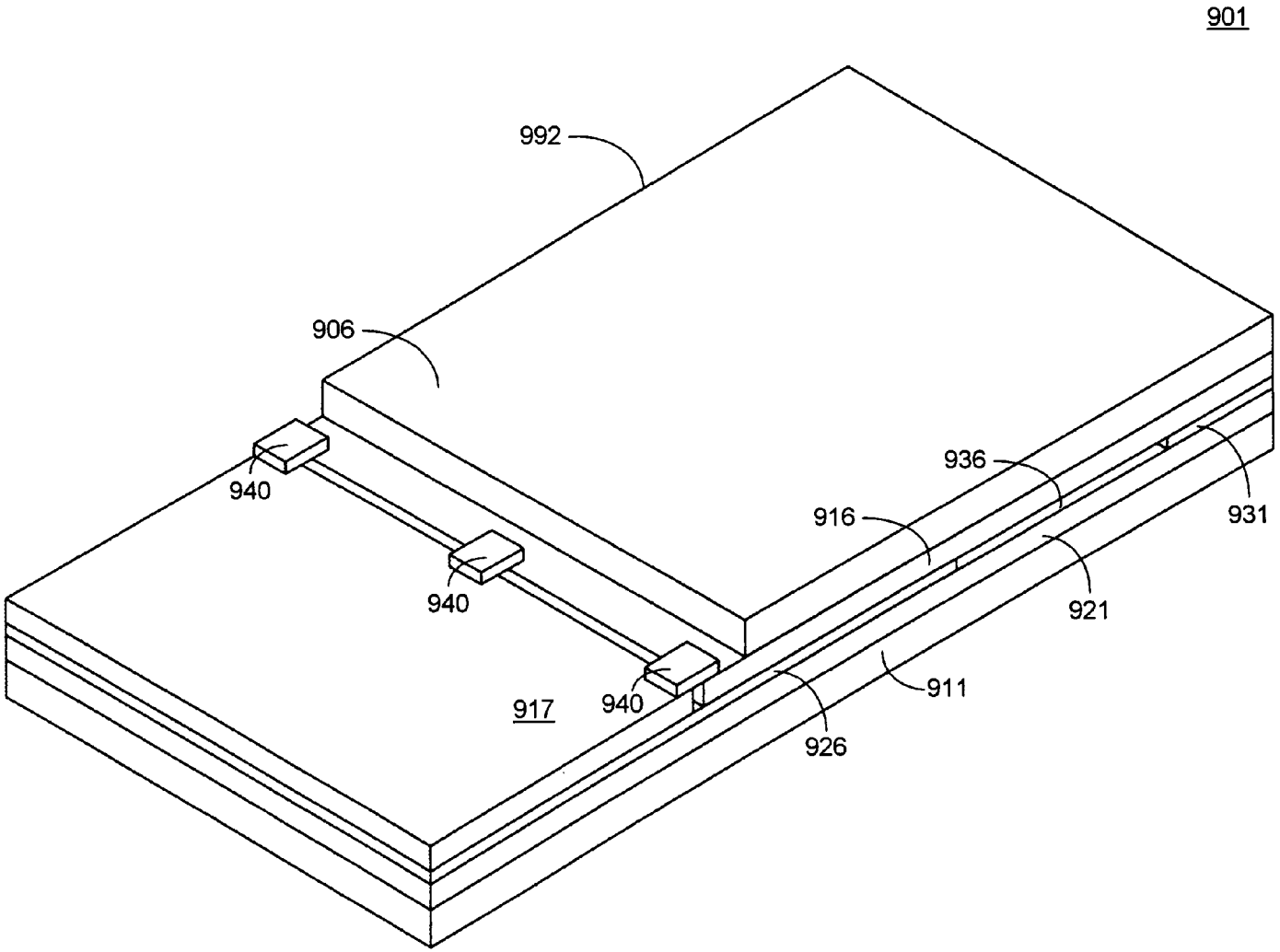

FIG. 9B shows a perspective view of a transmission line duct with opposing anode and cathode walls with integrated switches in accordance with an embodiment of the present invention.

Figure 9C:
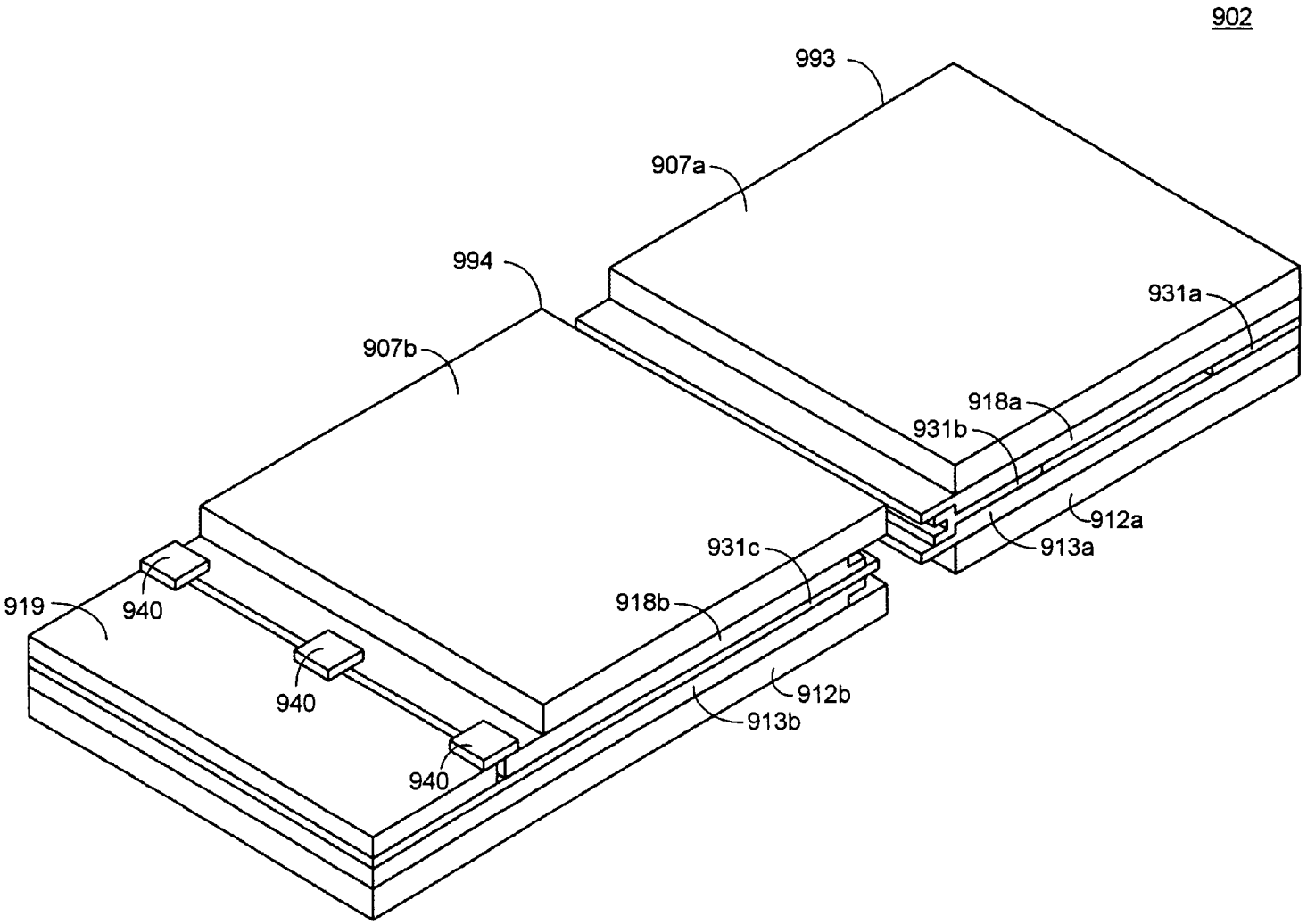

FIG. 9C shows a perspective view of a transmission line duct with opposing anode and cathode walls with a detachable switch module in accordance with an embodiment of the present invention.

Figure 9D:
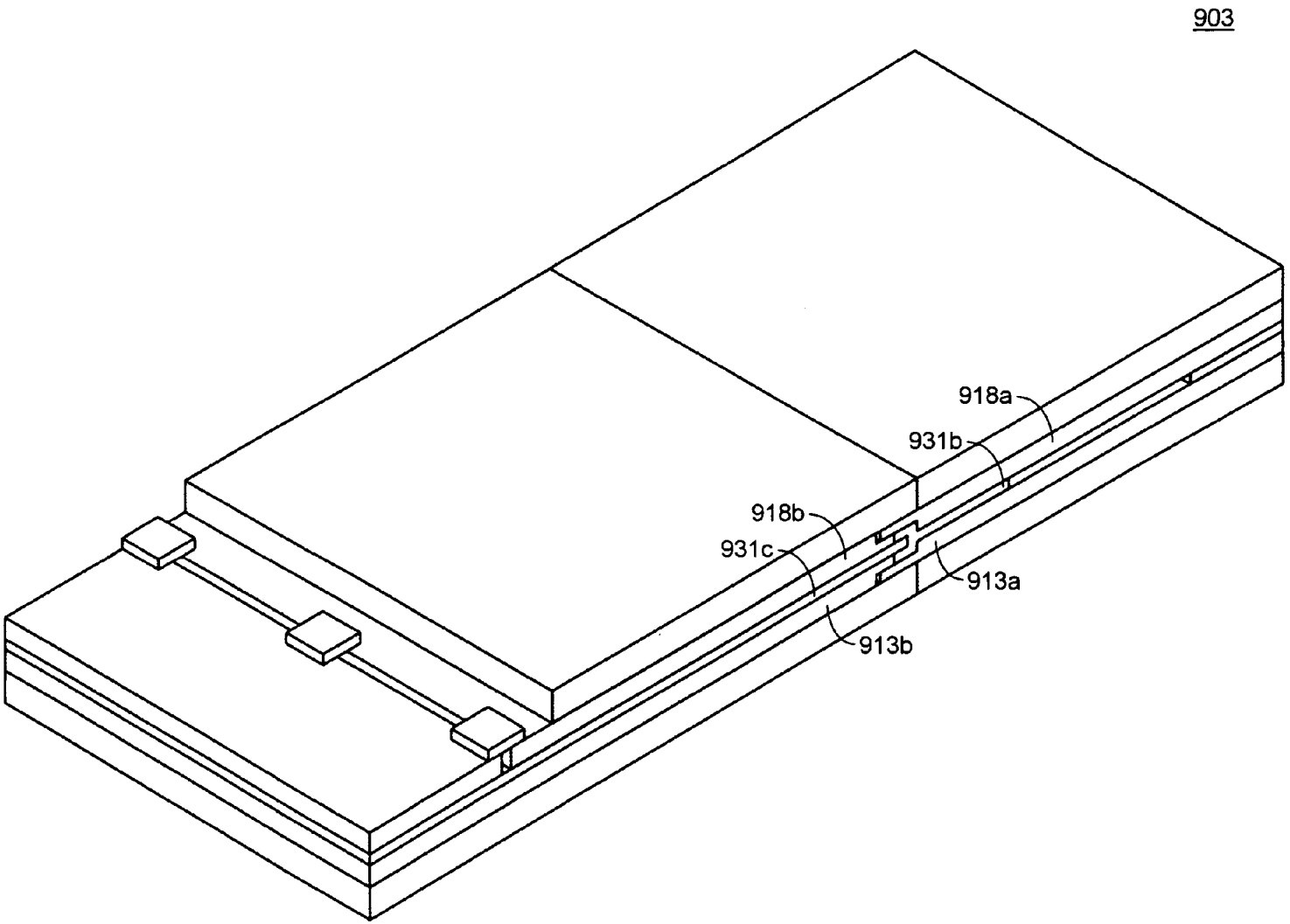

FIG. 9D shows a perspective view of a transmission line duct with opposing anode and cathode walls with a detachable switch module in an attached configuration in accordance with an embodiment of the present invention.

Figure 10A:
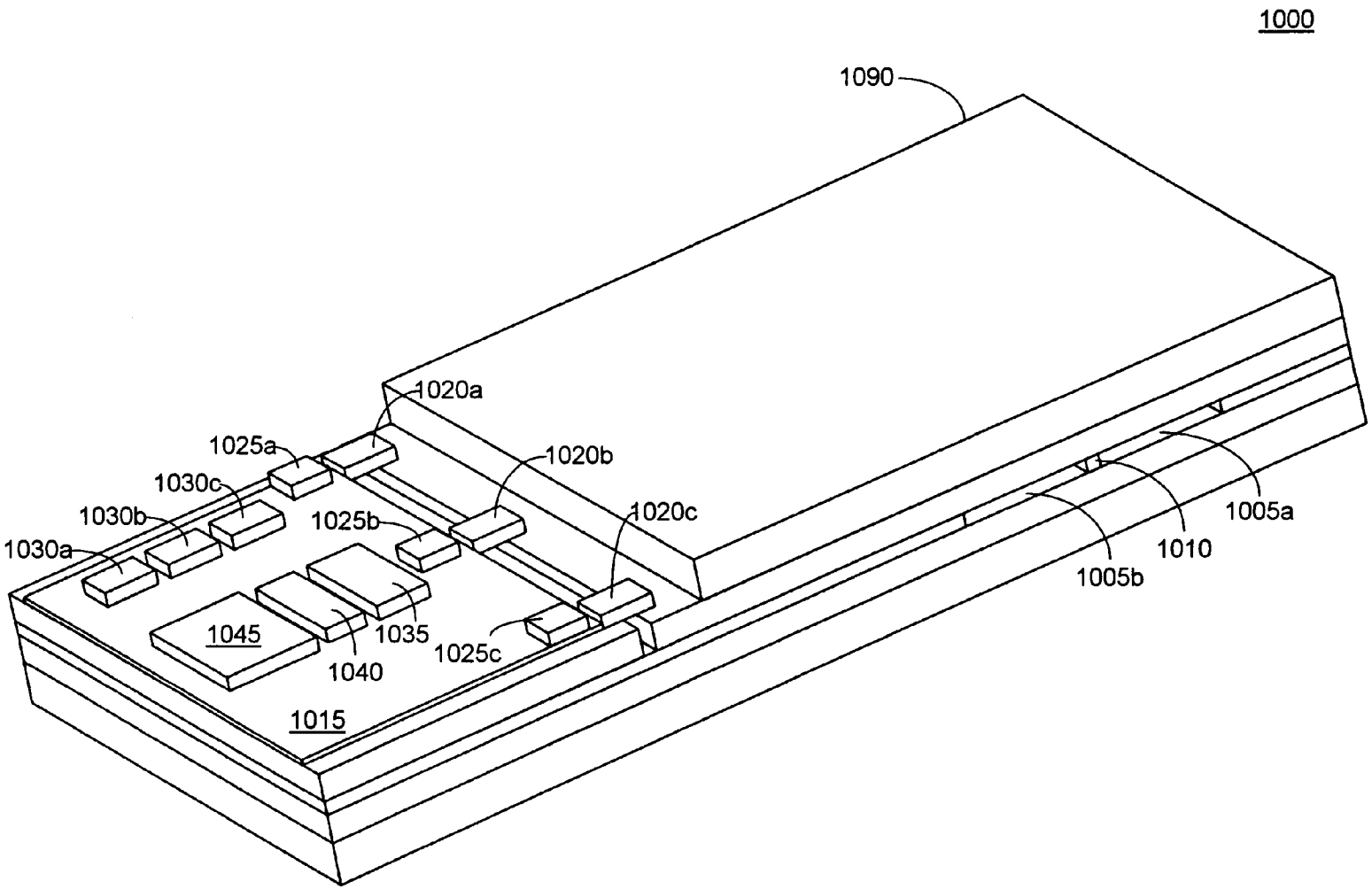

FIG. 10A shows a perspective view of a dual duct transmission line with an integrated power supply in accordance with an embodiment of the present invention.

Figure 10B:
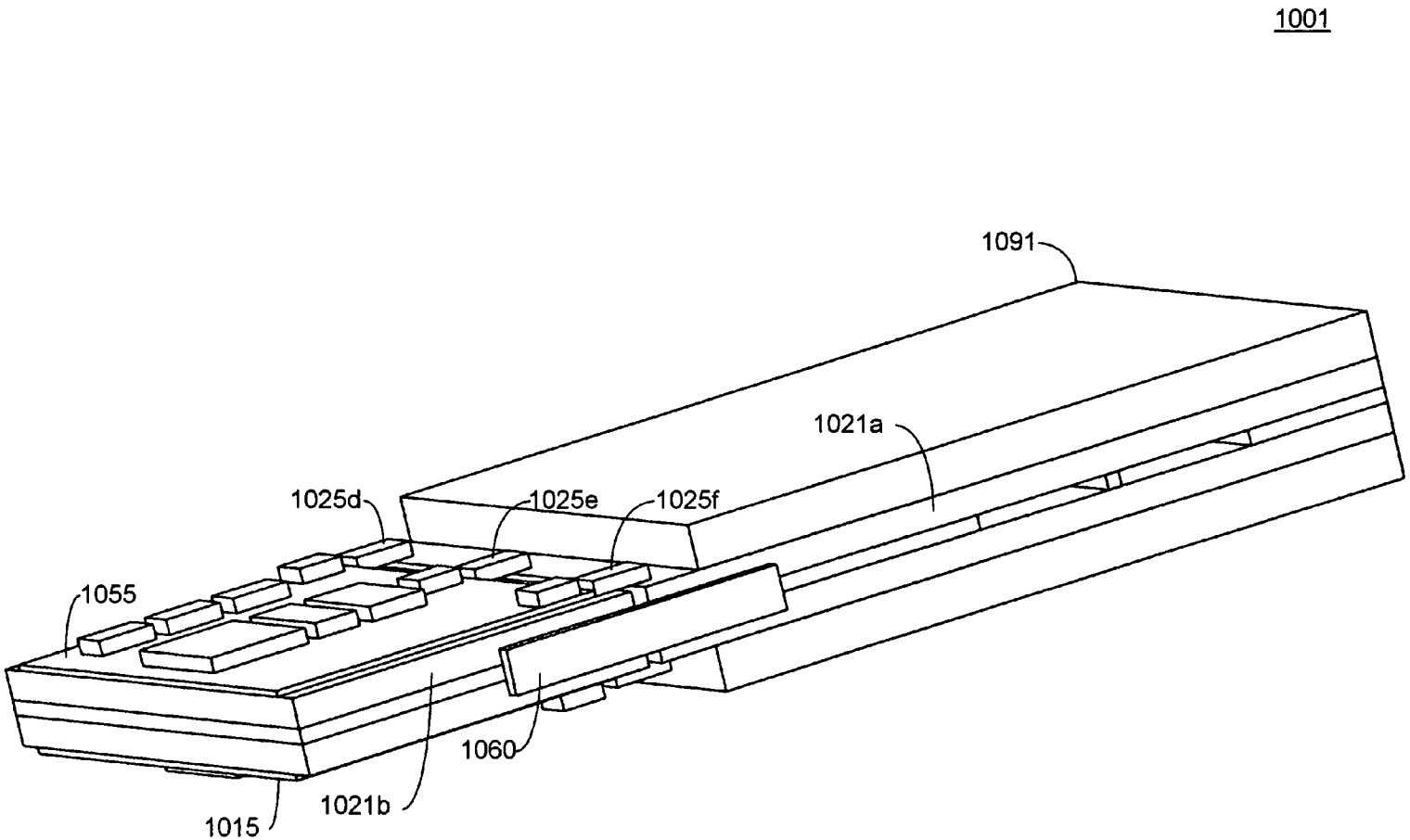

FIG. 10B shows a perspective view of a dual duct transmission line with an integrated power supply and dual switching in accordance with an embodiment of the present invention.

Figure 10C:
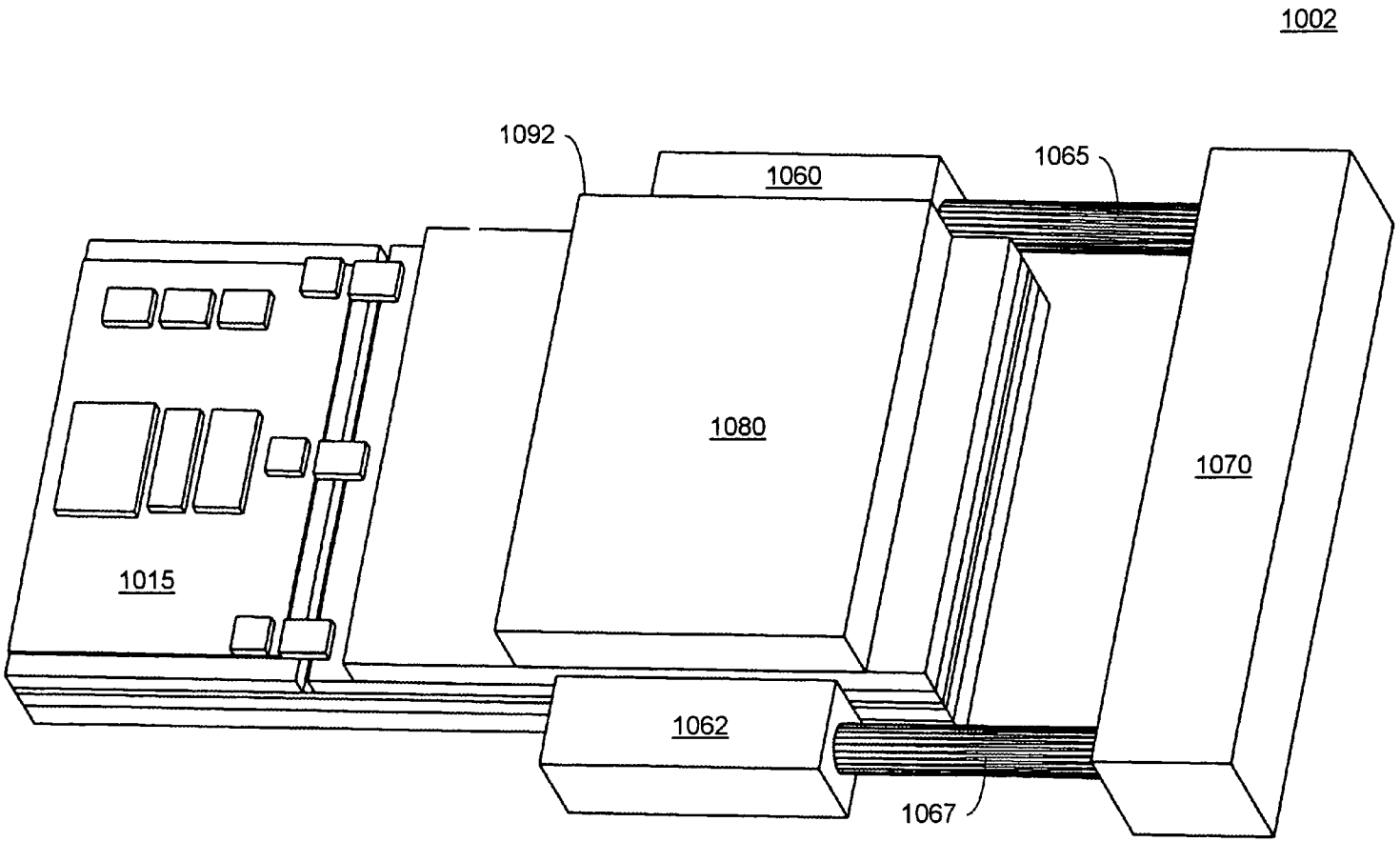

FIG. 10C shows a perspective view of an illuminated transmission line duct coupled to an electrolyte circulation system in accordance with an embodiment of the present invention.

Figure 11:
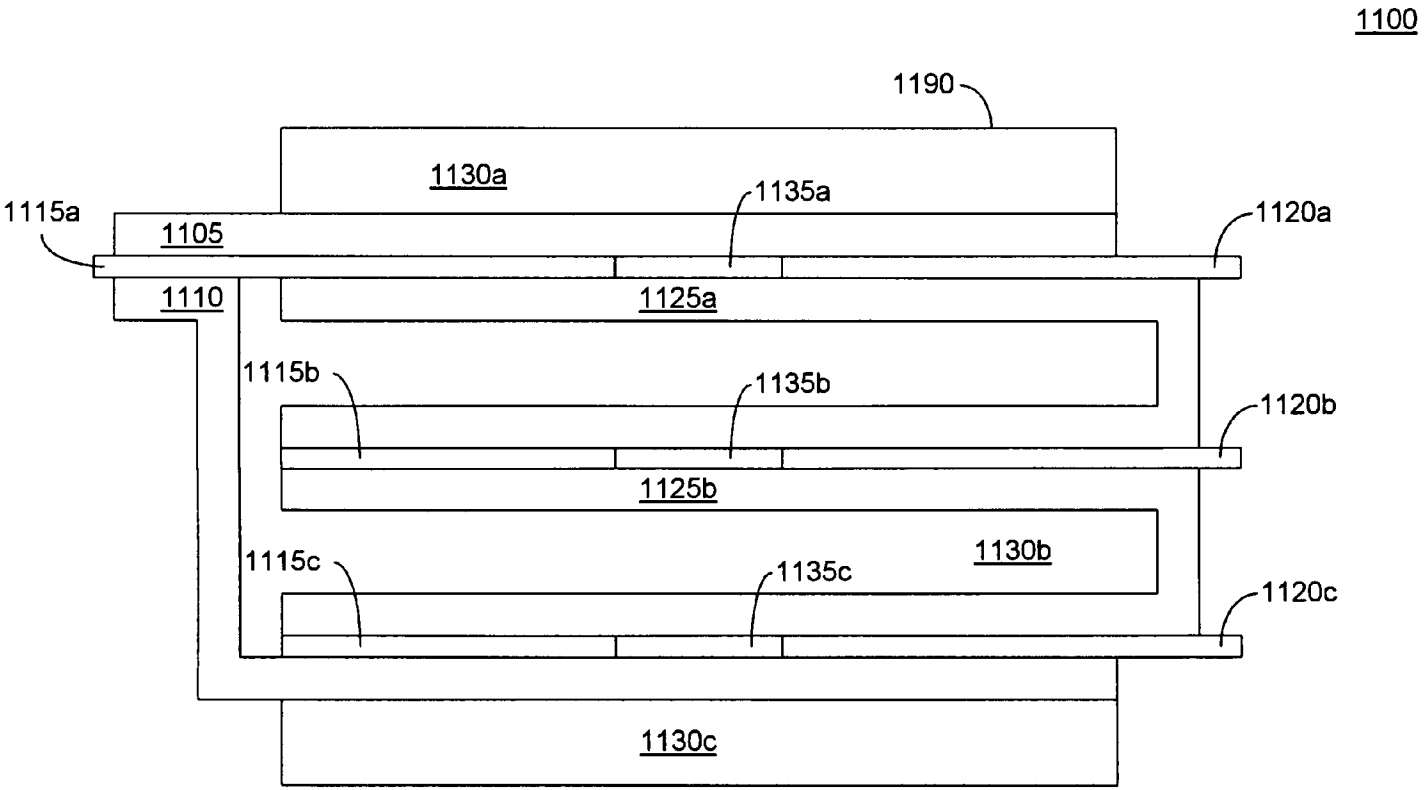

FIG. 11 shows an electrolytic module with multiple channel ducts in a series configuration in accordance with an embodiment of the present invention.

Figure 12A:
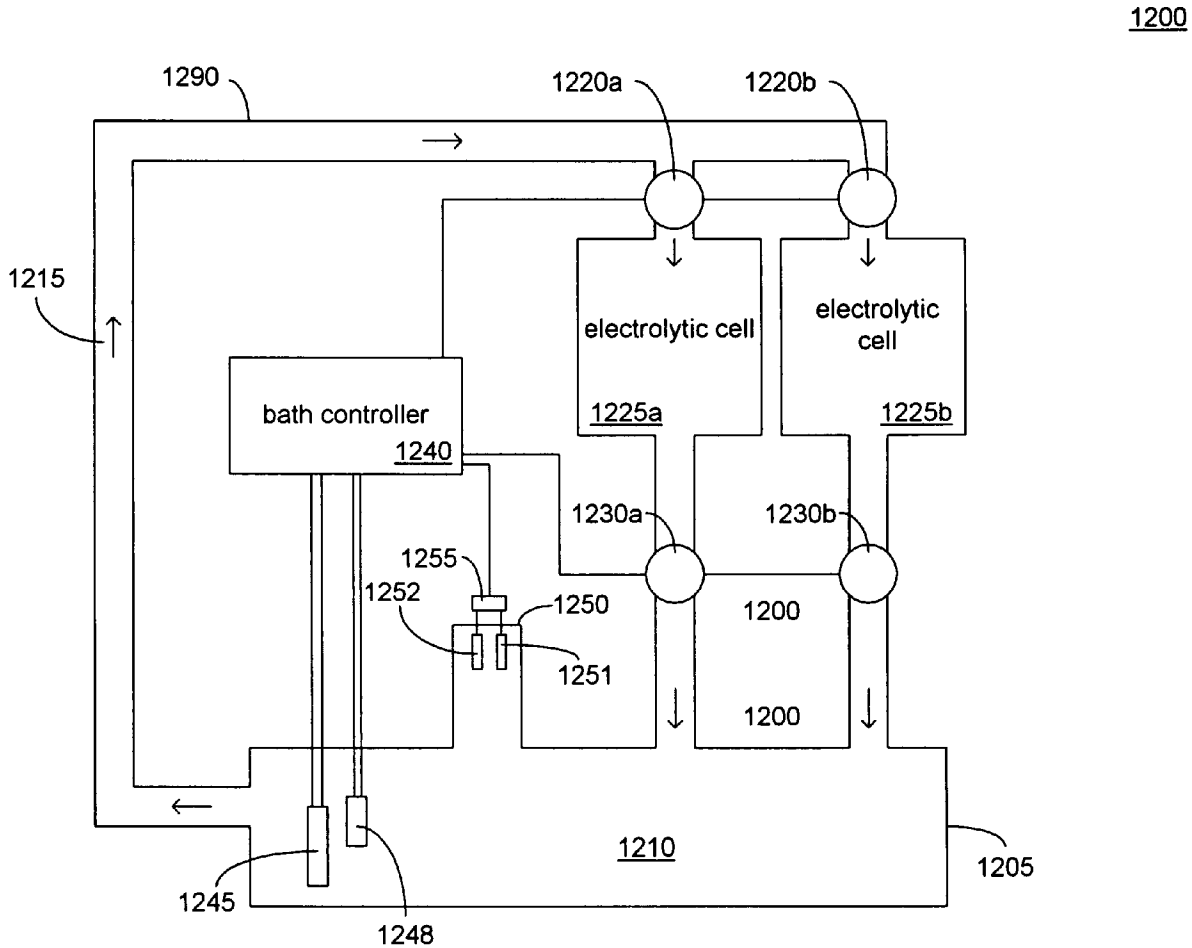

FIG. 12A shows a schematic view of an electrolyte recirculation system with electrically isolated cells in accordance with an embodiment of the present invention.

Figure 12B:
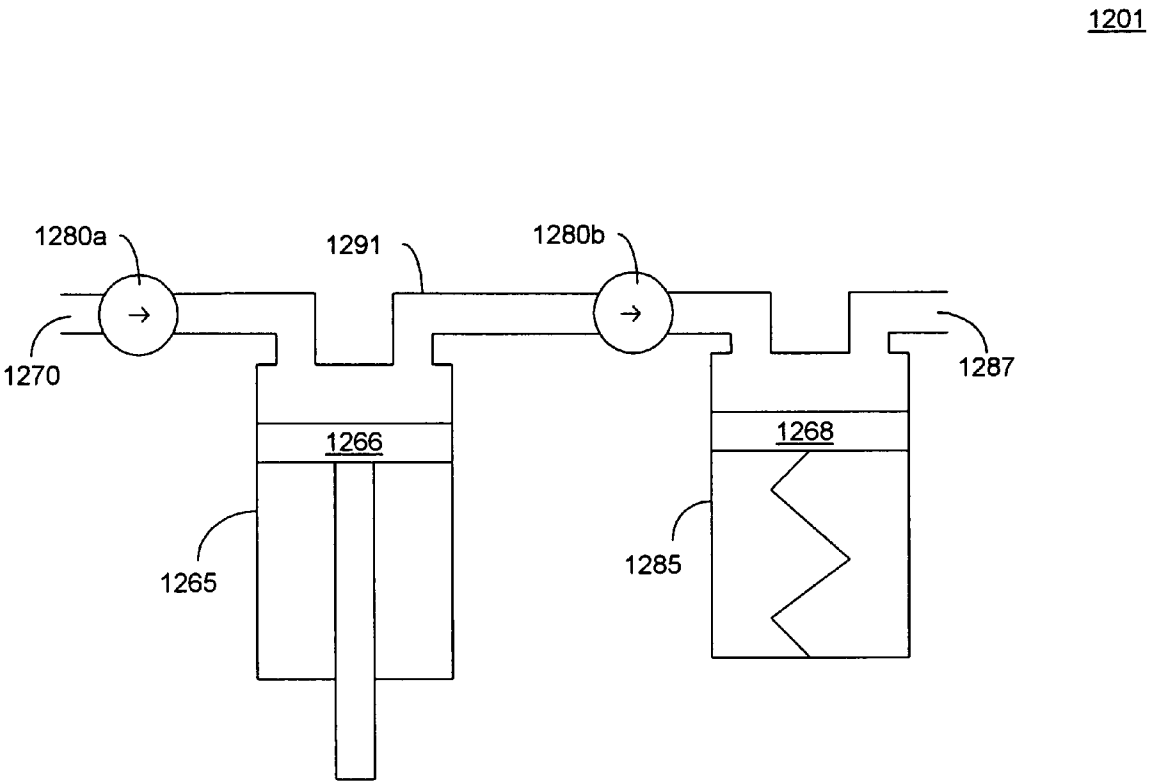

FIG. 12B shows a schematic view of an isolation pump for an electrolyte recirculation system in accordance with an embodiment of the present invention.

Figure 13A:
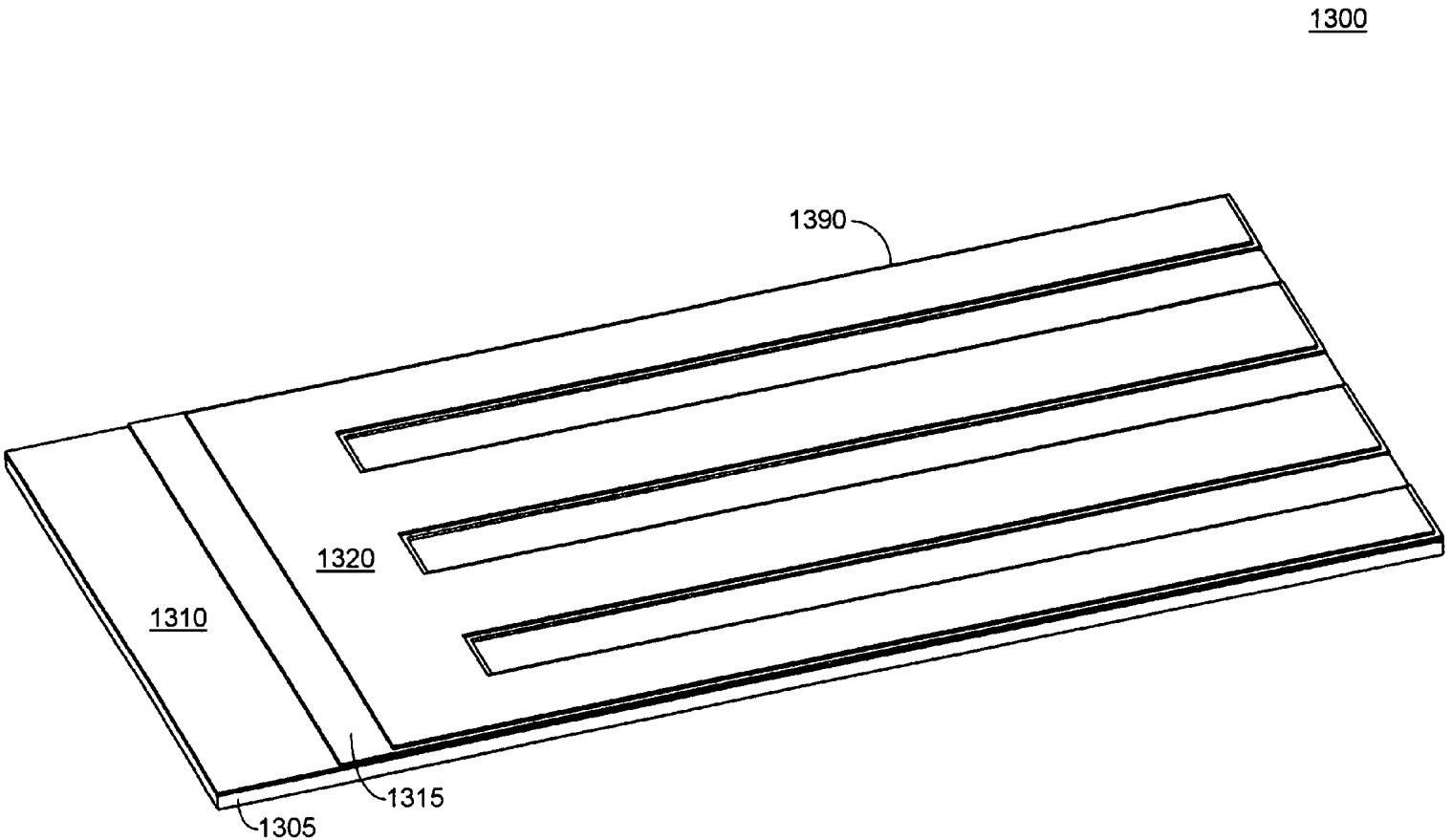

FIG. 13A shows a perspective view of a parallel plate transmission line anode/cathode assembly on a dielectric substrate in accordance with an embodiment of the present invention.

Figure 13B:
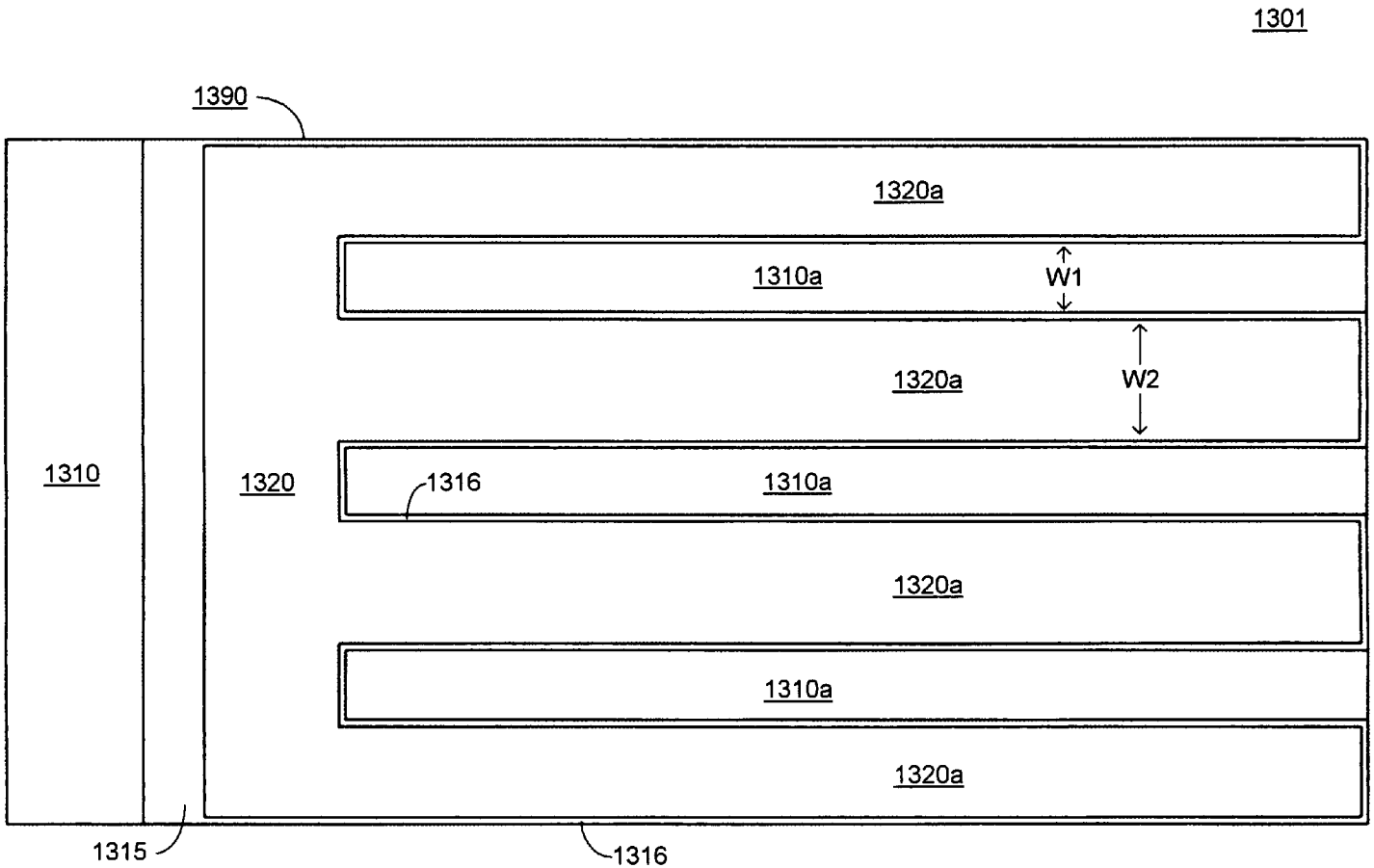

FIG. 13B shows a top view of the parallel plate anode/cathode assembly of FIG. 13A.

Figure 14:
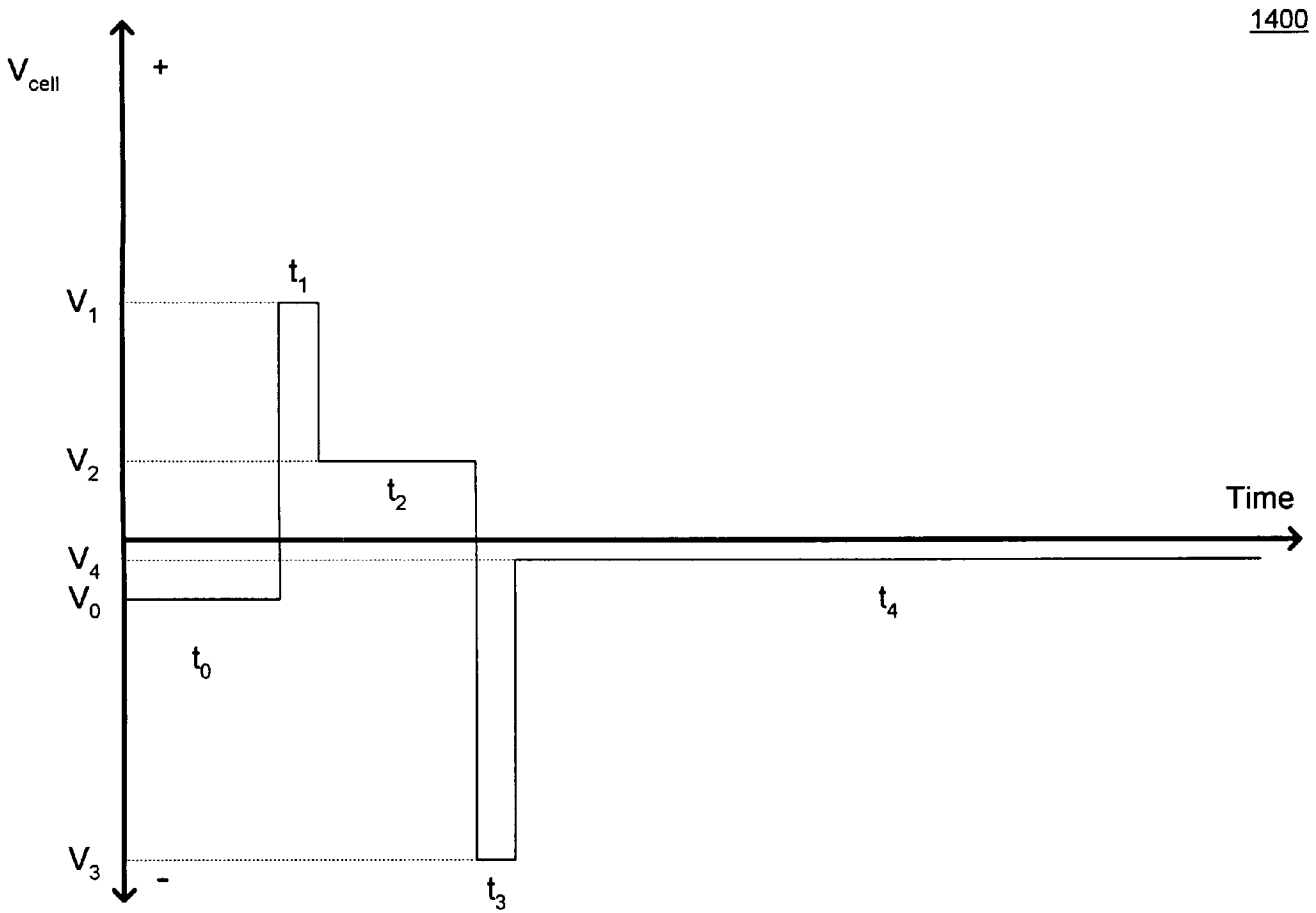

FIG. 14 shows an electrolytic cell power supply output waveform in accordance with an embodiment of the present invention.

Figure 15:
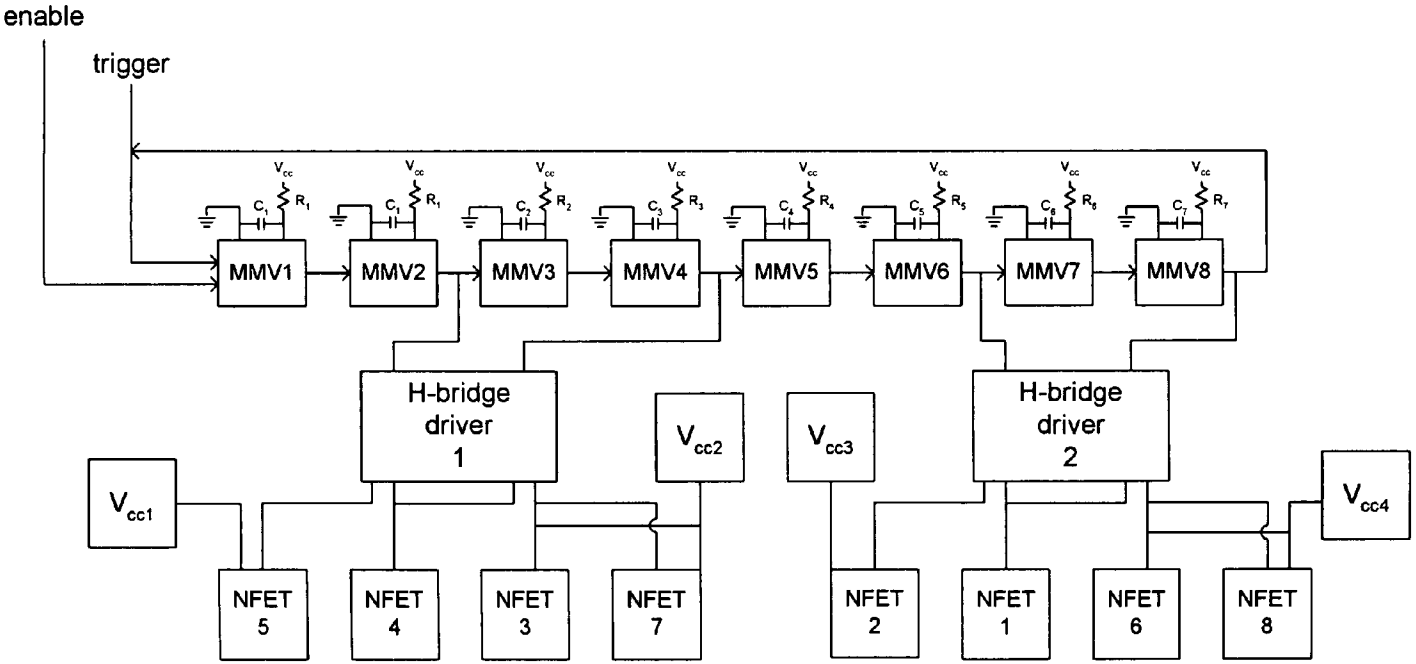

FIG. 15 shows an electrolytic cell power supply circuit schematic diagram in accordance with an embodiment of the present invention.

Figure 16:
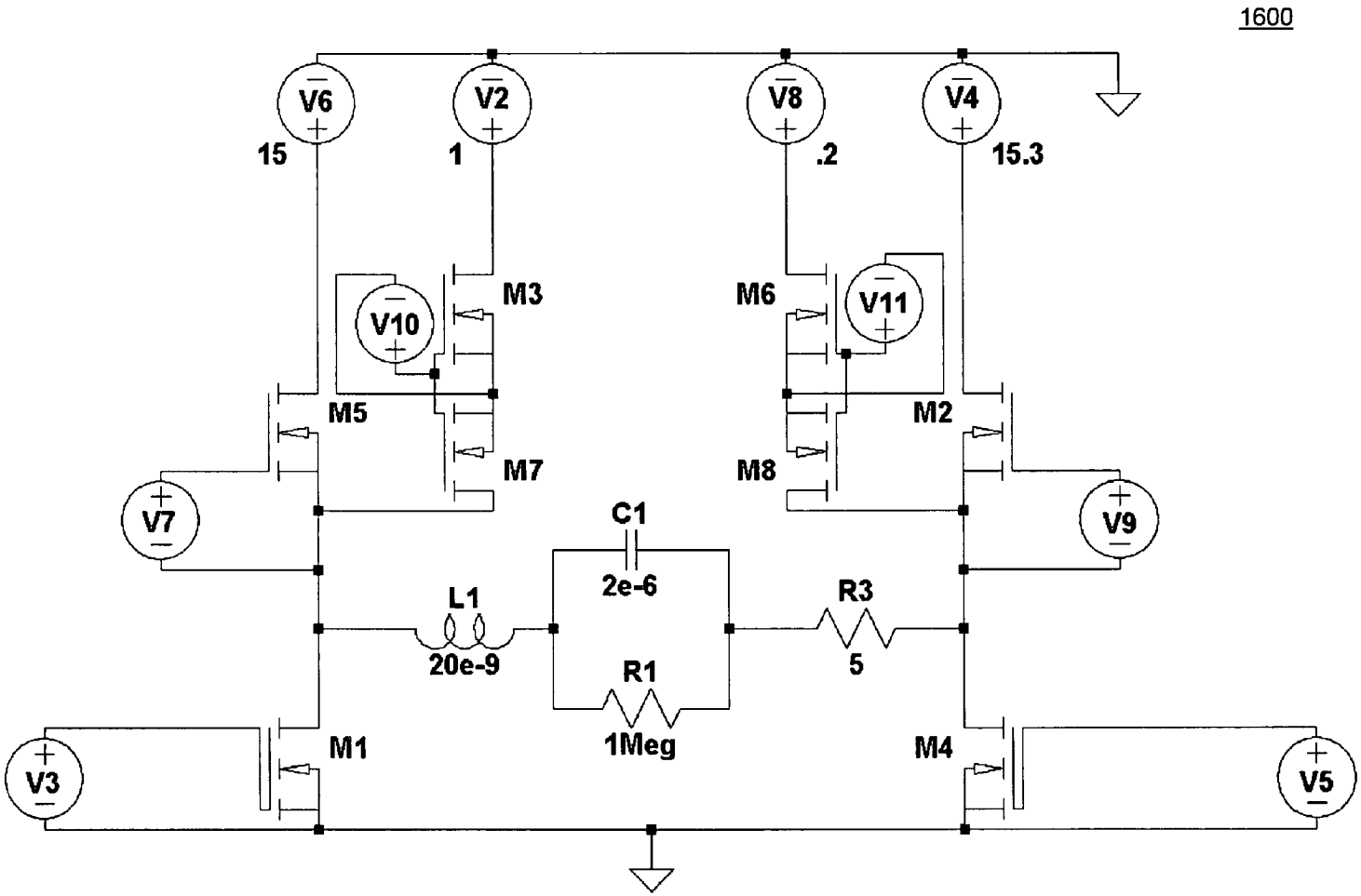

FIG. 16 shows a schematic diagram of an output stage of an electrolytic cell power supply in accordance with an embodiment of the present invention.

Figure 17A:
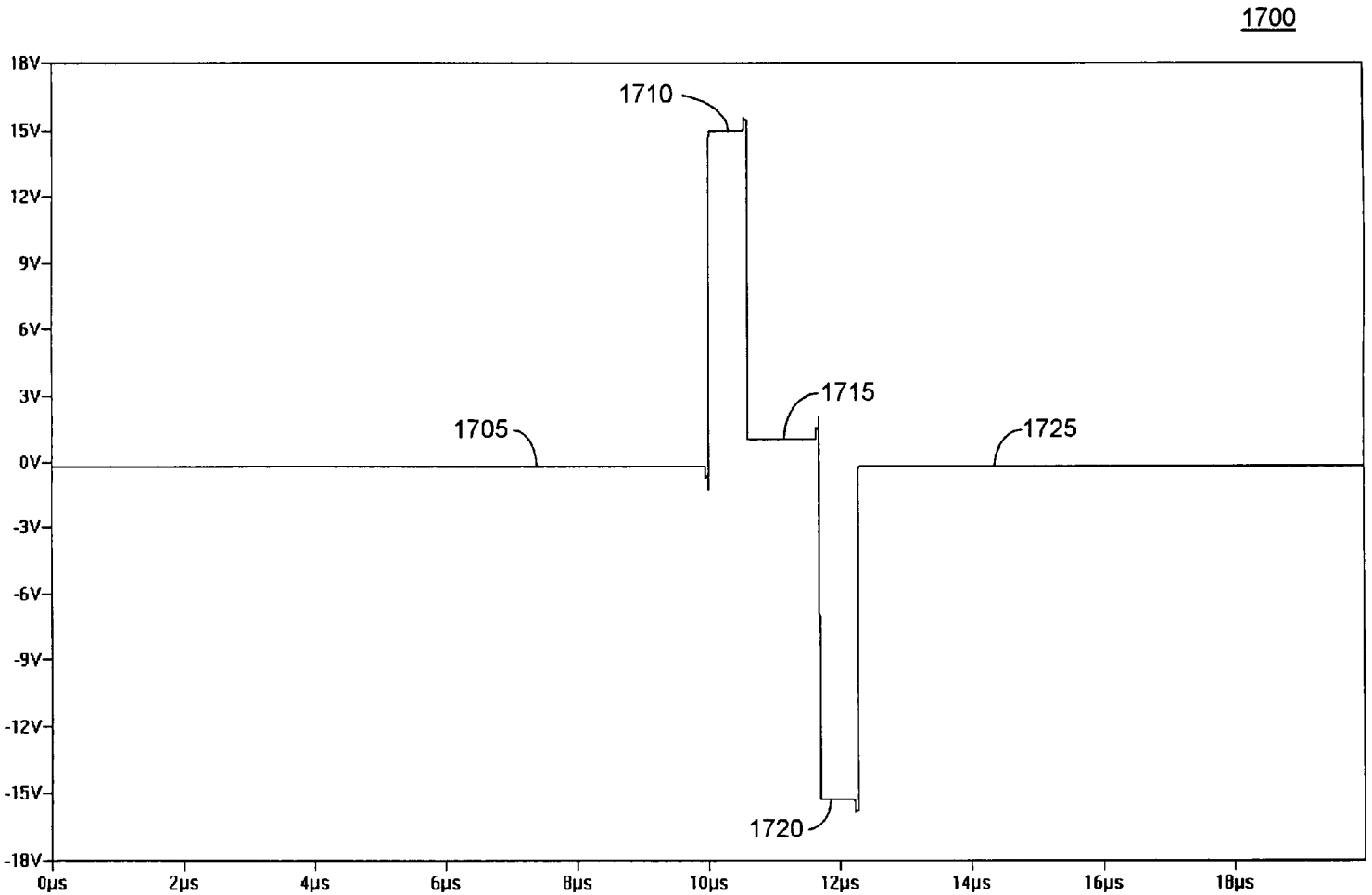

FIG. 17A shows a diagram of the modeled open circuit response of the circuit of FIG. 15.

Figure 17B:
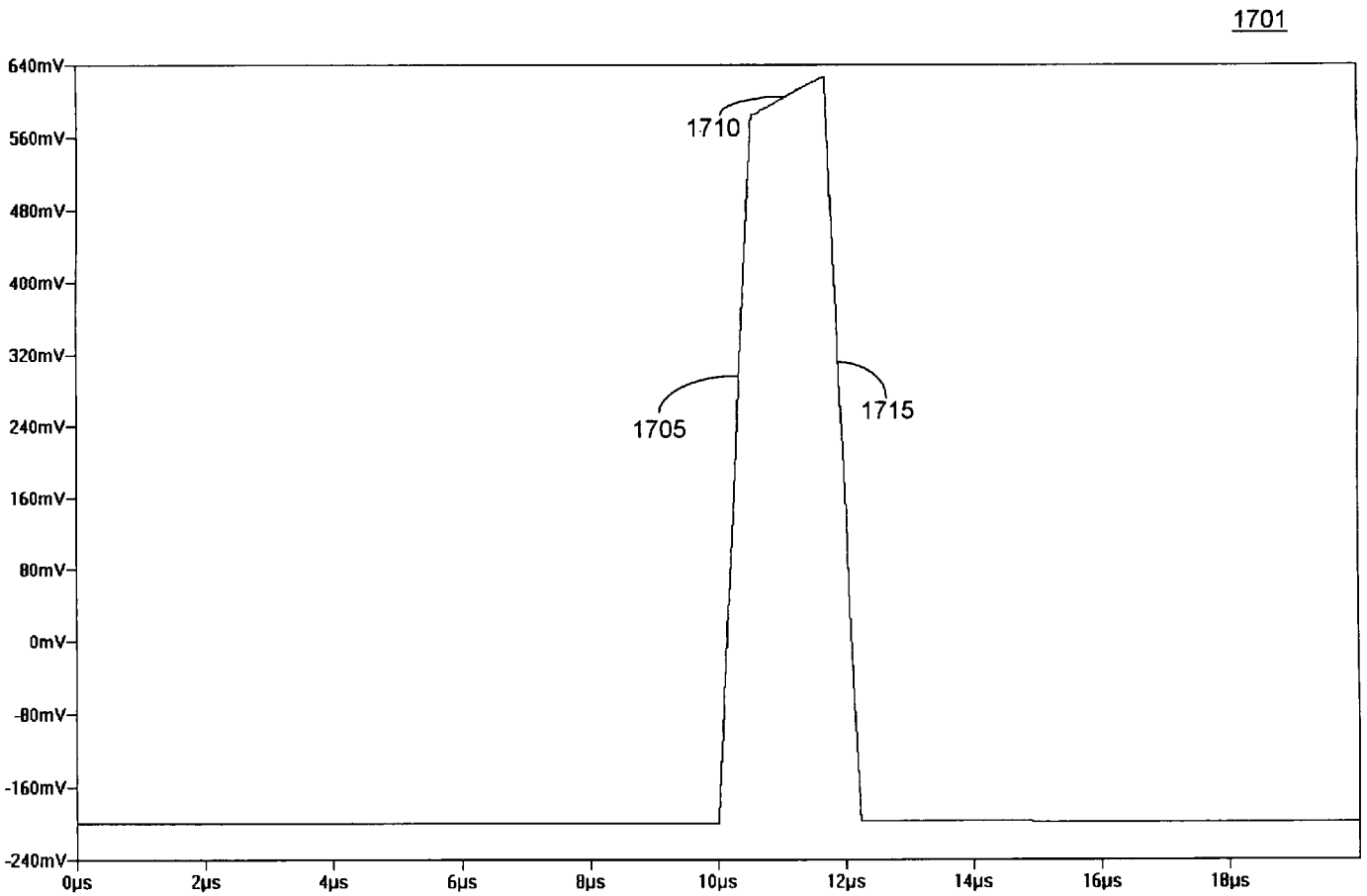

FIG. 17B shows a diagram of the modeled response of the circuit of FIG. 15 with a small capacitance load.

Figure 17C:
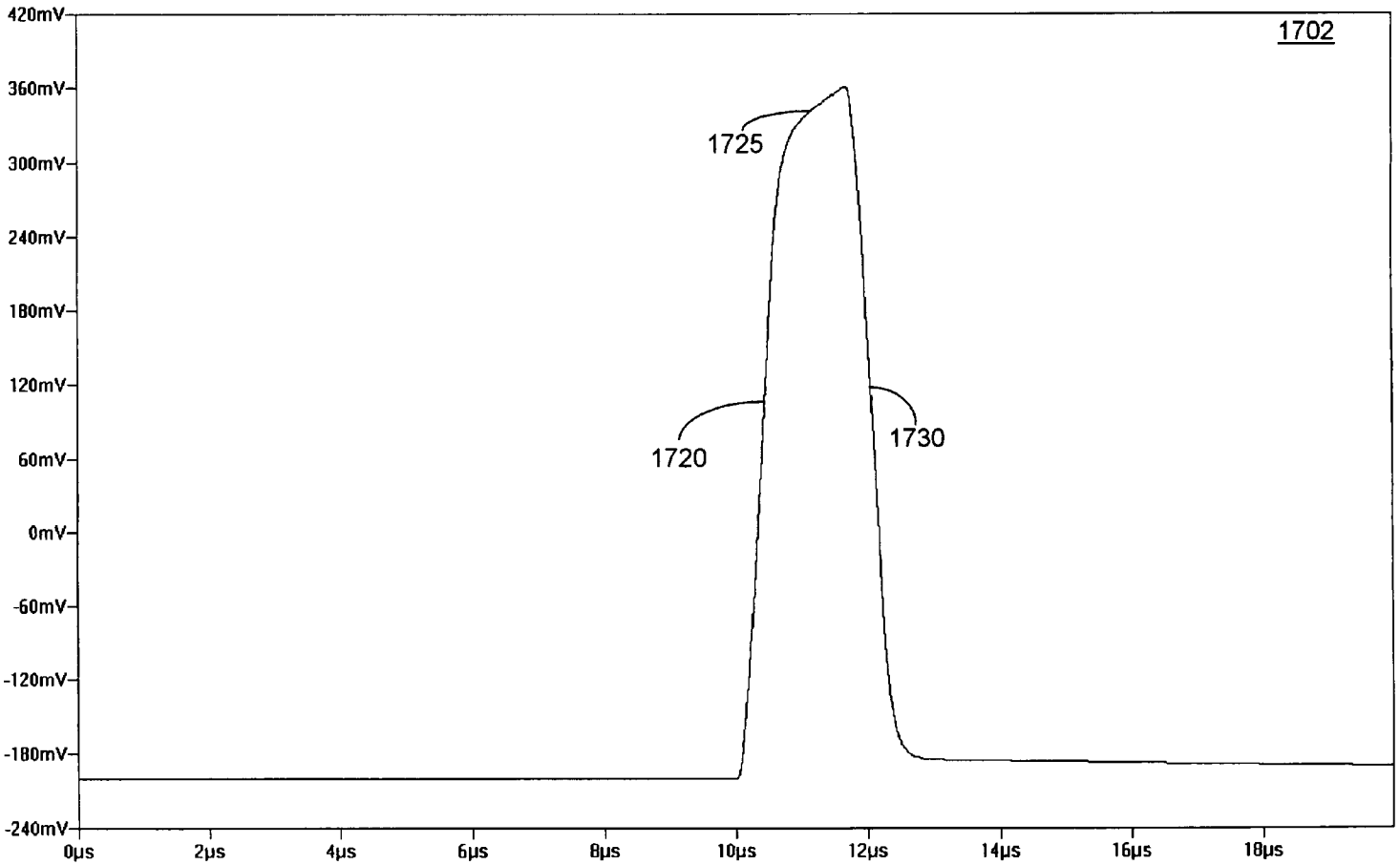

FIG. 17C shows a diagram of the modeled response of the circuit of FIG. 15 with an increased capacitance and a decreased resistance.

Figure 17D:
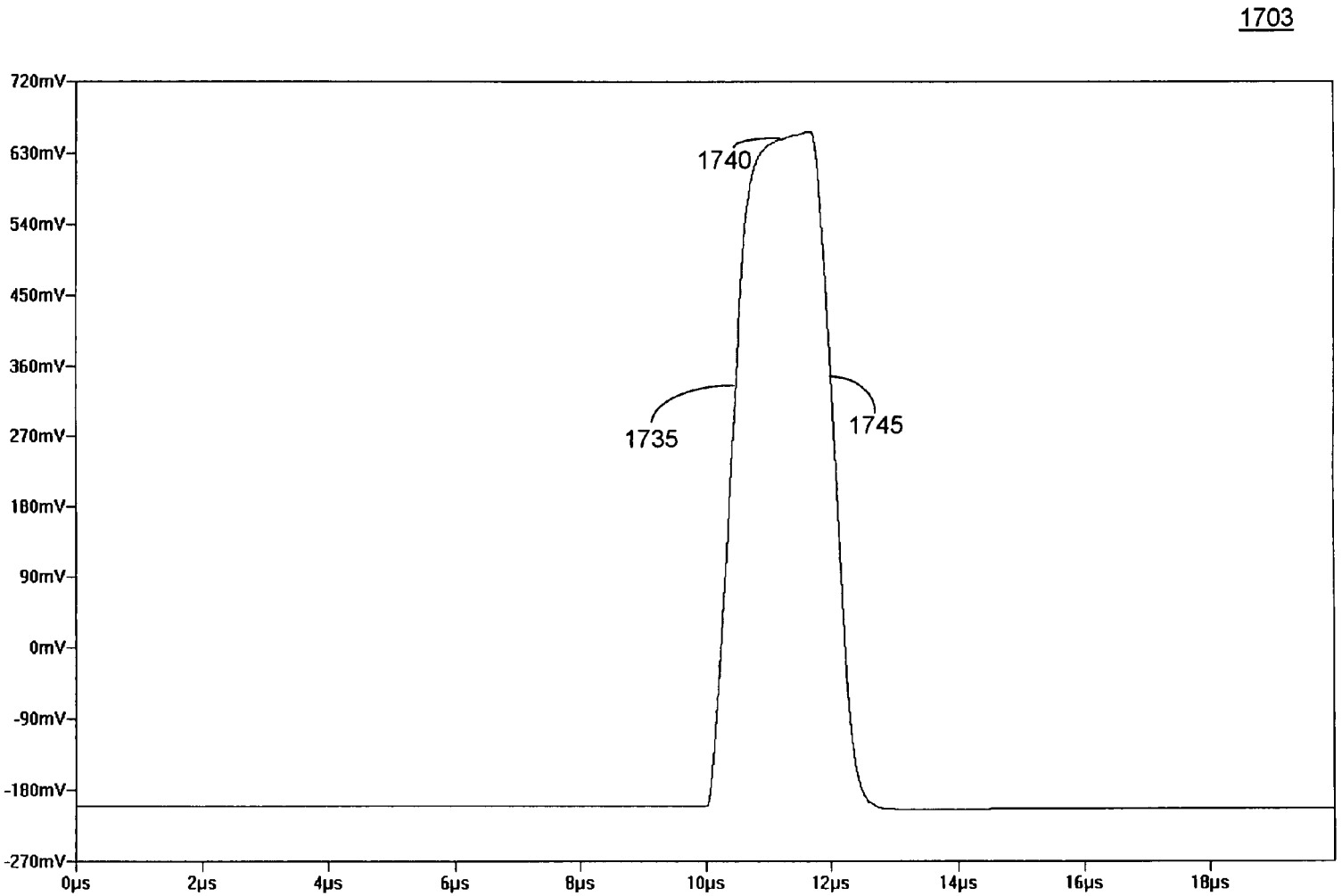

FIG. 17D shows a diagram of the modeled response of the circuit of FIG. 15 with an increased capacitance and a decreased resistance and increased supply voltages.

Figure 17E:
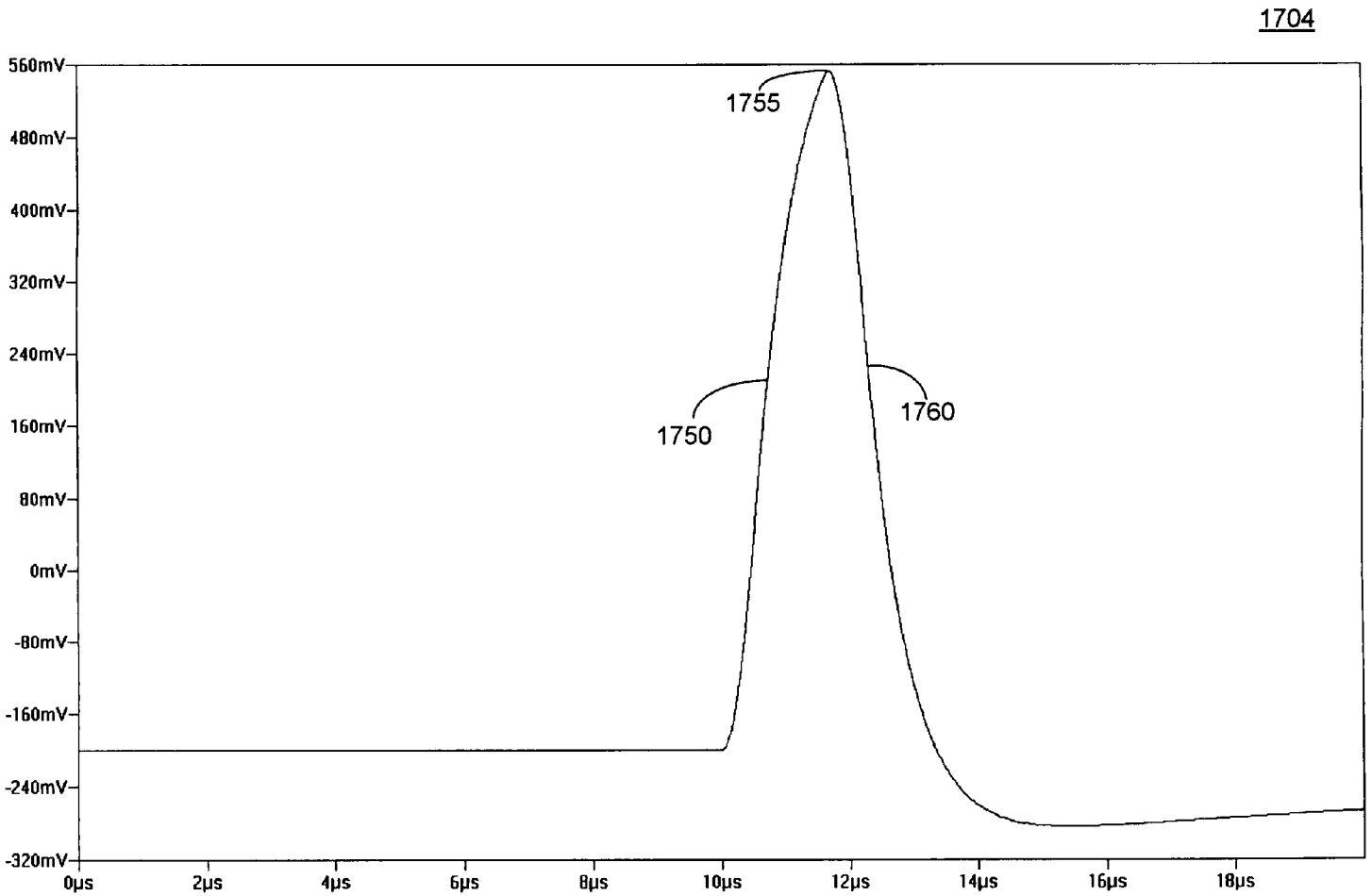

FIG. 17E shows a diagram of the modeled response of the circuit of FIG. 15 with an increased inductance.

Figure 17F:
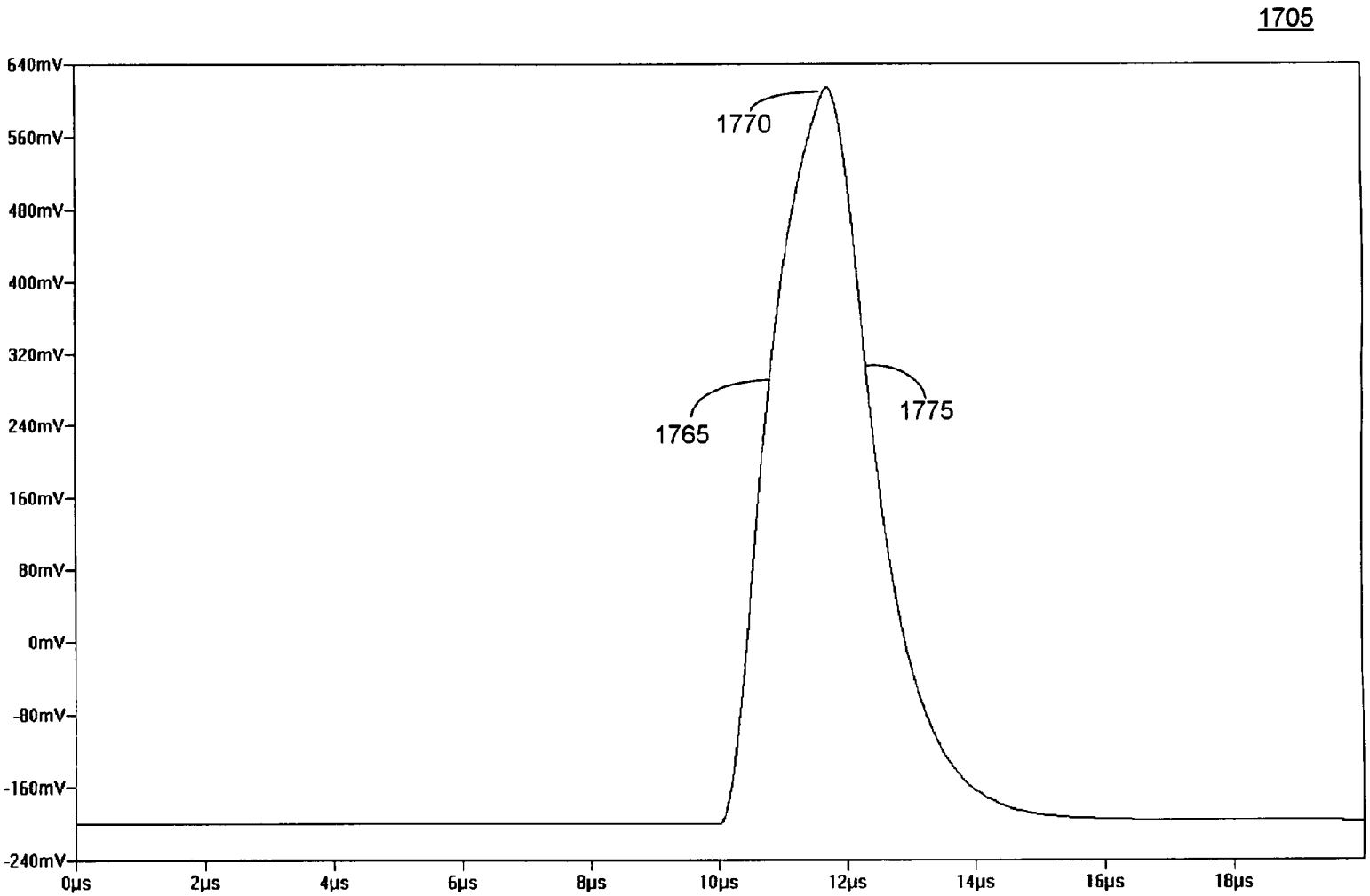

FIG. 17F shows a diagram of the modeled response of the circuit of FIG. 15 with an increased inductance and increased supply voltages.

Figure 17G:
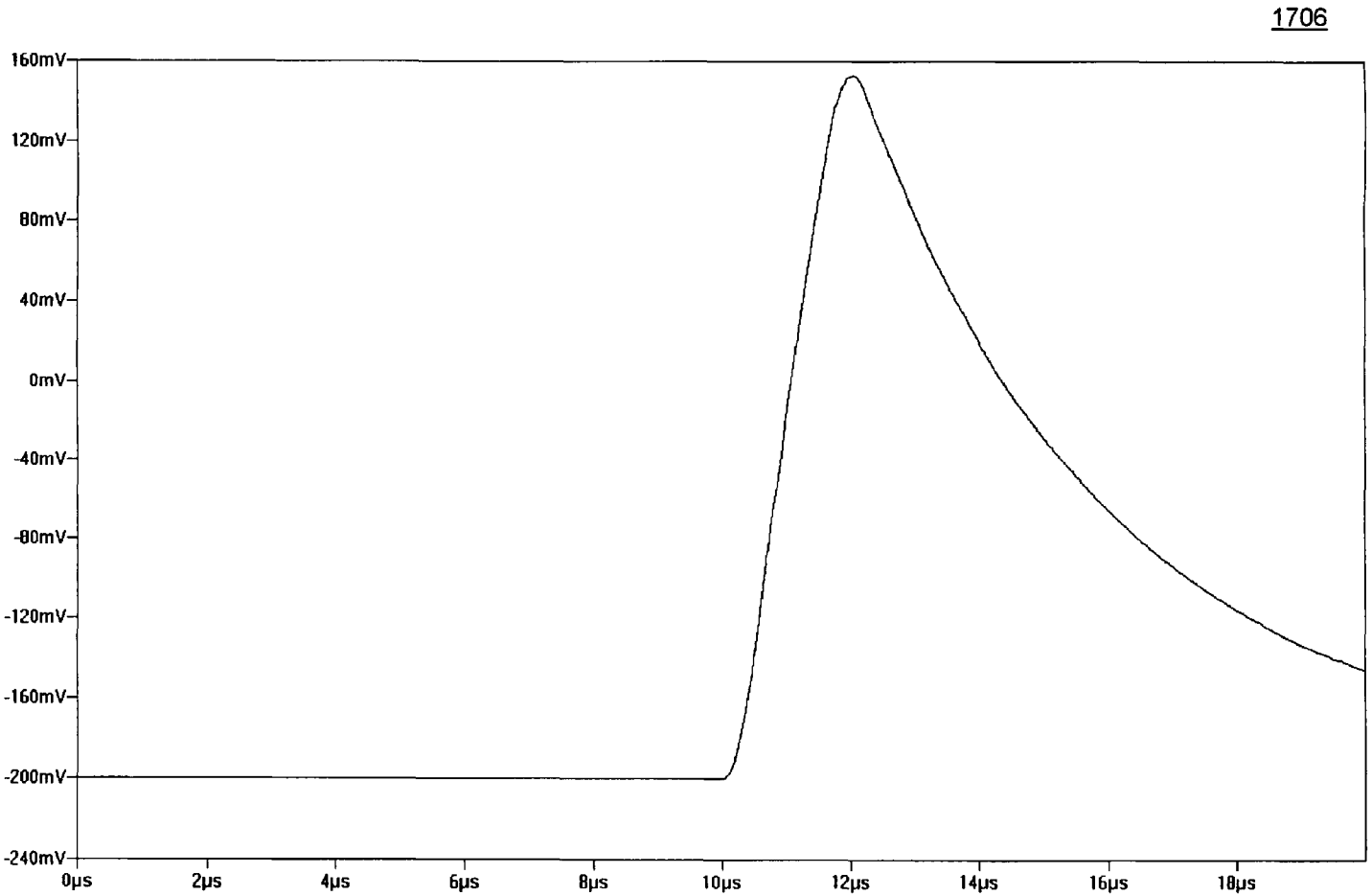

FIG. 17G shows a diagram of the modeled response of the circuit of FIG. 15 with a further increase in inductance. and increased supply voltages.

Figure 17H:
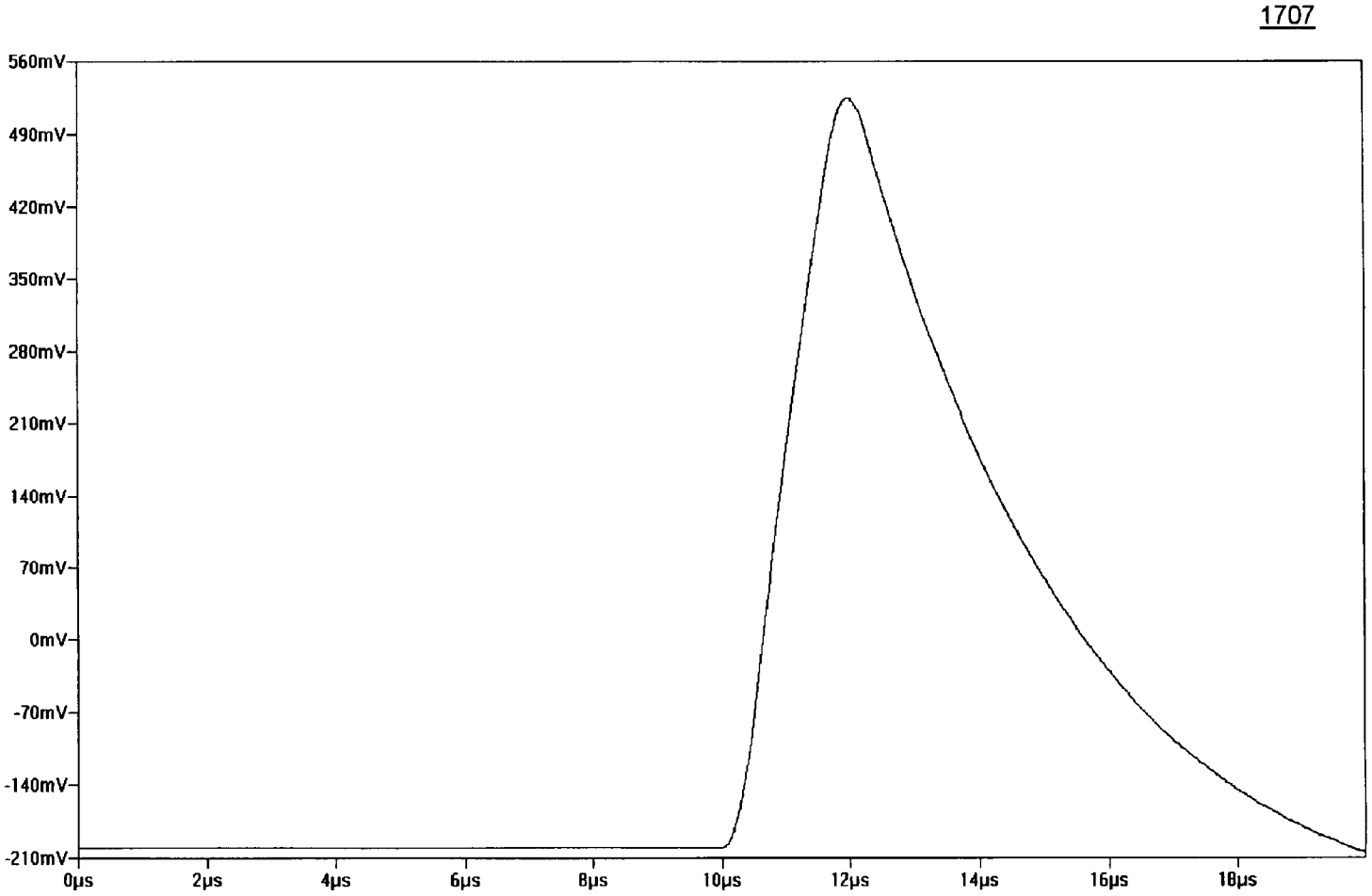

FIG. 17H shows a diagram of the modeled response of the circuit of FIG. 15 with a further increase in inductance and further increase in supply voltages.

Figure 18A:
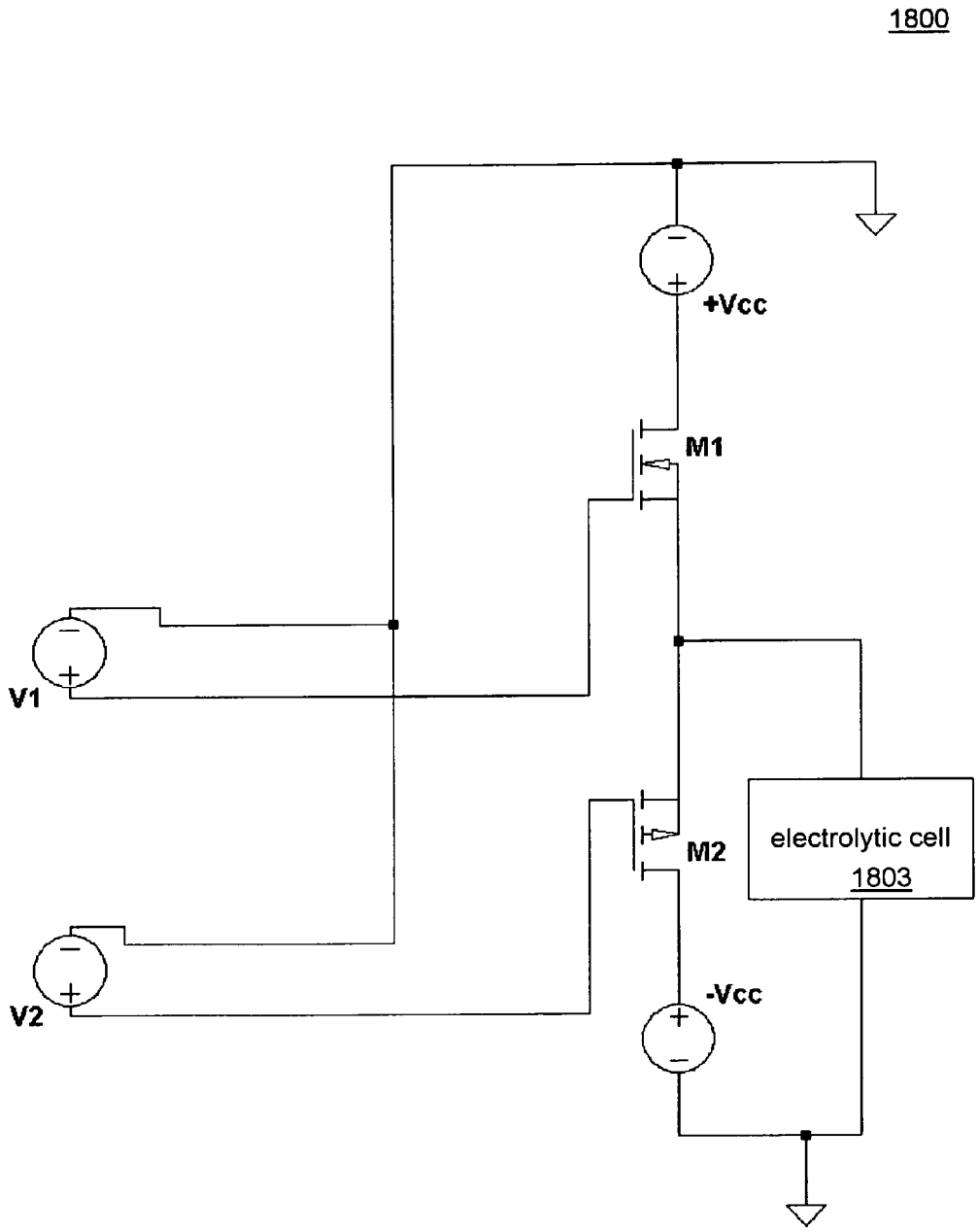

FIG. 18A shows a schematic diagram of a complementary output circuit for driving an electrolytic cell with dual voltages in accordance with an embodiment of the present invention.

Figure 18B:
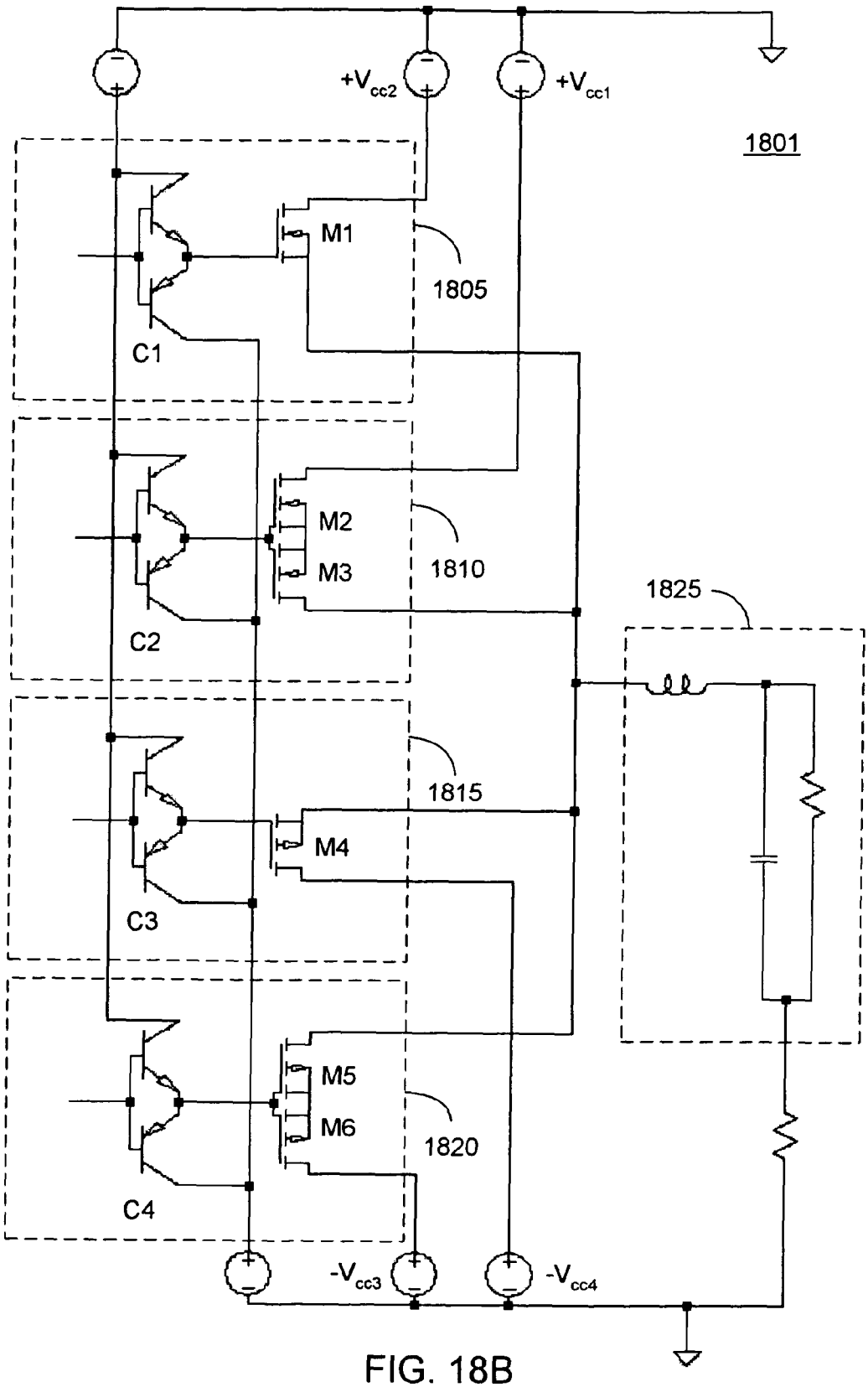

FIG. 18B shows a schematic diagram of a complementary output circuit for driving an electrolytic cell with four voltages in accordance with an embodiment of the present invention.

DETAILED DESCRIPTION OF THE INVENTION

FIG. 3 shows a block diagram 300 of an embodiment of an electrolytic cell interphase control system. A bus 311 couples a control module 310 to a waveform generator 315. The control module 310 transmits signals to the waveform generator 315 that set the parameters of an output waveform (e.g., duty cycle, amplitude, and period). The bus 311 may also provide feedback to the control module 310 with respect to the output of the waveform generator 315. The output waveform of the waveform generator 315 may include a unipolar signal that has a positive excursion referenced to ground and/or a bipolar signal with positive and negative excursions.

The waveform generator 315 is coupled to a driver 320 by a signal bus 312. The bus 312 may couple two nodes and carry a single waveform as the output of the waveform generator 315, or it may carry a number of distinct signals between more than two nodes. In a preferred embodiment the driver 320 is driven by an input signal in the range of 1-10 volts and has output rise and fall times of less than 50 nanoseconds. The driver 320 is coupled to the control module 310 by a bus 325 that allows the control module 310 to monitor the driver output and/or control the supply voltage for the driver 320.

The driver 320 is coupled to a power module 330 that is essentially a switched current supply that provides current to an electrode assembly 340 via a transmission line 335. The power module may include N-channel and/or P-channel MOSFETs (metal-oxide semiconductor field-effect transistors). In a preferred embodiment the power module includes multiple selectively switched MOSFETs coupled to three or more supply voltages. The power module 330 is coupled to the control module 310 by bus 325, allowing for control of the supply voltages to the MOSFETs.

In addition to MOSFETs, JFETs (junction field effect transistors), BJTs (bipolar junction transistors), and IGBTs (insulated-gate bipolar transistors) may be used as switches in the power module 330. Generally, the turn-off speed of silicon BJTs and IGBTs is inferior to that of silicon MOSFETs. However, BJTs using materials such as gallium arsenide and indium phosphide and employing heterojunction structures can provide considerable improvements over silicon BJTs. JFETs may be preferred for low voltage applications.

The transmission line 335 is preferably a coaxial transmission line or a parallel plate transmission line, or may be a combination of the two. In a preferred embodiment the gap between conductors in the transmission line is substantially filled with a solid dielectric. It is desirable that the two conductors be restrained from moving under the influence of the magnetic fields generated by the current flowing through them. If the two conductors are able to respond to the magnetic fields that are generated, they may act as an electromechanical transducer that presents a variable load to the power module 330, thus altering the waveform at the electrode surface. For coaxial conductors, a displacement of the axis of the center conductor with respect to the axis of the outer conductor does not affect the DC inductance; However, it can affect the inductance at high frequencies.

For purposes of this disclosure, a statically configured transmission line is defined as a restrained pair of conductors configured as a transmission line with a sufficiently small spacing between them such that if they were not restrained, one or both conductors would experience a displacement as a result of the electromagnetic force generated by an operational current flowing through the pair of conductors. Operational current is defined as a current that would flow through the conductors during normal operation.

The electrode assembly 340 is preferably a transmission line structure, with the anode and cathode serving as the two conductors in the transmission line in contact with electrolyte 345. In one embodiment the gap between the anode and cathode is substantially filled with a solid dielectric. In another embodiment the gap between the anode and cathode is substantially filled with electrolyte 345. Frequent reference will be made in this specification to an "electrode assembly" or an "anode/cathode assembly" with two electrodes. Unless specifically stated otherwise, either of the two electrodes may serve as anode or cathode, with a reference to one designation implying the substitution of the other as an alternative embodiment.

For purposes of this disclosure, an "electrode" is a conductor that is intended to be used in contact with an electrolyte, and may be either an anode or a cathode. A "bus" is a conductor that may be used to couple an electrode to a power source or signal source, but is itself not intended to be used in contact with an electrolyte. A "transmission line" may refer to either a parallel plate transmission line or a coaxial transmission line.

For purposes of this disclosure, in reference to a parallel plate transmission line, a preferred but not exclusive embodiment thereof is a pair of substantially flat rectangular conductors that have a spacing s and a width w such that the inductance per unit length L in Henries/meter is approximated by the equation:

$$L = 4\pi \times 10^{-7}\left(\frac{s}{w}\right)$$

In general, there are a number of spatial arrangements of conductors that can be used for transmission lines, such as parallel wires, parallel plates, and coaxial conductors. For purposes of this disclosure, in reference to a transmission line, a preferred but not exclusive embodiment thereof includes a spatial arrangement of conductors that is mechanically fixed to maintain the spatial arrangement under load.

Electrolyte 345 may be an aqueous or nonaqueous solvent containing dissolved ions. A nonaqueous solvent may be an aprotic solvent. The electrolyte 345 may include one or more molten salts such as an alkali metal fluoride or chloride. Electrolyte 345 may also include an ionic material that is a liquid at room temperature. In contrast to electrochemical energy storage devices which may have closely spaced planar electrodes, the volume of electrolyte 345 in contact with the electrode assembly 340 is typically larger than the volume between the electrodes. An electrolytic cell that is used for a manufacturing process requires access to reactant species to replace those converted to product species.

For purposes of this disclosure, the term "accessible electrolyte volume" refers to the volume of electrolyte in an electrolytic cell that is in electrical contact with the anode and cathode. In a preferred embodiment for parallel plate or coaxial transmission line electrode assemblies, the accessible electrolyte volume is at least ten times greater than the volume swept out by the projection of one electrode onto the other.

A sensor 350 is in contact with the electrolyte 345 and coupled to the Control Module 310 by bus 327. Sensor 350 may be a reference electrode, temperature sensor or resistance measurement cell. Sensor 350 provides information feedback for process control by the Control Module 310. Sensor 350 may provide information concurrent with the output of power module 330, or the output of power Module 330 may be suspended while Sensor 350 is operational.

FIG. 3B shows a diagram 301 of an interphase control circuit with a single-switched transmission line electrode assembly 362. Terminal F of transmission line electrode assembly 362 is coupled to terminal D of transmission line bus 360. Terminal E of transmission line electrode assembly 362 is coupled to terminal C of transmission line bus 360 by a switch 364. A bypass capacitor 366 couples terminal C of transmission line bus 360 to terminal F of transmission line electrode assembly 362 and to terminal D of transmission line bus 360. Bypass capacitor 366 is not required but is preferred for circuits in which large currents are switched. Terminals x and y of current source 358 are coupled to terminals A and B, respectively, of transmission line bus 360.

FIG. 3C shows a diagram 302 of an interphase control circuit with a double-switched transmission line electrode assembly 362. Terminal F of transmission line electrode assembly 362 is coupled to terminal D of transmission line bus 360 by a switch 368. Terminal E of transmission line electrode assembly 362 is coupled to terminal C of transmission line bus 360 by a switch 364. A bypass capacitor 366 couples terminal C of transmission line bus 360 to terminal D of transmission line bus 360. Terminals x and y of current source 358 are coupled to terminals A and B, respectively, of transmission line bus 360.

FIG. 3D shows a diagram 303 of an interphase control circuit with a double-switched transmission line bus 360. Terminals A and B of transmission line bus 360 are coupled to terminals x and y of current source 358 by switches 364 and 368, respectively. Terminals E and F of transmission line electrode assembly 362 are coupled to terminals C and D, respectively, of transmission line bus 360. A bypass capacitor 366 couples terminals x and y of current source 358.

FIG. 3E shows a diagram 304 of an interphase control circuit with a single-switched transmission line bus 360. Terminal A of transmission line bus 360 is coupled to terminal x of current source 358 by switch 364. Terminal B of transmission line bus 360 is coupled to terminal y of current source 358. Terminals E and F of transmission line electrode assembly 362 are coupled to terminals C and D, respectively, of transmission line bus 360. A bypass capacitor 366 couples terminals x and y of current source 358.

FIG. 3F shows a diagram 305 of a transmission line electrode assembly 362 with a single-switched current source 358. Terminal E of transmission line electrode assembly 362 is coupled to terminal x of current source 358 by switch 364 and terminal F of transmission line electrode assembly 362 is coupled to terminal x of current source 358. A bypass capacitor 366 is coupled to terminals x and y of current source 358. Switch 364, capacitor 366 and current source 358 may be combined into an integrated power supply 359.

FIG. 3G shows a diagram 306 of a transmission line electrode assembly 362 with a double-switched current source 358. Terminal E of transmission line electrode assembly 362 is coupled to terminal x of current source 358 by switch 364 and terminal F of transmission line electrode assembly 362 is coupled to terminal y of current source 358 by switch 368. A bypass capacitor 366 couples terminals x and y of current source 358.

FIG. 3H shows an electrical schematic diagram 307 of a transmission line bus similar to transmission line bus 360. Repeating unit 307 includes a series inductance $L_{series}$, a series resistance $R_{series}$, and a shunt capacitance $C_{shunt}$.

FIG. 3I shows an electrical schematic diagram 308 of an embodiment of a transmission line electrode assembly. Repeating unit 308*a* includes a series inductance $L_{series}$, a series resistance $R_{series}$, and a shunt capacitance $C_{shunt}$. The repeating unit 308*a* also includes a $C_{dl}$, an $L_{shunt}$, and an $R_{shunt}$, that are associated with an electrolyte in contact with electrodes. The transmission line electrode assembly of diagram 308 may be considered a lossy transmission line stub.

FIG. 3J shows an electrical schematic diagram 309 of an embodiment of a transmission line electrode assembly. Repeating unit 308*a* includes a series inductance $L_{series}$, a series resistance $R_{series}$, a $C_{dl}$, an $L_{shunt}$, and an $R_{shunt}$. The transmission line electrode assembly of diagram 309 is similar to that of diagram 308, except that it lacks a $C_{shunt}$ associated with a non-electrolyte dielectric.

FIG. 3K shows a schematic diagram of a parallel driver module 320*a* coupled to a parallel power module 330*a* by a tunable delay module 322. Driver1 is coupled to switch1 by a delay element delay1 and driver2 is coupled to switch2 by a delay element delay2. In order to obtain high currents, parallelism among drivers and switches may be required. Multiple individual driver circuits may be combined as driver1 or driver2. For example, both driver circuits on a dual integrated circuit (IC) may be combined to drive a single transistor. Although less common, more than one switch circuit may be combined to be driven by a single driver. When a large number driver/switch combinations are combined in parallel, variation in switching behavior between driver/switch combinations will tend to degrade the output waveform.

The delay module 322 provides a tunable delay1 between driver1 and switch1 and a tunable delay2 between driver2 and switch2. For switches with logic level inputs (e.g., logic level input MOSFETs) a monostable multivibrator such as the 74VHC221A device manufactured by the Fairchild Semiconductor Corporation may be used. For switches requiring a high drive voltage, the MM74C221 monostable multivibrator from the Fairchild Semiconductor Corporation may be used. The delay may be tuned once during manufacturing, or it may be tuned periodically during operation. For operational tuning, a digital potentiometer such as the AD5222 manufactured by Analog Devices, Inc. may be used to set the RC time constant for a monostable multivibrator.

Delay1 and/or delay2 may be adjusted to minimize the distortion in the output waveform. Although only two driver/delay/switch combinations are shown, several may be used in an electrolytic cell interphase control system. In general, the greater the number of switches (e.g., transistors) configured in parallel, the greater the benefit of tunable delays. In a preferred embodiment the output rise and fall times of the power module 330*a* are less than 100 nanoseconds.

FIG. 4A shows a perspective view 400 of an embodiment of a parallel plate transmission line 406 coupled to a parallel plate transmission line anode/cathode assembly 407. The parallel plate transmission line 406 includes a top conductor plate 405, a dielectric sheet 415, and a bottom conductor plate 410. The top conductor plate 405 and the bottom conductor plate 410 may be adhesively bonded, clamped, or otherwise fixed to the dielectric sheet 415. For example, the parallel plate transmission line 406 may be fabricated from a copper-clad glass/epoxy composite.

FIG. 4B shows a cross-section view 401 of the parallel plate transmission line 406 of FIG. 4A. A lower mounting block 435 couples the bottom conductor plate 410 to electrode 425 of the parallel plate transmission line anode/cathode assembly 407 and an upper mounting block 440 couples the top conductor plate 405 to electrode 420 of the anode/cathode assembly 407. Although the anode/cathode assembly 407 may be more or less permanently fixed to the parallel plate transmission line 406, it may be desirable to have a removable parallel plate transmission line anode/cathode assembly 407 that may be attached (e.g., bolted) to the upper mounting block 440 and lower mounting block 435. Either of the electrodes 420 and 425 may serve as anode or cathode, and more than one parallel plate transmission line anode/cathode assembly 407 may be coupled to the parallel plate transmission line 406.

FIG. 4C shows a cross-section view 402 of a construction for an embodiment of parallel plate transmission line. A top conductor 405 and bottom conductor 410 sandwich a dielectric sheet 415. For minimum inductance it is desirable that the dielectric sheet 415 be thin so that the center-to-center spacing of top conductor 405 and bottom conductor 410 be minimized. Similarly, it is desirable that the conductor 405 and 410 be thin so that their center-to-center spacing be minimized. Although decreasing the thickness of the conductor results in an increase in resistance, the width can be increased to maintain the cross-sectional area while further reducing the inductance. In a preferred embodiment, the ratio of the center-to-center spacing to the width of top conductor 405 and bottom conductor 410 is greater than 1000.

For parallel plate transmission lines with thin, wide, conductors and dielectrics, a top backup plate 450 and/or a bottom backup plate 455 may be used. A fastener 460 (e.g., bolt) may be used to clamp top backup plate 450 and bottom backup plate 455 against top conductor 405, dielectric 415 and bottom conductor plate 410. A dielectric sleeve 445 may be used to insulate the fastener 460 if it is conductive. It is preferable that the top backup plate 450 and the bottom backup plate 455 be electrically isolated from top conductor 405 and bottom conductor 410, or that they be fabricated from a dielectric material.

The holes in top conductor 405 and bottom conductor 410 may have a chamfer 470 if dielectric 415 is very thin, or large voltages are applied to the transmission line. Conductor edges may also be provided with a radius to avoid high electric fields. A dielectric fill 445 may also be used to improve resistance to short circuits between top conductor 405 and bottom conductor 410. In general it is desirable that materials with a high magnetic permeability be excluded from the transmission line assembly.

In a preferred embodiment, a top backup plate 450, a top conductor 405, a bottom conductor 410, and a bottom backup plate 455 are bonded together using a filled epoxy adhesive. Examples of a suitable fill material are silica and alumina. The fill material particles may be sized to provide a minimum separation distance between top conductor 405 and bottom conductor 410. The assembly may be vacuum encapsulated to prevent voids.

The dielectric 415 may be fabricated from a variety of polymers such as fluorocarbons, polyesters, or other polymers that are used in the fabrication of film capacitors. Alternatively, the dielectric may be deposited as a film on top conductor 405 and/or bottom conductor 410 (e.g., from paraxylene).

FIG. 4D Shows a perspective view 403 of parallel plate transmission line 406 coupled to a parallel plate transmission line anode/cathode assembly 408 with an electrolyte filled gap 431. In keeping with the preference of a low inductance, the thickness of the gap 431 and the thickness of electrodes 420 and 425 may kept small, in which case additional mechanical support may be required to resist electromagnetic forces. Electrode 420 and electrode 425 are shown with backup plates 421 and 426, respectively.

FIG. 4E Shows a cross-section view of the parallel plate transmission line of FIG. 4C. It should be noted that although the substitution of the electrolyte filled gap 431 in parallel plate transmission line 408 for the solid dielectric filled gap in parallel plate transmission line 407 has no significant direct effect on the inductance; however, there is a considerable impact on the performance in an electrolytic cell due to the difference in behavior when immersed in an electrolyte. parallel plate transmission line 408 will have a much lower resistance and a much more uniform current density at the wetted surfaces of electrodes 420 and 421. The difference in current distribution may also manifest itself as a difference in inductance due to the change in current distribution.

The RC time constant of an electrolytic cell is typically dominated by the bulk resistance of the electrolyte and the double-layer capacitance associated with the electrode surfaces. The double-layer capacitance may be decreased by limiting area, but this also limits the throughput of the cell. The double-layer capacitance and bulk resistance can also be reduced by altering the electrolyte composition, but this may also reduce throughput. The preferred approach to reducing the RC time constant of an electrolytic cell is to minimize the spacing between electrode 420 and electrode 426.

There are two primary disadvantages associated with a very narrow gap 431. First, there is the inhibition of the transport of reactants and products to and from the electrode surfaces. Second, if the electrolytic cell is used for an electrodeposition process, the gap spacing will change as deposition occurs. Mass transport may be improved by directing a flow of electrolyte into the gap under pressure. Narrowing of the gap 431 by electrodeposition may be dealt with by substitution using removable electrodes.

FIG. 5A shows a top perspective view 500 of an embodiment of a switched coaxial transmission line bus 505. An outer conductor 510 encloses a dielectric 515 which in turn encloses a center conductor 520. Switches 530 couple center conductor 520 to conductor plate 525.

FIG. 5B shows a top view 501 of the switched coaxial transmission line of FIG. 5A. For clarity, dielectric 515 and outer conductor 510 are shown cut back to expose a portion of inner 520 and conductor plate 525. The exposed surface of conductor plate 525 may be used to mount circuit elements associated with the switches 530. In practice, dielectric 515 and outer conductor 510 may envelop a greater area of conductor plate 525 and inner conductor 520.

FIG. 5C shows a cross-section view 502 of the switched coaxial transmission line bus 505 of FIG. 5A with an integrated anode/cathode assembly including planar electrode 535 and planar electrode 540. It can be seen that the switched coaxial transmission line bus 505 could be converted into a switched parallel plate transmission line by removing portions of the dielectric 515 and 520, essentially creating a switched version of the parallel plate transmission line shown in FIG. 4A.

FIG. 5D shows a bottom perspective view 503 of the switched coaxial transmission line of FIG. 5C. Planar electrode 540 and planar electrode 535 are shown without a dielectric. However, it should be noted that both filled and unfilled coaxial and parallel plate transmission lines may be used as anode/cathode assemblies and attached to coaxial and parallel plate transmission line busses using an orthogonal transition.

FIG. 6A shows an exploded view 600 of an embodiment of a parallel plate anode/cathode assembly. First and second mounting blocks 605 and 610 are provided for establishing an electrical connection to electrodes 625 and 615, respectively. Mounting blocks 605 and 610 also provide a means for attaching the assembly to a parallel plate or coaxial transmission line bus.

Electrodes 625 and 615 are separated by a dielectric 620. The dielectric 620. The electrodes 625 are preferably copper, and may be coated with other metals to provide a working surface with different properties (e.g., platinum). If a high permeability material such as nickel is used as a coating, it is desirable that the coating be kept thin to avoid an undue increase in inductance. The dielectric 620 may be a ceramic, a polymer, or a composite material. It may be a sheet form that is bonded to electrodes 625 and 615 with an adhesive. Alternatively, it may be a dielectric adhesive that is applied to electrode 625 and/or electrode 615.

FIG. 6B shows an assembled view 601 of the parallel plate anode/cathode of FIG. 6A. The hole 606 provides a path for current and mass transport between the two electrode surfaces. More than one hole may be provided, depending upon the desired current distribution and mass transport between the electrode surfaces. The parallel plate transmission line with a solid dielectric and the parallel plate electrode with a gap can be viewed as the opposite ends of a spectrum of parallel plate electrode configurations, with perforated solid dielectric parallel plate electrodes falling in between. In one embodiment, the dielectric is a ceramic substrate and electrode 615 and 620 are deposited using thin film or thick film techniques such as those used for electronic circuits. Hole patterns in the ceramic substrate may be punched in green tape before firing.

FIG. 6C shows a cross section view 602 of an embodiment of a parallel plate anode/cathode assembly. An anode 630 and a cathode 635 are bonded together by a thermosetting polymer adhesive 640 that contains filler particles 645. The thermosetting polymer adhesive may be an epoxy and the filler particles may be silica, alumina, or other ceramic.

FIG. 7A shows an exploded view 700 of a solid dielectric coaxial anode/cathode assembly. A coaxial element 790 includes center electrode 705 and an outer electrode 715 that are separated by a dielectric 710. the cutback of the outer conductor 715 at the upper end provides a more uniform current distribution at the electrode surfaces. a first plate conductor 725, a dielectric 730, and a second plate conductor 735 make up a socket portion 791 of a parallel plate transmission line for connection to the coaxial element 701.

FIG. 7B shows a perspective view 701 of a solid dielectric coaxial anode/cathode assembly 790 attached to a switched coaxial transmission line 745. Switched coaxial transmission line 745 is similar to switched coaxial transmission line 505 shown in FIG. 5A. It should be noted that the orthogonal transition shown in FIGS. 7A and 7B may be used to connect a circular coaxial transmission line bus to a parallel plate transmission line electrode assembly. In practice it is usually more straightforward to use a parallel plate transmission line or a coaxial transmission line with a rectangular cross-section since the switched current source typically has a planar layout to begin with.

FIG. 8 shows a perspective view 800 of a coaxial anode/cathode assembly 890 attached to parallel plate transmission line 805. The coaxial anode/cathode assembly 890 has a center electrode 810 separated from an outer electrode 815 by a gap 820.

FIG. 9A shows a perspective view 900 of a transmission line duct 991 with an anode wall 915 and an opposing cathode wall 920. As with other transmission line conductors discussed herein, the anode wall 915 and cathode wall 920 are preferably fabricated from a material with high electrical conductivity and low magnetic permeability such as copper. For applications where dimensional stability is desired, particularly at high temperatures, tungsten or molybdenum may be used. The base electrode may be coated with another metal to obtain particular surface characteristics. For a particular electrolyte, the surface coating may be chosen to provide a non-polarizable, or low polarization electrode. Anode wall and/or cathode wall 920 may be partially masked to provide a desired ratio between the active areas of anode wall 915 and cathode wall 920.

A first dielectric wall 925 and a second dielectric wall are sandwiched between the anode wall 915 and the cathode wall 930, and their height determine the height of the duct channel 935. Dielectric wall 925 and 930 are preferably fabricated from a dielectric material that is inert with respect to the electrolyte contemplated for use. For very short walls, a stiff, creep resistant material such as silica, alumina, beryllia, or other ceramic is preferred to maintain dimensional stability. Non-oxide ceramics such as silicon nitride, boron nitride, silicon nitride, and aluminum nitride may be used.

Top backup plate 905 and bottom backup plate 910 are not required, but are preferred when the anode wall 915 and cathode wall 920 are thin and additional mechanical support is desired. The anode wall 910 and the cathode wall 915 may be fabricated on the top backup plate 905 and the bottom backup plate 910, respectively, using thin-film or thick film techniques such as those use for fabricating electronic circuits on ceramic substrates. Patterning may be done using photolithographic techniques. Single crystal and polycrystalline ceramic materials may be lapped and polished to provide backup plates with high dimensional accuracy. Thin gold metallization may applied along with appropriate adhesion layers to provide diffusion bondable surfaces. Opaque and/or transparent ceramic materials may be used for backup plate 905 and/or backup plate 910.

The anode wall 910 and/or the cathode wall 915 may be fabricated by depositing transparent conductive materials on the top backup plate 905 and the bottom backup plate 910, respectively. Examples of suitable transparent conductive materials are antimony doped tin oxide and tin doped indium oxide. Transparent conductive materials may be deposited alone or in combination with a fine-line metal pattern for enhanced conductivity. Examples of materials that are suitable for use as top backup plate 905 and bottom backup plate 910 are sapphire and fused silica. For greater transmission in the IR region, sulfides, selenides and halides may be used. The use of transparent materials for the backup wall and anode/cathode walls enables the illumination of the electrode surfaces.

The flat surface surrounding the duct channel 935 provides an area against which a seal may be made to enable a forced fluid flow through the channel duct 935. Additional backup plates may be added to increase the seal surface area around the channel duct 935. A temporary seal may be made using gaskets or o-rings, and a more permanent seal may be made using adhesives. The use of ceramic materials and thin film techniques enables the construction of ducts with a height on the order of 0.001 inches or smaller and a width on the order of an inch or larger. For low profile transmission line ducts, adapters may be attached to facilitate plumbing connections. The transmission line duct 991 is an embodiment of a fundamental element of the present invention: an electrolytic cell with inherently low inductance that is achieved through closely spaced and substantially parallel electrodes with a separation that is small compared to the width of parallel plate electrodes, or the cross-section perimeter of the center conductor in the case of coaxial electrodes. In a preferred embodiment of transmission line duct 991 the width to separation ratio of the anode wall 910 and the cathode wall 915 is at least 100. In a most preferred embodiment of transmission line duct 992 the width to separation ratio is at least 1000.

FIG. 9B shows a perspective view 901 of an embodiment of a switched transmission line duct 992. An anode wall 916 and a cathode wall 921 are coupled to and separated by a dielectric wall 931 and a transmission line dielectric 926. The transmission line dielectric 926 is also coupled to a switch plate 917 and separates switch plate 917 from the cathode wall 921. The switch plate 917 is coupled to anode wall 916 by switches 940 (e.g., transistors). The switched transmission line duct 992 is essentially a union of two parallel plate transmission lines, with two of the conductors being directly coupled and the other two conductors being coupled by switches.

FIG. 9C shows a perspective view 902 of an embodiment of a transmission line duct 993 with a detachable switch module 994. The transmission line duct 993 is similar to the transmission line duct 991 of FIG. 9A, but has been adapted for detachable coupling to the power module 994. dielectric walls 931*a* and 931*b* are disposed between anode wall 918*a* and cathode wall 913*a*, which are in turn sandwiched between backup plate 907*a* and backup plate 912*a*.

The detachable switch module 994 has a lower conductor plate 913*b* and an upper conductor plate 918*b* that are separated by and coupled to a transmission line dielectric 931*c*. The transmission line dielectric 931*c* is also coupled to a switch plate 919 and separates switch plate 919 from the lower conductor plate 913*b*. The switch plate 919 is coupled to upper conductor plate 918*b* by switches 940 (e.g., transistors).

FIG. 9D shows a perspective view 903 of the transmission line duct 993 and detachable power module 994 of FIG. 9C in an attached configuration. dielectric wall 931*b* and transmission line dielectric 931*c* interlock as a tongue-in-groove. Anode wall 918 overlaps upper conductor plate 918*b*, and cathode wall 913*a* overlaps bottom conductor plate 913*b*. The detachable power module is desirable when an array of transmission line ducts 993 are arranged in the same fluid electrolyte circuit. If a power module 994 fails, it can be replaced without disturbing the fluid electrolyte circuit.

In an electrolytic cell with an aqueous electrolyte, a nominal double-layer capacitance of 20 microfarads per square centimeter and an electrode area of 25 square centimeters, the average current required to charge the capacitance to one volt in one microsecond is on the order of 500 amperes. Faster charging times will require proportionally larger currents, with peak currents on the order of thousands of amperes.

For an electrolytic manufacturing process that requires large total electrode areas in order to obtain a reasonable throughput, driving a single large electrolytic cell (e.g., plating bath) will be very difficult. Thus, it is an aspect of the present invention to provide a compact module that combines an electrolytic cell with a local power supply. Another aspect of the invention is the combination of an array of compact modules to provide a large total electrode area.

The inductance of a circuit element increases with length. It is thus desirable to minimize the circuit path between the switch and the anode/cathode of a high-speed electrolytic cell. Instead of increasing the size of a power supply and the electrolytic cell it serves, the electrolytic cell can be divided into a plurality of smaller cells, each with a dedicated power supply. To reduce the overall load capacitance and thus reduce the peak current, an array of electrolytic cells may be configured in series. The smaller capacitance will reduce the charging current that is required; however, the overall applied voltage will be increased.

FIG. 10A shows a perspective view 1000 of an embodiment of an electrolytic module 1090 that is derived from the transmission line duct 992 shown in FIG. 9B. The duct channel 936 of transmission line duct 992 has been subdivided by a septum 1010 to produce two adjacent duct channels 1005*a* and 1005*b*. Septum 1010 may be used to provide additional dimensional stability and accuracy for closely spaced anodes and cathodes. A control circuit board 1015 has also been added. Vias may be used to connect circuit elements on the circuit control board 1015 to the transmission line conductors.

Control circuit board 1015 provides a number of control functions for the switch transistors 1020*a*, 1020*b*, and 1020*c*. Bypass capacitors 1025*a*, 1025*b*, and 1025*c* are in close proximity to switch transistors 1025*a*, 1025*b*, and 1025*c*, and serve to minimize voltage drops at turn-on. Bypass capacitors 1025*a*, 1025*b*, and 1020*c* preferably have a low equivalent series resistance. Multiple capacitors may be used in parallel for each transistor. Transistor driver 1035 provides the drive signal to switch transistors 1020*a*, 1020*b*, and 1020*c*. Transistor driver 1035 may be a MOSFET driver, and more than one may be used to drive the switch transistors 1020*a*, 1020*b*, and 102*c*. Waveform generator 1040 provides the waveform that is amplified by transistor driver(s) 1035. Voltage regulators 1030*a*, 1030*b*, and 1030*c* provide the supply voltages to switch transistors 1020*a*, 1020*b*, and 1020*c*.

Microcontroller 1045 controls the output voltages of voltage regulators 1030*a*, 1030*b*, and 1030*c*. Microcontroller 1045 may have a built-in Analog-to-digital conversion capability that provides for adjustment of the voltage regulators in response to measured I-V characteristics of the anode and cathode. Microcontroller 1045 may also have a communications capability that allows it to be networked with a master controller, thus allowing a central master controller to control an array of electrolytic modules 1090. Examples of devices suitable for use as microcontroller 1045 are the Z8 Encore!® 8K Series of 8-bit microcontrollers manufactured by Zilog, Inc.

The functions described in relation to circuit board 1015 may be provided by different configurations of integrated circuits and discrete devices. Field programmable gate arrays (FPGAs) or application specific integrated circuits (ASICs) may also be used. Additional switch transistors, bypass capacitors, and voltage regulators may be added to provide more complex output waveforms.

FIG. 10B shows a bottom perspective view 1001 of an embodiment of a double-switched electrolytic module 1091 that is derived from the electrolytic module 1090 shown in FIG. 10A. The cathode wall 921 of electrolytic module 1090 has been divided into a cathode wall 1021*a* and a switch plate 1021*b*, which are coupled by switching transistors 1025*d*, 1025*e*, and 1025*f*. A circuit board 1055 is coupled to switch plate 1021*b*, and serves to drive switching transistors 1025*d*, 1025*e*, and 1025*f*. The use of two sets of switches allows both terminals of the electrolytic cell to be driven, thus enabling the use of a bridge configuration. Circuit board 1055 may be configured as a slave circuit, with circuit board 1015 serving as a master. In slave mode, circuit board 1055 may or may not include a microcontroller and/or waveform generator. Stiffener 1060 has been added to prevent the loss mechanical integrity that may occur from the division of the cathode wall. Modifications to the location of the switched gaps and to the backup plates may also be made to improve mechanical integrity.

FIG. 10C shows a perspective view 1002 of an illuminated electrolytic module 1092 that is derived from the electrolytic module 1090 of FIG. 10A. An input adapter 1060 and an output adapter 1062 are coupled to a circulation pump 1070 by conduits 1065 and 1067, respectively. Input adapter 1060 and output adapter 1062 are coupled to opposite ends of the channel duct of electrolytic module 1092 to provide forced flow of electrolyte through the channel duct.

Illumination module 1080 may be provided as a photon source for use with transparent backup plate/electrode assemblies to provide radiation at an electrode surface to assist redox reactions. The illumination module may be a continuous source or it may be a pulsed source. The illumination module may be controlled by the circuit board 1015. As a pulsed source, the illumination module may be synchronized with a switch driver waveform output by the circuit board 1015.

The illumination module 1080 may be a monochromatic light source or a filtered light source for providing a limited spectrum. Light emitting diodes (LEDs) and/or laser diodes may be used as elements in the illumination module 1080. The illumination module 1080 may include fiber optics or other transmission means to couple the electrolytic module 1092 to a remote photon source (e.g., a tunable dye laser).

FIG. 11A shows a cross-section view 1100 of an embodiment of an electrolytic module 1190 that includes an array of transmission line ducts that are electrically connected in series. The electrolytic module 1190 is constructed using the transmission line duct 991 of FIG. 9A as a basic building block. The dielectric and conductive elements have been modified to provide the serial configuration shown in FIG. 11.

Anode 1105 and cathode 1110 provide terminals for connection to a power supply. Anode 1105 is separated from composite electrode 1125*a* by dielectric walls 1115*a* and 1120*a*. Composite electrode 1125*a* is separated from composite electrode 1125*b* by dielectric walls 1115*b* and 1120*b*. Cathode 1110 is separated from composite electrode 1125*b* by dielectric walls 1115*b* and 1120*b*. Composite electrodes 1125*a* and 1125*b* each serve as an anode to one electrolytic cell, and as a cathode to an adjacent cell. Backup plate structures 1130*a*, 1130*b*, and 1130*c* support the electrodes and provide mechanical integrity. Backup plate structures 1130*a*, 1130*b*, and 1130*c* may be in part fabricated by vacuum encapsulation or injection molding around a stack of components.

The serial connection of the electrodes in electrolytic module 1190 requires that the electrolyte volumes with each of the duct channels 1135*a*, 1135*b*, and 1135*c*, be electrically isolated from each other. It is also important that each channel duct have the same electrode areas so that the potential applied to the electrolytic module 1190 will be evenly divided across the duct channels 1135*a*, 1135*b*, and 1135*c*. This may be achieved by the use of photolithographic techniques and thin film deposition on ceramic substrates.

The RC time constant of the electrolytic module 1190 is substantially the same as that for a single transmission line duct. Although the serial connection reduces the net capacitance, the capacitance reduction is offset by the series resistance increase. However, the increased complexity of the electrolytic module 1190 allows for the use of smaller drive currents at higher voltages. This reduces the voltage transients associated with fast switching.

FIG. 12A shows a schematic view 1200 of an electrolyte recirculation system 1290. An electrolyte reservoir 1205 contains an electrolyte volume 1210. A sensor array 1245 and a heating module are immersed in the electrolyte volume 1210 and coupled to a bath controller 1240. The sensor array 1245 provides information to the bath controller 1240 regarding the bath conductivity and/or composition. the heating module 1248 maintains the temperature of the electrolyte volume. An electrolyte conduit 1215 couples the electrolyte volume to pumps 1220*a* and 1220*b*, which are controlled by bath controller 1240. Pumps 1220*a* and 1220*b* may be isolation pumps that provide isolation between the conduit 1215 and electrolytic cells 1225*a* and 1225*b*, respectively.

Electrolytic cells 1225*a* and 1225*b* preferably include transmission line ducts similar to those previously described. In a preferred embodiment the electrodes of electrolytic cells 1225*a* and 1225*b* are connected in series in a manner similar to that shown in FIG. 11. Output isolators 1230*a* and 1230*b* may be isolation pumps or they may be passive piston/cylinder/valve configurations that provide a discontinuity in the ionic conductance path while maintaining electrolyte flow. although electrolytic cells 1225*a* and 1225*b* could be provided with independent electrolyte fluid circuits, better process uniformity may be obtained by using a mixed common electrolyte and electrical isolation of the cells.

A secondary electrolytic cell 1250 provides for modification of the electrolyte composition and is coupled to bath controller 1240. Anode 1251 and cathode 1252 are controlled by the bath controller 1240 and are immersed in the electrolyte 1210. Anode 1251 may be a consumable anode. Secondary electrolytic cell 1250 may be used to provide redox reactions that may or may not involve electrodeposition. Anode 1251 may be a consumable anode FIG. 12B shows a schematic diagram 1201 of an embodiment of an isolation pump 1291. A first check valve 1280*a* has an electrolyte inlet port 1270 and an output coupled to the input of a first stage pump cylinder 1265. The output of the first stage pump cylinder is coupled to a second check valve 1280*b*. The output of check valve 1280*b* is coupled to the input of a snubber 1285. the output of snubber 1285 is the electrolyte output port 1287. Snubber piston 1268 provides damping of the output fluctuations.

Check valves 1280*a* and 1280*b* are controlled to allow only one valve to be open at one time. A dead zone may also be employed so that there is a minimum period of time during which both valves are kept closed before either is opened. The dead zone eliminates transient completion of an ionic conduction path. The wetted parts of check valves 1280*a* and 1280*b* are preferably constructed of dielectric materials (e.g., a fluorocarbon polymer) so that electrical conduction does not occur between the input and output connections.

An operation cycle for the isolation pump 1291 begins with both valves closed and the piston stationary in the up position. After valve 1280*a* is opened, a piston downstroke is made then valve 1280*a* is closed. After the dead zone period, valve 1280*b* is opened and the piston upstroke is made then valve 1280*b* is closed.

FIG. 13A shows a perspective view 1300 of an embodiment of a parallel plate (microstrip) transmission line 1390 including an anode 1310, a dielectric 1315 and a cathode 1320 on a dielectric substrate 1305. The dielectric substrate 1305 may be a ceramic material, or it may be silicon substrate with a dielectric coating such as silicon dioxide or silicon nitride.

FIG. 13B shows a top view 1301 of the parallel plate transmission line 1390 of FIG. 12A. The anode 1310 is essentially a continuous sheet of conductive material deposited on the surface of dielectric substrate 1305. A deposited dielectric film 1315 separates the anode 1310 from the cathode 1320. The dielectric 1316 has an apron region 1316 extending out from the edge of the cathode 1320. The cathode 1320 includes an array of fingers 1320*a* having a width W2, adjacent to anode stripes 1310*a* having a width W1. The ratio W1/W2 may be varied to adjust the electrode area ratio. For a given substrate area, decreasing W1 and W2 decreases the total resistance between the anode 1310 and the cathode 1320. The pattern 1390 may stepped and repeated over a large area with bus connections to each pattern. W1 and W2 may be on the order of a micron.

Due to a large resistance or a large capacitance, or both, the RC time constant of an electrolytic cell may prevent the voltage across the double-layer capacitance in the cell from rising quickly enough to suit a particular process. In this instance, a voltage greater than the desired working cell voltage may be applied for a short duration to accelerate charging or discharging of the double-layer capacitance.

FIG. 14 shows a diagram 1400 for an embodiment of a waveform applied to an electrolytic cell for control of an interphase in an electrolytic cell. It is important to note that $V_{cell}$ is the voltage applied to the electrolytic cell as a whole. At the beginning of an electrolytic process a voltage $V_0$ is applied for a period to. The application of $V_0$ establishes a concentration profile for each of the charged species within the interphase at the electrodes of the electrolytic cell. The length of period to is preferably sufficient for the concentration profiles of the species of interest to equilibrate. $V_0$ is generally a voltage at which no intended redox reactions occur, although a small current may be observed due to redox reactions involving impurities. Although $V_0$ is shown to be opposite in polarity to $V_1$ and $V_2$, it may be of the same polarity. The waveform of FIG. 14 may be produced by the system shown in FIG. 3A.

For example, if the intended electrolytic process is a reduction reaction at the cathode, the application of $V_0$ to the electrode serving as the anode will produce a positive charge at the cathode. This positive charge will lower the cation concentration within the interphase at the cathode surface and increase the anion concentration in the interphase at the cathode surface. The mean distance between the cathode surface and the cations within the interphase will be increased.

Subsequent to period to, a voltage $V_1$ is applied for a period $t_1$. $V_1$ is a voltage that is greater in magnitude than the voltage $V_2$ at which the intended reaction will occur. For systems including a solvent and a dissolved electrolyte, $V_1$ may be equal to or greater than the cell potential at which the solvent is oxidized and/or reduced. For embodiments in which the electrolyte has a low conductivity, it is preferred that $V_1$ be greater than the voltage at which solvent electrolysis occurs.

It is important that $V_1$ and $t_1$ are closely controlled, since overcharging of the double-layer capacitance may occur. In processes where $V_1$ is greater than the voltage at which solvent electrolysis occurs, electrolysis is inevitable if $t_1$ is not sufficiently limited. The purpose of the $V_1/t_1$ pulse is to overcome the RC time constant of the electrolytic cell. Ideally, at the end of $t_1$, the potential across the double-layer capacitance is equal to the desired process potential associated with the cell voltage $V_2$, and has been reached in a time $t_1$ that is less than the time it would have taken if $V_2$ were applied directly.

The change in polarity from $V_0$ to $V_1$ and the magnitude of $V_1$ may result in large currents during the initial charging of the double-layer capacitance. It is important that the power supply providing $V_1$ have a low inductance and a low internal resistance so that current lag and limiting are minimized.

$V_2$ is the cell voltage at which the desired reaction (e.g., reduction at the cathode) occurs. $V_2$ may be the voltage associated with the onset of the reaction, but is preferably one hundred millivolts or more higher. Due to the small distances and short timescales involved with the interphase, it is desirable to carry out redox reactions with large overpotentials so that charge transfer kinetics are not a limiting factor. It is preferable that $V_2$ provide a sufficiently large reaction overpotential so that the time required for migration of a cation to the electrode is large compared to the time required for its reduction.

During the application of $V_1/t_1$ and $v_2/t_2$, cations will migrate toward the cathode, and their velocity will be influenced by charge, mass, and solvation. Not all cations will have the same velocity under the influence of the applied voltage, thus there will be a degree of segregation between the cations. Segregation may occur between cations with the same mass and different charge, or between cations with the same charge and different mass. The first species to arrive at the cathode will tend to be those with the greatest mobility. The period $t_2$ may be ended shortly after the first reduction reactions occur, thus limiting reaction participation to the initially closer and faster cations.

At the end of period $t_2$ a voltage $V_3$ is applied for a period $t_3$. The purpose of $V_3$ is to quickly remove the charge acquired by the double-layer capacitance during the application of $V_1$ and $V_2$. This charge removal helps to reset the electrolytic cell so that another pulse cycle can be applied. The application of $V_3$ for the period $t_3$ may be omitted from the waveform; however, the discharge of the double-layer capacitance may require a longer time. For processes involving the application of a series of pulses, the $V_3/t_3$ segment may be used to increase the pulse rate, and thus the throughput of the process.

At the end of period $t_3$ voltage $V_4$ is applied for a period $t_4$. In this instance $V_4$ is shown as being different from $V_0$; however $V_4$ may be equal to $V_0$. In the application of a series of pulses, the $V_0/t_0$ segment may be absent altogether (e.g., $V_0$=0). Also, $V_4$ is shown as being of opposite polarity from $V_1$ and $V_2$; however, $V_4$ may be of the same polarity as $V_1$ and $V_2$. $V_4$ serves as a reference voltage at which the electrolytic cell is allowed to equilibrate before the next application of $V_1$. In one embodiment, the period $t_4$ is at least ten times greater than the sum of $t_1$ and $t_2$. In another embodiment, the period t4 is at least 100 times greater than the sum of $t_1$ and $t_2$. Since cation diffusion can be significantly slower than cation migration in a large electric field, a relatively long period of time may be required for the equilibrium concentration of the cationic species being reduced to be restored in the interphase and the adjacent region in the bulk electrolyte.

FIG. 15 shows a block schematic view 1500 of an embodiment of an electrolytic cell power supply. A cascade of monostable multivibrators MMV1, MMV2, MMV3, MMV4, MMV5, MMV6, MMV7, and MMV8 form a tapped ring oscillator in which each of the multivibrators MMV1, MMV2, MMV3, MMV4, MMV5, MMV6, MMV7, and MMV8 produces an output pulse with a length that is determined by the time constants $R_1C_1$, $R_2C_2$, $R_3C_3$, $R_3C_3$, $R_3C_3$, $R_4C_4$, $R_5C_5$, $R_6C_6$, $R_7C_7$, and $R_8C_8$, respectively. The output pulse of MMV1 provides a delay between the output pulses from MMV8 and MMV2 to avoid shoottthrough in the NFETs. The output pulse of MMV2 drives a first high input and a first low input of H-bridge driver 1. The output pulse of MMV3 provides a delay between output pulse from MMV2 and MMV4 to avoid shoottthrough in the NFETs. The output pulse of MMV4 drives a second high input and a second low input of H-bridge driver 1. An example of a monostable multivibrator suitable for use in the ring oscillator is the TC7WH7123FU from the Toshiba Corporation.

The output pulse of MMV5 provides a delay between the output pulses from MMV4 and MMV6 to avoid shoottthrough in the NFETs. The output pulse of MMV6 drives a first high input and a first low input of H-bridge driver 2. The output pulse of MMV7 provides a delay between output pulse from MMV6 and MMV8 to avoid shoottthrough in the NFETs. The output pulse of MMV8 drives a second high input and a second low input of H-bridge driver 1.

A first pair of outputs of H-bridge driver 1 drives high side NFET5 and low side NFET4. A second pair of outputs of H-bridge driver 1 drives high side NFET3, high side NFET7, and low side NFET4. A first pair of outputs of H-bridge driver 2 drives high side NFET8 and low side NFET1. A second pair of outputs of H-bridge driver 2 drives high side NFET6, high side NFET8, and low side NFET1.

The circuit of FIG. 15 can be turned on and off by TTL level signals at the enable and trigger input. One or more of resistors $R_1$, $R_2$, $R_3$, $R_4$, $R_5$, $R_6$, $R_7$, and $R_8$ may be digitally controlled potentiometers to allow for altering the pulse width of the monostable multivibrators by a digital signal (e.g., from a microcontroller). Digital potentiometers frequently have a parasitic capacitance, and it must be taken into account when selecting the value for the timing capacitors $C_1$, $C_2$, $C_3$, $C_4$, $C_5$, $C_6$, $C_7$, and $C_8$. Examples of a digital potentiometer suitable for use is the AD5222 Dual Digital Potentiometer manufactured by Analog Devices, Inc.

A suitable device for use as H-bridge driver 1 and H-bridge driver 2 in FIG. 15 is the HIP4081A manufactured by the Intersil Corporation. A bridge driver circuit such as the HIP4081A is preferred as a driver for MOSFETs since the use of PFETs can be avoided, allowing all of the output MOSFETs to be NFETs. A Floating gate drive for the high side NFETs allows the supply voltages $V_{cc1}$, $V_{cc2}$, $V_{cc3}$, and $V_{cc4}$ to be significantly larger than the gate-to-source voltage ($V_{gs}$) on the high side NFETs. $V_{gs}$ is typically less than or equal to 15 volts.

FIG. 16 shows an electrical schematic diagram 1600 of an embodiment of an NFET output stage of an electrolytic cell power supply. Transistors M1, M2, M3, M4, M5, M6, M7, and M8 correspond to NFET1, NFET2, NFET3, NFET4, NFET5, NFET6, NFET7, and NFET8 respectively of schematic diagram 1500. A load circuit consisting of C1=2 microfarads, R1=1 megohm, and R3=5 ohms represents an arbitrary load model of an electrolytic cell. An inductance of L1=20 nanohenries is in series with the electrolytic cell. the value for R1=1 megohm represents a leakage current. The model is intended to illustrate the charging and discharging behavior of C1, and no appreciable redox reactions are involved.

Low side NFETs M1 and M4 are driven by sources V3 and V5 respectively. High voltage NFETs M5 and M2 are driven by sources V7 and V9, respectively. Low voltage NFETs M7 and M3 are driven by source V10. NFETs M7 and M3 are configured back-to-back to prevent diode conduction when M5 is on. Similarly, Low voltage NFETs M6 and M8 are driven by source V10 and are configured back-to-back to prevent diode conduction when M2 is on. As an alternative, the back-to-back NFET combination could be replaced by a NFET in series with an external diode at the expense of the diode forward voltage drop.

FIG. 17A shows a diagram of the modeled open circuit response of the circuit of FIG. 16. Voltage levels 1705, 1710, 1715, 1720, and 1725 correspond to V8=0.2 volts, V6=15 volts, V2=1 volt, V4=15.3 volts, and v8=0.2 volts, respectively. The NFET used in the model is the Si4850EY manufactured by Vishay Intertechnology, Inc. The Si4850EY NFET was selected to show the response of an electrolytic cell over a range of voltages. In practice, different devices would typically be chosen for different loads and operating voltages for optimal performance. The response was modeled with LTspice version 2.17g, from the Linear Technology Corporation. The ringing at the voltage level transitions is due to reactive components in the model that are not associated with the load (e.g., the parasitic capacitances in the NFETs).

FIG. 17B shows a diagram 1701 of the modeled response of the voltage across the double-layer capacitance C1 of circuit FIG. 15 with the parameters shown in FIG. 16.: L1=20 nanohenries, C1=2 microfarads, R1=1 Megohm, and R3=5 ohms, V8=0.2 volts, V6=15 volts, V2=1 volt, and V4=15.3 volts. The rising edge 1705 shows the rapid pullup of the voltage across C1 under the influence of the application of V6=15 volts. The ramp segment 1710 shows the gradual increase of the voltage across C1 during the application of V2=1 volt. The falling edge 1715 shows the rapid pulldown of the voltage across C1 under the influence of the application of V4=15.3 volts.

FIG. 17C shows a diagram 1702 of the modeled response of the voltage across the double-layer capacitance C1 of circuit FIG. 15 with the following parameters: L1=20 nanohenries, C1=100 microfarads, R1=1 Megohm, and R3=0.1 ohms, V8=0.2 volts, V6=15 volts, V2=1 volt, and V4=15.3 volts. It should be noted that the load RC time constant is the same for response 1701 and response 1702; however, the internal resistance of the NFETs has been manifested by a reduction in the peak voltage across C1, with a decrease of over 200 millivolts. Also, rising edge 1720, ramp segment 1725, and falling edge 1730 slightly rounded off.

FIG. 17D shows a diagram 1703 of the modeled response of the voltage across the double-layer capacitance C1 of circuit FIG. 15 with the following parameters: L1=20 nanohenries, C1=100 microfarads, R1=1 Megohm, and R3=0.1 ohms, V8=0.2 volts, V6=24 volts, V2=1 volt, and V4=24 volts. In comparison to diagram 1702, V6 and V4 have been increased from 15 volts and 15.3 volts to 24 volts. The increased supply voltage has increased the voltage across C1 to a value close to that of diagram 1701; however, rising edge 1735, ramp segment 1740, and falling edge 1745 are still slightly rounded off.

FIG. 17E shows a diagram 1704 of the modeled response of the voltage across the double-layer capacitance C1 of circuit FIG. 15 with the following parameters: L1=100 nanohenries, C1=100 microfarads, R1=1 Megohm, and R3=0.1 ohms, V8=0.2 volts, V6=24 volts, V2=1 volt, and V4=24 volts. In comparison to diagram 1703, the series inductance L1 has been increased from 10 nanohenries to 100 nanohenries. The ramp segment 1725 has been replaced by a sharp and slightly reduced peak 1755 and the rising edge 1750 and falling edge 1760 are slightly less steep. It should be noted that 100 nanohenries is still much lower than the inductance of a typical electroplating system.

FIG. 17F shows a diagram 1705 of the modeled response of the voltage across the double-layer capacitance C1 of circuit FIG. 15 with the following parameters: L1=100 nanohenries, C1=100 microfarads, R1=1 Megohm, and R3=0.1 ohms, V8=0.2 volts, V6=26 volts, V2=1 volt, and V4=23 volts. In comparison to diagram 1704, V6 and V4 have been increased from 15 volts and 15.3 volts to 26 volts and 23 volts, respectively. The peak amplitude has been restored at close to 630 millivolts; however, the rising edge 1765, falling edge 1775, and peak 1770, have not been restored.

FIG. 17G shows a diagram 1706 of the modeled response of the voltage across the double-layer capacitance C1 of circuit FIG. 15 with the following parameters: L1=500 nanohenries, C1=100 microfarads, R1=1 Megohm, and R3=0.1 ohms, V8=0.2 volts, V6=24 volts, V2=1 volt, and V4=24 volts. In comparison to diagram 1703, the series inductance L1 has been increased from 100 nanohenries to 500 nanohenries. The peak amplitude has been reduced to less than 160 millivolts, and the pulse has widened considerably.

FIG. 17H shows a diagram 1707 of the modeled response of the voltage across the double-layer capacitance C1 of circuit FIG. 15 with the following parameters: L1=500 nanohenries, C1=100 microfarads, R1=1 Megohm, and R3=0.1 ohms, V8=0.2 volts, V6=26 volts, V2=1 volt, and V4=23 volts. In comparison to diagram 1706, V6 and V4 have been increased from 15 volts and 15.3 volts to 55 volts and 51 volts, respectively. The 55 volt supply voltage is close to the limit for the Si4850EY NFET (60 volts), but the capacitor voltage amplitude is still below 600 millivolts.

FIGS. 17C-H illustrate some of the difficulties involved in rapidly charging and discharging the double-layer capacitance associated with an electrode area of roughly one square inch, particularly the impact of series inductance. Although inductance is frequently ignored, it is a considerable burden for systems intended to provide high-speed control of the interphase in electrolytic cells. Even for systems with low inductance, the selection of the proper switch devices and drive circuit topology is important for optimizing performance.

FIG. 18A shows an electrical schematic diagram 1800 of an embodiment of a dual voltage complementary MOSFET circuit for driving an electrolytic cell 1803. A positive supply voltage +Vcc is provided to a NFET M1 and a negative supply voltage −Vcc is provided to a PFET M2. The source of M1 and M2 are coupled to one terminal of the electrolytic cell 1803 and the other terminal of the electrolytic cell 1803 is connected to ground. A drive waveform is provided to the gates of M1 and M2 by sources V1 and V2, respectively. M1 and M2 may be augmented by additional transistors M1 and M2 in parallel.

FIG. 18B shows an electrical schematic diagram 1801 of an embodiment of a quadruple voltage complementary MOSFET circuit for driving an electrolytic cell 1825. Gain block 1805 includes a complementary bipolar transistor pair C1 as a driver stage for NFET M1, which switches high supply $+V_{cc2}$ to the load 1825. Gain block 1810 includes a complementary bipolar transistor pair C2 as a driver stage for back-to-back NFET M2 and NFET M3, which switches low supply $+V_{cc1}$ to the load 1825. Gain block 1815 includes a complementary bipolar transistor pair C3 as a driver stage for PFET M4, which switches high supply $-V_{cc4}$ to the load 1825. Gain block 1820 includes a complementary bipolar transistor pair C4 as a driver stage for back-to-back PFET M5 and PFET M6, which switch low supply $+V_{cc3}$ to the load 1825. The circuit shown in FIG. 18B may be used to provide the waveform shown in FIG. 14.

What is claimed:

1. A system for controlling an interphase at an electrode of an electrolytic cell comprising:

a control module for controlling a process in said electrolytic cell;

a waveform generator coupled to said control module;

a driver coupled to said waveform generator;

a switched current source coupled to said driver;

a transmission line electrode assembly coupled to said switched current source; and wherein said switched current source and said transmission line electrode assembly have a total inductance of less than 500 nanohenries and said transmission line electrode assembly has a capacitance of less than 100 microfarads.

2. The system of claim 1, wherein said switched current source is coupled to said transmission line electrode assembly by a transmission line bus.

3. The system of claim 1, wherein said transmission line electrode assembly is a statically configured transmission line.

4. The system of claim 1, wherein said transmission line electrode assembly is a coaxial transmission line.

5. The system of claim 1, wherein said transmission line electrode assembly is a parallel plate transmission line.

6. The system of claim 5, wherein said parallel plate transmission line comprises an electrolyte filled gap.

7. The system of claim 5, wherein said parallel plate transmission line comprises a solid dielectric filled gap.

8. The system of claim 1, wherein said transmission line electrode assembly is a coaxial transmission line.

9. The system of claim 8, wherein said coaxial transmission line comprises an electrolyte filled gap.

10. The system of claim 8, wherein said coaxial transmission line comprises a solid dielectric filled gap.

11. The system of claim 1, wherein said transmission line electrode assembly is coupled to said switched current source by a transmission line bus.

12. The system of claim 11, wherein said transmission line bus is a statically configured transmission line.

13. The system of claim 11, wherein said transmission line bus is a parallel plate transmission line.

14. The system of claim 11, wherein said transmission line bus is a coaxial transmission line.

15. The system of claim 1, wherein said transmission line electrode assembly is a transmission line duct.

16. The system of claim 1, wherein said transmission line electrode assembly comprises two or more transmission line ducts electrically connected in a serial configuration.

17. The system of claim 1, wherein said switched current source comprises a plurality of NFETs configured as an H-bridge.

18. A system for controlling an interphase at an electrode of an electrolytic cell comprising:

a control module for controlling a process in said electrolytic cell;

a waveform generator coupled to said control module;

a driver coupled to said waveform generator;

a switched current source coupled to said driver;

a transmission line electrode assembly coupled to said switched current source; and wherein said switched current source is configured to switch three or more independent current sources having different voltage levels.

19. The system of claim 18, wherein said transmission line electrode assembly comprises a transparent electrode.

20. The system of claim 19, further comprising an illumination module coupled to said transmission line electrode assembly.

* * * * *